US010806978B2

(12) United States Patent
Golden et al.

(10) Patent No.: US 10,806,978 B2
(45) **Date of Patent: *Oct. 20, 2020**

(54) GOLF CLUB HEAD WITH FLEXURE

(71) Applicant: Acushnet Company, Fairhaven, MA (US)

(72) Inventors: Charles E. Golden, Encinitas, CA (US); Thomas Orrin Bennett, Carlsbad, CA (US); Stephanie Luttrell, Carlsbad, CA (US); David S. Cornelius, San Marcos, CA (US); Stephen S. Murphy, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/421,876

(22) Filed: May 24, 2019

(65) Prior Publication Data

US 2019/0275388 A1 Sep. 12, 2019

Related U.S. Application Data

(63) Continuation of application No. 15/828,139, filed on Nov. 30, 2017, now Pat. No. 10,343,033, which is a (Continued)

(51) Int. Cl.
*A63B 53/04* (2015.01)
*A63B 60/54* (2015.01)
(Continued)

(52) U.S. Cl.
CPC ..... *A63B 53/0466* (2013.01); *A63B 53/06* (2013.01); *A63B 60/52* (2015.10); (Continued)

(58) Field of Classification Search
CPC ..... A63B 53/0466; A63B 60/54; A63B 53/06; A63B 60/52; A63B 2053/042; (Continued)

(56) References Cited

U.S. PATENT DOCUMENTS 708,575 A 9/1902 Mules
819,900 A 5/1906 Martin
(Continued)

FOREIGN PATENT DOCUMENTS

JP 1-91876 4/1989
JP 2002-052099 2/2002
(Continued)

OTHER PUBLICATIONS

Englis language translartion of JP Patent Publication No. 2002-52099A (full text).
English Machine Translation of JP2008-067813.

*Primary Examiner* — Sebastiano Passaniti
(74) *Attorney, Agent, or Firm* — Kevin N. McCoy

(57) ABSTRACT

A golf club head including a crown, a sole, a hosel, a face and a flexure. The flexure provides compliance during an impact between the golf club head and a golf ball, and is tuned to vibrate, immediately after impact, at a predetermined frequency. A filler at least partially fills the cavity defined between the front wall and the rear wall of the flexure and is exposed to the interior of the golf club head.

16 Claims, 38 Drawing Sheets

Related U.S. Application Data continuation-in-part of application No. 15/625,446, filed on Jun. 16, 2017, now Pat. No. 10,039,961, which is a continuation of application No. 14/982,789, filed on Dec. 29, 2015, now Pat. No. 9,682,293, which is a continuation-in-part of application No. 14/832,587, filed on Aug. 21, 2015, now Pat. No. 9,675,850, which is a continuation-in-part of application No. 14/666,167, filed on Mar. 23, 2015, now Pat. No. 9,561,410, which is a continuation of application No. 13/844,954, filed on Mar. 16, 2013, now Pat. No. 8,986,133, which is a continuation-in-part of application No. 13/720,885, filed on Dec. 19, 2012, now Pat. No. 8,834,290, which is a continuation-in-part of application No. 13/618,963, filed on Sep. 14, 2012, now Pat. No. 8,834,289.

(51) Int. Cl.
*A63B 53/06* (2015.01)
*A63B 60/52* (2015.01)
*A63B 60/00* (2015.01)

(52) U.S. Cl.
CPC ..... *A63B 60/54* (2015.10); *A63B 2053/042* (2013.01); *A63B 2053/045* (2013.01); *A63B 2053/0408* (2013.01); *A63B 2053/0412* (2013.01); *A63B 2053/0433* (2013.01); *A63B 2053/0437* (2013.01); *A63B 2053/0458* (2013.01); *A63B 2053/0491* (2013.01); *A63B 2060/002* (2015.10); *A63B 2209/00* (2013.01); *A63B 2209/02* (2013.01)

(58) Field of Classification Search
CPC ..... A63B 2060/002; A63B 2053/0458; A63B 2053/0433; A63B 2053/0491; A63B 2209/00; A63B 2053/04347; A63B 2053/045; A63B 2209/02; A63B 2053/0408; A63B 2053/0412
USPC ..... 473/324–350, 287–292
See application file for complete search history.

(56) References Cited

U.S. PATENT DOCUMENTS 1,705,997 A 3/1929 Quynn
1,854,548 A 4/1932 Hunt
2,968,486 A 1/1961 Walton
3,084,940 A 4/1963 Cissel
3,166,320 A 1/1965 Onions
4,398,965 A 8/1983 Campau
5,076,585 A 12/1991 Bouquet
D323,035 S 1/1992 Yang
5,092,599 A 3/1992 Okumoto et al.
5,492,327 A 2/1996 Biafore, Jr.
5,511,786 A 4/1996 Antonious
5,551,694 A 9/1996 Grim
D375,130 S 10/1996 Hlinka et al.
D382,612 S 8/1997 Oyer
5,772,527 A 6/1998 Liu
D413,952 S 9/1999 Oyer
6,042,486 A 3/2000 Gallagher
6,344,001 B1 2/2002 Hamada
6,348,013 B1 2/2002 Kosmatka
6,454,664 B1 9/2002 Long
D482,089 S 11/2003 Burrows
D482,090 S 11/2003 Burrows
D482,420 S 11/2003 Burrows
D484,208 S 12/2003 Burrows
D486,542 S 2/2004 Burrows
6,743,118 B1 6/2004 Soracco
6,783,465 B2 8/2004 Matsunaga
D501,036 S 1/2005 Burrows
D501,903 S 2/2005 Tanaka
6,855,068 B2 2/2005 Antonious
D504,478 S 4/2005 Burrows
6,887,165 B2 5/2005 Tsurumaki
D508,274 S 8/2005 Burrows
D520,585 S 5/2006 Hasebe
D523,104 S 6/2006 Hasebe
7,156,750 B2 1/2007 Nishitani et al.
7,160,205 B2 1/2007 Yamamoto
D536,402 S 2/2007 Kawami
7,226,366 B2 6/2007 Galloway
D552,701 S 10/2007 Ruggiero et al.
7,294,064 B2 11/2007 Tsurumaki et al.
7,318,782 B2 1/2008 Imamoto et al.
7,344,452 B2 3/2008 Imamoto et al.
7,347,795 B2 3/2008 Yamagishi et al.
7,438,649 B2 10/2008 Ezaki et al.
7,470,201 B2 12/2008 Nakahara et al.
7,500,924 B2 3/2009 Yokota et al.
7,530,901 B2 5/2009 Imamoto et al.
7,530,903 B2 5/2009 Imamoto et al.
7,572,193 B2 8/2009 Yokota et al.
7,582,024 B2 9/2009 Shear
7,682,264 B2 3/2010 Hsu et al.
D616,952 S 6/2010 Oldknow
7,731,603 B2 6/2010 Beach
7,857,711 B2 12/2010 Shear
7,896,753 B2 3/2011 Boyd et al.
7,934,998 B2 5/2011 Yokota
8,206,241 B2 6/2012 Boyd et al.
8,235,841 B2 8/2012 Stites et al.
8,235,844 B2 8/2012 Albertsen
8,277,337 B2 10/2012 Shimazaki
8,328,659 B2 12/2012 Shear
8,403,771 B1 3/2013 Rice
8,435,134 B2 5/2013 Tang et al.
8,517,860 B2 8/2013 Albertsen et al.
8,529,368 B2 9/2013 Rice et al.
8,579,728 B2 11/2013 Morales et al.
8,591,351 B2 11/2013 Albertsen et al.
8,641,555 B2 2/2014 Stites et al.
8,702,532 B2 4/2014 Shear
8,821,312 B2 9/2014 Burnett et al.
8,827,831 B2 9/2014 Burnett et al.
8,834,289 B2 9/2014 De la Cruz et al.
8,834,290 B2 9/2014 Bezilla et al.
8,858,360 B2 10/2014 Rice et al.
8,888,607 B2 11/2014 Harbert et al.
8,900,069 B2 12/2014 Beach et al.
8,956,242 B2 2/2015 Rice et al.
8,961,332 B2 2/2015 Galvan
8,986,133 B2 3/2015 Bennett et al.
9,011,267 B2 4/2015 Burnett et al.
9,101,808 B2 8/2015 Stites et al.
9,174,101 B2 * 11/2015 Burnett ..... A63B 60/52
9,211,448 B2 12/2015 Bezilla et al.
9,220,953 B2 12/2015 Beach et al.
9,265,993 B2 * 2/2016 Albertsen ..... A63B 53/047
9,320,949 B2 4/2016 Golden
9,409,067 B2 8/2016 De la Cruz et al.
9,421,433 B2 8/2016 Martens et al.
9,468,819 B2 * 10/2016 Rice ..... A63B 53/0466
9,498,688 B2 11/2016 Galvan et al.
9,526,956 B2 12/2016 Murphy
9,561,408 B2 2/2017 Bezilla et al.
9,561,410 B2 2/2017 Bennett
9,636,552 B2 5/2017 Cleg Horn et al.
9,636,559 B2 5/2017 De la Cruz et al.
9,675,850 B2 6/2017 Bennett et al.
9,682,290 B2 * 6/2017 Shear ..... A63B 53/0466
9,682,293 B2 6/2017 Bennett
9,700,765 B2 7/2017 Frame
9,764,207 B2 * 9/2017 Fossum ..... A63B 53/0466
9,839,820 B2 12/2017 Bennett
9,914,030 B2 3/2018 Cleghorn
9,937,390 B2 4/2018 Luttrell
10,039,961 B2 8/2018 Golden
10,076,689 B2 9/2018 de la Cruz

(56) References Cited

U.S. PATENT DOCUMENTS

| | | | | |
|---|---|---|---|---|
| 10,076,694 | B2 | 9/2018 | Galvan | |
| 10,099,092 | B2 | 10/2018 | Morin | |
| 10,343,032 | B2 * | 7/2019 | Martens | A63B 53/0466 |
| 10,343,033 | B2 * | 7/2019 | Frame | A63B 53/0466 |
| 2002/0183134 | A1 | 12/2002 | Allen | |
| 2003/0139227 | A1 | 7/2003 | Sugimoto | |
| 2004/0176183 | A1 | 9/2004 | Tsurumaki | |
| 2004/0192463 | A1 | 9/2004 | Tsurumaki | |
| 2005/0049081 | A1 | 3/2005 | Boone | |
| 2005/0255936 | A1 | 11/2005 | Huang | |
| 2006/0084525 | A1 | 4/2006 | Imamoto et al. | |
| 2007/0026961 | A1 | 2/2007 | Hou | |
| 2007/0082751 | A1 | 4/2007 | Lo | |
| 2007/0099726 | A1 | 5/2007 | Rife | |
| 2012/0142447 | A1 | 6/2012 | Boyd et al. | |
| 2012/0196701 | A1 | 8/2012 | Stites et al. | |
| 2012/0196703 | A1 | 8/2012 | Sander | |
| 2012/0244960 | A1 | 9/2012 | Tang | |
| 2013/0165254 | A1 | 6/2013 | Rice | |
| 2013/0331201 | A1 | 12/2013 | Wahl | |
| 2015/0174461 | A1 | 6/2015 | Bennett et al. | |
| 2015/0190688 | A1 | 7/2015 | Bennett et al. | |
| 2018/0221723 | A1 | 8/2018 | Luttrell | |
| 2018/0361216 | A1 | 12/2018 | Galvan | |

FOREIGN PATENT DOCUMENTS

| | | |
|---|---|---|
| JP | 2003-093554 | 4/2003 |
| JP | 2004-174224 | 6/2004 |
| JP | 2004-313762 | 11/2004 |
| JP | 2004-351054 | 12/2004 |
| JP | 2004-351173 | 12/2004 |
| JP | 2006-345911 | 12/2006 |
| JP | 2008-067813 | 3/2008 |

* cited by examiner

GOLF CLUB HEAD WITH FLEXURE

CROSS-REFERENCE TO RELATED APPLICATIONS

This application is a continuation of U.S. patent application Ser. No. 15/828,139, filed on Nov. 30, 2017, currently pending, which is a continuation-in-part of U.S. patent application Ser. No. 15/625,446, filed Jun. 16, 2017, now U.S. Pat. No. 10,039,961, which is a continuation of U.S. patent application Ser. No. 14/982,789, filed Dec. 29, 2015, now U.S. Pat. No. 9,682,293, which is a continuation-in-part of U.S. patent application Ser. No. 14/832,587, filed on Aug. 21, 2015, now U.S. Pat. No. 9,675,850, which is a continuation-in-part of U.S. patent application Ser. No. 14/666,167, filed on Mar. 23, 2015, now U.S. Pat. No. 9,561,410, which is a continuation of U.S. patent application Ser. No. 13/844,954, filed on Mar. 16, 2013, now U.S. Pat. No. 8,986,133, which is a continuation-in-part of U.S. patent application Ser. No. 13/720,885, filed on Dec. 19, 2012, now U.S. Pat. No. 8,834,290, which is a continuation-in-part of U.S. patent application Ser. No. 13/618,963, filed on Sep. 14, 2012, now U.S. Pat. No. 8,834,289, the disclosures of which are hereby incorporated by reference in their entireties.

FIELD OF THE INVENTION

The present invention relates to an improved golf club head. More particularly, the present invention relates to a golf club head having a compliant portion.

BACKGROUND

The complexities of golf club design are well known. The specifications for each component of the club (i.e., the club head, shaft, grip, and subcomponents thereof) directly impact the performance of the club. Thus, by varying the design specifications, a golf club can be tailored to have specific performance characteristics.

The design of club heads has long been studied. Among the more prominent considerations in club head design are loft, lie, face angle, horizontal face bulge, vertical face roll, center of gravity (CG), inertia, material selection, and overall head weight. While this basic set of criteria is generally the focus of golf club engineering, several other design aspects must also be addressed. The interior design of the club head may be tailored to achieve particular characteristics, such as the inclusion of hosel or shaft attachment means, perimeter weights on the club head, and fillers within hollow club heads.

Golf club heads must also be strong to withstand the repeated impacts that occur during collisions between the golf club and the golf ball. The loading that occurs during this transient event can create a peak force of over 2,000 lbs. Thus, a major challenge is designing the club face and body to resist permanent deformation or failure by material yield or fracture. Conventional hollow metal wood drivers made from titanium typically have a face thickness exceeding 2.5 mm to ensure structural integrity of the club head.

Players generally seek a metal wood driver and golf ball combination that delivers maximum distance and landing accuracy. The distance a ball travels after impact is dictated by the magnitude and direction of the ball's translational velocity and the ball's rotational velocity or spin. Environmental conditions, including atmospheric pressure, humidity, temperature, and wind speed, further influence the ball's flight. However, these environmental effects are beyond the control of the golf equipment manufacturer. Golf ball landing accuracy is driven by a number of factors as well. Some of these factors are attributed to club head design, such as center of gravity and club face flexibility.

The United States Golf Association (USGA), the governing body for the rules of golf in the United States, has specifications for the performance of golf balls. These performance specifications dictate the size and weight of a conforming golf ball. One USGA rule limits the golf ball's initial velocity after a prescribed impact to 250 feet per second+2% (or 255 feet per second maximum initial velocity). To achieve greater golf ball travel distance, ball velocity after impact and the coefficient of restitution of the ball-club impact must be maximized while remaining within this rule.

Generally, golf ball travel distance is a function of the total kinetic energy imparted to the ball during impact with the club head, neglecting environmental effects. During impact, kinetic energy is transferred from the club and stored as elastic strain energy in the club head and as viscoelastic strain energy in the ball. After impact, the stored energy in the ball and in the club is transformed back into kinetic energy in the form of translational and rotational velocity of the ball, as well as the club. Since the collision is not perfectly elastic, a portion of energy is dissipated in club head vibration and in viscoelastic relaxation of the ball. Viscoelastic relaxation is a material property of the polymeric materials used in all manufactured golf balls.

Viscoelastic relaxation of the ball is a parasitic energy source, which is dependent upon the rate of deformation. To minimize this effect, the rate of deformation must be reduced. This may be accomplished by allowing more club face deformation during impact. Since metallic deformation may be purely elastic, the strain energy stored in the club face is returned to the ball after impact thereby increasing the ball's outbound velocity after impact.

A variety of techniques may be utilized to vary the deformation of the club face, including uniform face thinning, thinned faces with ribbed stiffeners and varying thickness, among others. These designs should have sufficient structural integrity to withstand repeated impacts without permanently deforming the club face. In general, conventional club heads also exhibit wide variations in initial ball speed after impact, depending on the impact location on the face of the club. Hence, there remains a need in the art for a club head that has a larger "sweet zone" or zone of substantially uniform high initial ball speed.

Technological breakthroughs in recent years provide the average golfer with more distance, such as making larger head clubs while keeping the weight constant or even lighter, by casting consistently thinner shell thickness and going to lighter materials such as titanium. Also, the faces of clubs have been steadily becoming extremely thin. The thinner face maximizes the coefficient of restitution (COR). The more a face rebounds upon impact, the more energy that may be imparted to the ball, thereby increasing distance. In order to make the faces thinner, manufacturers have moved to forged, stamped or machined metal faces which are generally stronger than cast faces. Common practice is to attach the forged or stamped metal face by welding them to the body or sole. The thinner faces are more vulnerable to failure. The present invention provides a novel manner for providing the face of the club with the desired flex and rebound at impact thereby maximizing COR.

SUMMARY OF THE INVENTION

The present invention relates to a golf club head including a flexure that alters the compliance characteristics as compared to known golf club heads.

In another embodiment, a golf club head comprises a crown, a sole, a side wall, a hosel, and a face. The crown defines an upper surface of the golf club head. The sole defines a lower surface of the golf club head, and comprises a transmittal portion, a flexure and a rear portion. The side wall extends between the crown and the sole. The hosel extends from the crown and includes a shaft bore. The face defines a ball-striking surface, intersects the transmittal portion at a leading edge, and includes a face insert that forms at least a portion of the ball-striking surface. The face insert is constructed of maraging steel and has a thickness less than 2.0 mm. The flexure is spaced aftward of the ball-striking surface by the transmittal portion, and comprises a front wall, an apex and a rear wall. The front wall extends into a cavity defined by the golf club head and the rear wall extends into the cavity, and the front wall and the rear wall are coupled at the apex. The flexure is spaced from the ball-striking surface by a distance that is between 20% and 50% of a CG-Z-fc distance between the geometric face center of the golf club head and the center of gravity of the golf club head along a horizontal Z-axis that extends from the face to the aft of the golf club head.

In another embodiment, a golf club head comprises a crown, a sole, a side wall, a hosel, a face, and a filler member. The crown defines an upper surface of the golf club head. The sole defines a lower surface of the golf club head, and comprises a transmittal portion, a flexure and a rear portion. The flexure is defined by a front wall that is spaced from a rear wall to define a cavity. Each of the front wall and the rear wall extend from the sole toward an interior of the golf club head. The side wall extends between the crown and the sole. The hosel extends from the crown and includes a shaft bore. The face defines a front ball-striking surface and a back surface, and the face intersects the transmittal portion at a leading edge. The filler member at least partially fills the cavity defined between the front wall and the rear wall of the flexure. The golf club head defines an origin at a location on a shaft axis defined by the shaft bore in a plane defined by the proximal end of the hosel, an x-axis extending from the origin in a heel to toe direction and parallel to a plane that is tangent to the face at a geometric face center of the ball-striking surface, a y-axis extending vertically through the origin and perpendicular to a ground plane when the golf club head is in an address position on the ground plane, and a z-axis extending in a face to aft direction parallel to the ground plane when the golf club head is in an address position. The transmittal portion of the sole defines a first positive angled bounce surface between the face and the flexure of the golf club head, and the rear portion of the sole defines a second positive angled bounce surface between the flexure and a rear end of the golf club head.

In another embodiment, a golf club head comprises a crown, a sole, a side wall, a hosel, a face, and an elongate flexure. The crown defines an upper surface of the golf club head, and comprises a portion having constant thickness of between about 0.3 mm to about 0.4 mm. The sole defines a lower surface of the golf club head. The side wall extends between the crown and sole. The hosel extends from the crown and includes a shaft bore. The face defines a ball-striking surface and intersects the lower surface at a leading edge. A perimeter of the face is coupled to the crown and the sole. The elongate flexure is recessed into the sole and is defined by a first portion and a second portion. The length of the first portion is different than the length of the second portion so that the flexure has a generally sharktooth cross-sectional shape. The first portion extends from the sole toward the interior of the golf club head, the second portion extends from the sole toward the interior of the golf club head, and the first portion interfaces the second portion at an apex. The flexure extends across the body in a generally heel-to-toe direction within about 5.0 mm to about 20.0 mm from the leading edge of the golf club head and intersects at least a portion of the side wall of the golf club head.

In an embodiment, a golf club head includes a crown, a sole, a side wall, a hosel and a face. The crown defines an upper surface of the golf club head, the sole defines a lower surface of the golf club head and the side wall extends between the crown and the sole. The sole includes a transmittal portion, a flexure and a rear portion. The face defines a ball-striking surface and intersects the transmittal portion at a leading edge. The flexure is spaced aftward of the ball-striking surface by the transmittal portion. The flexure includes a front wall that extends into a cavity defined by the golf club head, a rear wall that extends into the cavity and the front wall and the rear wall are coupled at an apex. The flexure is spaced from the ball-striking surface by a distance that is between 20% and 50% of a CG-Z-fc distance between the geometric face center of the golf club head and the center of gravity of the golf club head along a horizontal Z-axis that extends from the front to the aft of the golf club head. Additionally, in an embodiment, the CG-Z-fc distance is at least 33.0 mm and the moment-of-inertia about a vertical axis extending through the center-of-gravity is at least 450 kg-mm$^2$.

In another embodiment, a golf club head comprises a crown, a sole, a side wall, a hosel, an interchangeable shaft system, a face and a weight member. The crown defines an upper surface of the golf club head. The sole defines a lower surface of the golf club head, and comprises a transmittal portion, a flexure and a rear portion. The side wall extends between the crown and the sole. The hosel extends from the crown and includes a shaft bore. The interchangeable shaft system includes a shaft sleeve and a fastener that couples the shaft sleeve to the shaft bore of the hosel. The fastener is disposed at least partially in an access bore that extends through the sole, wherein the access bore intersects the flexure. The face defines a ball-striking surface and intersects the transmittal portion at a leading edge. The weight member is disposed in a mounting feature that intersects the flexure. The flexure is spaced aftward of the ball-striking surface by the transmittal portion, and comprises a front wall, an apex and a rear wall. The front wall extends into a cavity defined by the golf club head and the rear wall extends into the cavity and the front wall and the rear wall are coupled at the apex.

In another embodiment, a golf club head comprises a crown, a sole, a side wall, a hosel, a face, and a filler. The crown defines an upper surface of the golf club head. The sole defines a lower surface of the golf club head, and comprises a transmittal portion, a flexure and a rear portion. The flexure is defined by a front wall that is spaced from a rear wall to define a cavity. Each of the front wall and the rear wall extend from the sole toward an interior of the golf club head. The side wall extends between the crown and the sole. The hosel extends from the crown and includes a shaft bore. The face defines a front ball-striking surface and a back surface, and the face intersects the transmittal portion at a leading edge. The filler at least partially fills the cavity defined between the front wall and the rear wall of the flexure. The golf club head defines an origin at a location on a shaft axis defined by the shaft bore in a plane defined by the proximal end of the hosel, an x-axis extends from the origin in a heel to toe direction and parallel to a plane that is tangent to the face at a geometric face center of the ball-striking surface, a y-axis extends vertically through the origin and perpendicular to a ground plane when the golf club head is in an address position on the ground plane, and a z-axis extends in a face to aft direction parallel to the ground plane when the golf club head is in an address position. The flexure is spaced aftward of the ball-striking surface by the transmittal portion, and comprises a front wall. The front wall extends into a cavity defined by the golf club head. The front wall and the rear wall form divergent flanges that are angled away from each other as they extend further toward the interior from the sole so that the fore/aft distance between the members increases from the lowest portion, when the golf club head is in the address position, to the most inward, upper ends.

In a still further embodiment, a golf club head comprises a crown, a sole, a side wall, a hosel, a face, and a filler. The crown defines an upper surface of the golf club head. The sole defines a lower surface of the golf club head, comprising a transmittal portion, a flexure and a rear portion. The flexure is defined by a front wall that is spaced from a rear wall to define a cavity. Each of the front wall and the rear wall extend from the sole toward an interior of the golf club head. The side wall extends between the crown and the sole. The hosel extends from the crown and includes a shaft bore. The face defines a front ball-striking surface and a back surface, and the face intersects the transmittal portion at a leading edge. The filler at least partially fills the cavity defined between the front wall and the rear wall of the flexure. The golf club head defines an origin at a location on a shaft axis defined by the shaft bore in a plane defined by the proximal end of the hosel, an x-axis extends from the origin in a heel to toe direction and parallel to a plane that is tangent to the face at a geometric face center of the ball-striking surface, a y-axis extends vertically through the origin and perpendicular to a ground plane when the golf club head is in an address position on the ground plane, and a z-axis extends in a face to aft direction parallel to the ground plane when the golf club head is in an address position. The flexure is spaced aftward of the ball-striking surface by the transmittal portion, and comprises a front wall. The front wall extends into a cavity defined by the golf club head. The front wall and the rear wall form convergent flanges that are angled toward each other as they extend further toward the interior from the sole so that the fore/aft distance between the members decreases from the lowest portion, when the golf club head is in the address position, to the most inward, upper ends.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE PREFERRED EMBODIMENT

Figure 1:
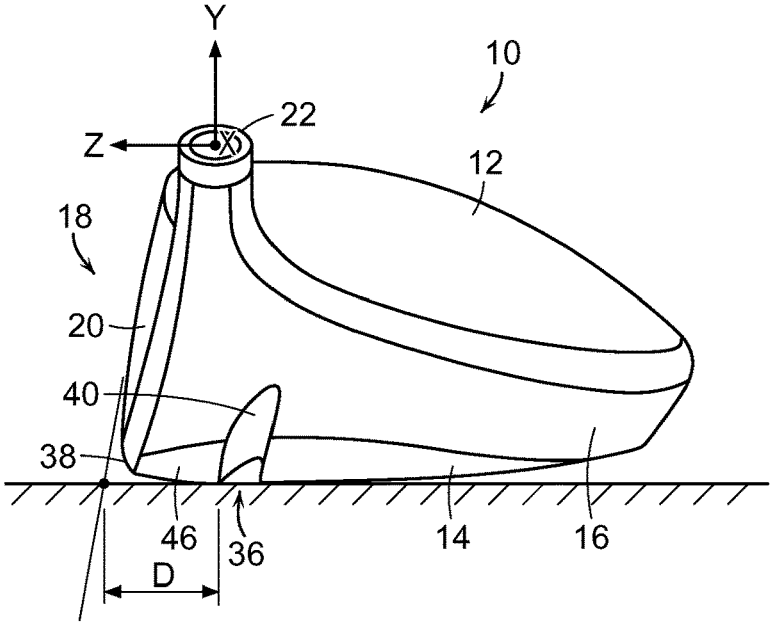
FIG. 1 is a side view of an embodiment of a golf club head of the present invention.

Other than in the operating examples, or unless otherwise expressly specified, all of the numerical ranges, amounts, values and percentages such as those for amounts of materials, moments of inertias, center of gravity locations, loft and draft angles, heights, widths, thicknesses, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Coefficient of restitution, or "COR", is a measure of collision efficiency. COR is the ratio of the velocity of separation to the velocity of approach. As an example, such as for a golf ball struck off of a golf tee, COR may be determined using the following formula:

$$(M_{ball}(V_{ball\text{-}post}-V_{ball\text{-}pre})+M_{club}(V_{ball\text{-}post}-V_{club\text{-}pre}))/M_{club}(V_{club\text{-}pre}-V_{ball\text{-}pre})$$

where, $V_{club\text{-}post}$ represents the velocity of the club after impact;

$V_{ball\text{-}post}$ represents the velocity of the ball after impact;

$V_{club\text{-}pre}$ represents the velocity of the club before impact (a value of zero for USGA COR conditions); and $V_{ball\text{-}pre}$ represents the velocity of the ball before impact.

Because the initial velocity of the ball is 0.0 during the collision, because it is stationary on a golf tee, the formula reduces to the following:

$$(M_{ball}V_{ball\text{-}post}+M_{club}(V_{ball\text{-}post}-V_{club\text{-}pre}))/M_{club}(V_{club\text{-}pre})$$

COR, in general, depends on the shape and material properties of the colliding bodies. A perfectly elastic impact has a COR of one (1.0), indicating that no energy is lost, while a perfectly inelastic or perfectly plastic impact has a COR of zero (0.0), indicating that the colliding bodies did not separate after impact resulting in a maximum loss of energy. Consequently, high COR values are indicative of greater ball velocity and distance.

Referring to FIGS. 1-4, an embodiment of a golf club head 10 of the present invention is shown. Club head 10 includes a construction that improves behavior of the club when struck by a golf ball, particularly when a lower portion of the face is struck. Club head 10 is a hollow body that includes a crown 12, a sole 14, a skirt 16, or side wall, that extends between crown 12 and sole 14, a face 18 that provides a ball striking surface 20, and a hosel 22. It should be understood that skirt 16 may comprise perimeter portions of crown 12 and sole 14 that curve towards each other to form the transition between an upper surface and a lower surface of the golf club head. The hollow body defines an inner cavity 24 that may be left empty or may be partially filled. If it is filled, it is preferable that inner cavity 24 be filled with foam or another low specific gravity material. Additionally, golf club head 10 includes at least one weight mounting feature 34 so that the overall weight of the golf club head can be altered and/or so the location of the center-of-gravity may be altered, and any number of weight mounting features may be included anywhere on the golf club head.

When club head 10 is in the address position, shown in FIG. 1, crown 12 provides an upper surface and sole 14 provides a lower surface of the golf club head. Skirt 16 extends between crown 12 and sole 14 and forms a perimeter of the club head. Face 18 provides a forward-most ball-striking surface 20 and includes a perimeter that is coupled to crown 12, sole 14 and skirt 16 to enclose cavity 24. Face 18 includes a toe portion 26 and a heel portion 28 on opposite sides of a geometric center of face 18. Hosel 22 extends outward from crown 12 and skirt 16 adjacent heel portion 28 of face 18 and provides an attachment structure for a golf club shaft (not shown).

Figure 2:
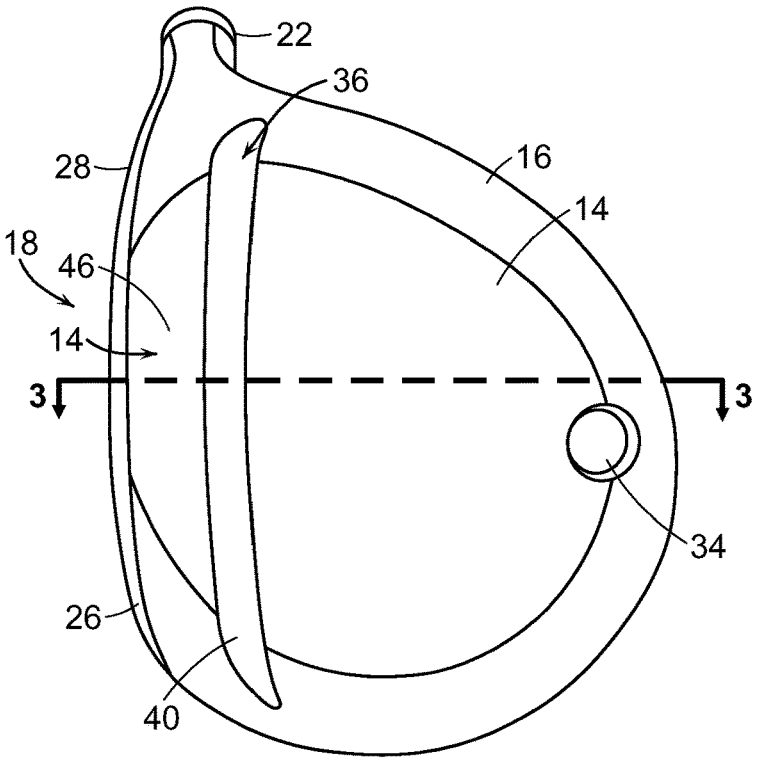
FIG. 2 is a bottom plan view of the golf club head of FIG. 1.
Figure 3:
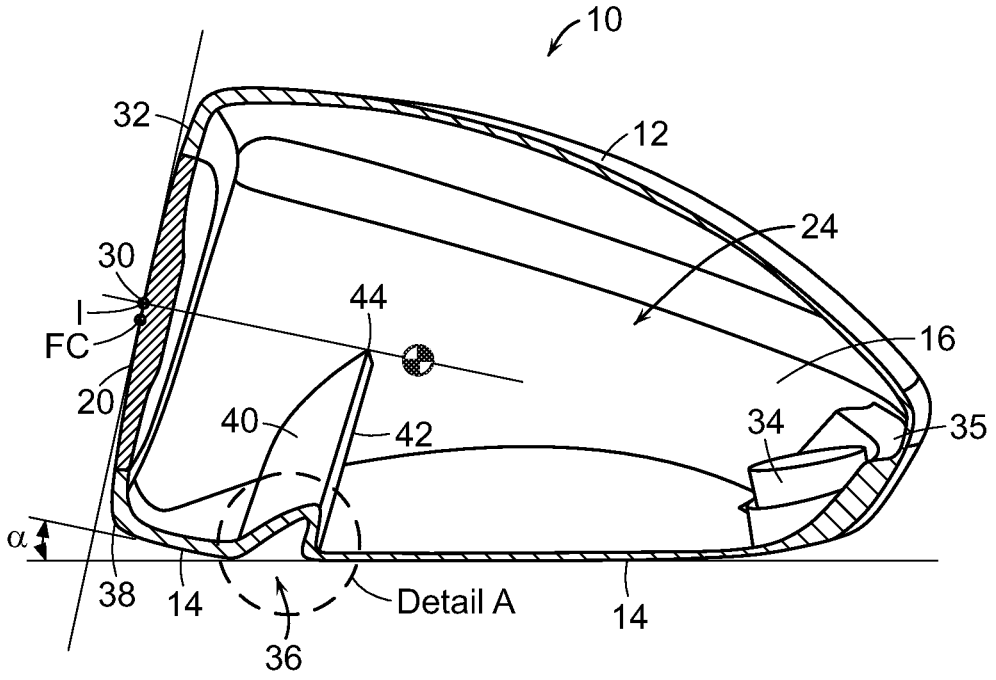
FIG. 3 is a cross-sectional view, corresponding to line 3-3 of FIG. 2.

Hosel 22 may have a through-bore or a blind hosel construction. In particular, hosel 22 is generally a tubular member and it may extend through cavity 24 from crown 12 to the bottom of the club head 10 at sole 14 or it may terminate at a location between crown 12 and sole 14. Furthermore, a proximal end of hosel 22 may terminate flush with crown 12, rather than extending outward from the club head away from crown 12 as shown in FIGS. 1 and 2.

Inner cavity 24 may have any volume, but is preferably greater than 100 cubic centimeters, and the golf club head may have a hybrid, fairway or driver type constructions. Preferably, the mass of the inventive club head 10 is greater than about 150 grams, but less than about 220 grams, although the club head may have any suitable weight for a given length to provide a desired overall weight and swing weight. The body may be formed of stamped, forged, cast and/or molded components that are welded, brazed and/or adhered together. Golf club head 10 may be constructed from a titanium alloy, any other suitable material or combinations of different materials. Further, weight members constructed of high density mater, such as tungsten, may be coupled to any portion of the golf club head, such as the sole.

Face 18 may include a face insert 30 that is coupled to a face perimeter 32, such as a face flange. The face perimeter 32 defines an opening for receiving the face insert 30. The face insert 30 is preferably connected to the perimeter 32 by welding. For example, a plurality of chads or tabs (not shown) may be provided to form supports for locating the face insert 30 or a face insert may be tack welded into position, and then the face insert 30 and perimeter 32 may be integrally connected by laser or plasma welding. The face insert 30 may be made by milling, casting, forging or stamping and forming from any suitable material, such as, for example, titanium, titanium alloy, carbon steel, stainless steel, beryllium copper, and carbon fiber composites and combinations thereof. Additionally, crown 12 or sole 14 may be formed separately and coupled to the remainder of the body.

The thickness of the face insert 30 is preferably between about 0.5 mm and about 4.0 mm. Additionally, the insert 30 may be of a uniform thickness or a variable thickness. For example, the face insert 30 may have a thicker center section and thinner outer section. In another embodiment, the face insert 30 may have two or more different thicknesses and the transition between thicknesses may be radiused or stepped. Alternatively, the face insert 30 may increase or decrease in thickness towards toe portion 26, heel portion 28, crown 12 and/or sole 14. It will be appreciated that one or both of the ball-striking surface or the rear surface of face 18 may have at least a portion that is curved, stepped or flat to vary the thickness of the face insert 30.

As mentioned above, club head 10 includes a construction that improves behavior of the club when it strikes a golf ball, particularly when a lower portion of the face impacts a golf ball. A flexure 36 is formed in a forward portion of the crown, sole and/or skirt. Flexure 36 is an elongate corrugation that extends in a generally heel to toe direction and that is formed in a forward portion of sole 14.

Flexure 36 is generally flexible in a fore/aft direction and provides a flexible portion in the club head 10 away from face 18 so that it allows at least a portion of face 18 to translate and rotate as a unit, in addition to flexing locally, when face 18 impacts a golf ball. The golf club head is designed to have two distinct vibration modes of the face between about 3000 Hz and about 6000 Hz, and the flexure is generally constructed to add the second distinct vibration mode of the face. The first face vibration mode primarily includes the local deflection of the face during center face impacts with a golf ball. The deflection profile of the second face vibration mode generally includes the entire face deflecting similar to an accordion and provides improved performance for off-center impacts between the face and a golf ball.

Flexure 36 is also configured to generally maintain the stiffness of sole 14 in a crown/sole direction so that the sound of the golf club head is not significantly affected. A lower stiffness of the sole in the crown/sole direction will generally lower the pitch of the sound that the club head produces, and the lower pitch is generally undesirable.

Flexure 36 allows the front portion of the club, including face 18, to flex differently than would otherwise be possible without altering the size and/or shape of face 18. In particular, a portion of the golf club head body adjacent the face is designed to elastically flex during impact. That flexibility reduces the reduction in ball speed, and reduces the backspin, that would otherwise be experienced for ball impacts located below the ideal impact location. The ideal impact location is a location on the ball-striking surface that intersects an axis that is normal to the ball-striking surface and that extends through the center of gravity of the golf club head, and as a result the ideal impact location is generally located above the geometric face center by a distance between about 0.5 mm and 5.0 mm. By providing flexure 36 in sole 14, close to face 18, the club head provides less of a reduction in ball speed, and lower back spin, when face 18 impacts a golf ball at a location below the ideal impact location. Thus, ball impacts at the ideal impact location and lower on the club face of the inventive club head will go farther than the same impact location on a conventional club head for the same swing characteristics. Locating flexure 36 in sole 14 is especially beneficial because the ideal impact location is generally located higher than the geometric face center in metal wood-type golf clubs. Therefore, a large portion of the face area is generally located below the ideal impact location. Additionally, there is a general tendency of golfers to experience golf ball impacts low on the face. Similar results, however, may be found for a club head 10 with flexures provided on other portions of the club head 10 for impacts located toward the flexure from the geometric face center. For example, a club having a flexure disposed in the crown may improve performance for ball impacts that are between the crown and the geometric face center.

In an embodiment, flexure 36 is provided such that it is substantially parallel to at least a portion of a leading edge 38 of the club head 10, so that it is generally curved with the leading edge, and is provided within a selected distance D from ball-striking surface 20. Preferably, flexure 36 is provided a distance D within 30 mm of ball-striking surface 20, more preferably within 20 mm of ball-striking surface 20, and more preferably between about 5.0 mm and 20.0 mm. For smaller golf club heads, such as those with fairway wood or hybrid constructions, it is preferable that the flexure 36 is provided within 10 mm of ball striking surface 20.

Flexure 36 is constructed from a first member 40 and a second member 42. First member 40 is coupled to a rearward edge of a forward transmittal portion 46 of sole 14 and curves into inner cavity 24 from sole 14. Second member 42 is coupled to a forward edge of a rearward portion of sole 14 and also curves into inner cavity 24 from sole 14. The ends of first member 40 and second member 42 that are spaced away from sole 14 are coupled to each other at an apex 44. Preferably, the flexure is elongate and extends in a generally heel to toe direction.

Figure 4:
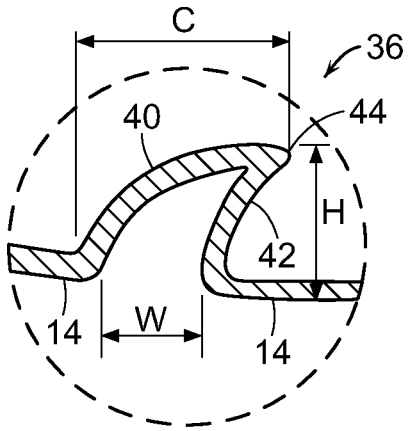
FIG. 4 is a cross-sectional view of a portion, shown in FIG. 3 as detail A, of the golf club head of FIG. 1.

The dimensions of flexure 36 are selected to provide a desired flexibility during a ball impact. Flexure 36 has a height H, a width W, and a curl length C, as shown in FIG. 4. Height H extends in the direction of the Y-axis between apex 44 and an outer surface of sole 14. Width W is the width of an opening in the sole that is created by flexure 36 and extends in the direction of the Z-axis between the junctions of flexure 36 with sole 14. Curl length C extends in the direction of the Z-axis and extends between the forward junction of flexure 36 with sole 14 and apex 44. Preferably, flexure 36 has a height that is greater than 4.0 mm, preferably about 5.0 mm to about 15.0 mm, more preferably about 6.0 mm to about 11.0 mm. Further, flexure 36 preferably has a width that is greater than 4.0 mm, preferably about 5.0 mm to about 12.0 mm, more preferably about 7.0 to about 11.0 mm. The flexure also has a wall thickness between about 0.8 mm and about 2.0 mm, and those dimensions preferably extend over a length that is at least 25% of the overall club head length along the X-axis. Further, first member 40 is curved inward, into the inner cavity, from the sole and preferably has a radius of curvature between about 20.0 mm and about 45.0 mm. Table 1, below, illustrates dimensions for inventive examples that provide a more efficient energy transfer, and therefore higher COR, for ball impacts that are below the ideal impact location of the golf club head.

TABLE 1

Flexure Dimensions

| | Height [mm] | Width [mm] | Curl Length [mm] |
|---|---|---|---|
| Inv. Example 1 | 10.0 | 10 | 13 |
| Inv. Example 2 | 6.5 | 10 | 13 |
| Inv. Example 3 | 10.0 | 8 | 13 |
| Inv. Example 4 | 6.5 | 8 | 13 |
| Inv. Example 5 | 5.0 | 8 | 13 |

The inventive examples described above were analyzed using finite element analysis to determine the effect on COR and vibration response of the golf club head. In particular, a club head lacking a flexure (i.e., Baseline) was compared to the inventive examples. Table 2 summarizes the comparison.

TABLE 2

Comparison

| | Weight Penalty [g] | Ball Speed [mph] | Extra Mode [Hz] | Mode 2 [Hz] | Mode 3 [Hz] | Mode 4 [Hz] |
|---|---|---|---|---|---|---|
| Baseline | N/A | 160.67 | N/A | 3409 | 3538 | 3928 |
| Inv. Example 1 | 7.0 | 157.16 | 2157 | 3608 | 3767 | 3907 |
| Inv. Example 2 | 5.4 | 161.28 | 3196 | 3639 | 3840 | 4002 |
| Inv. Example 3 | 7.6 | No data | 2186 | 3559 | 3706 | 3895 |
| Inv. Example 4 | 5.6 | 161.28 | 3406 | 3603 | 3796 | 4019 |
| Inv. Example 5 | 4.1 | 160.87 | N/A | 3540 | 3675 | 4163 |

In the above table, "extra mode" refers to a mode shape, or a natural mode of vibration that does not exist unless a flexure is present. The extra mode generally presents itself as the face portion rotating and flexing relative to the remainder of the golf club body. In particular, the inventive examples include a flexure that extends across a portion of the sole and the extra mode includes the face rotating about the interface between the face and crown so that the flexure flexes. The flexure is tuned so that that extra mode takes place in a range of frequencies from about 2900 Hz to about 4000 Hz, and more preferably at approximately 3600 Hz, which has been analyzed to be most effective in increasing the ball speed after impact. Practically speaking, that tuning results in the width W of the flexure varying sinusoidally, immediately after impact, at a frequency of about 2900 Hz to about 4000 Hz. If the extra mode takes place at a frequency that is higher or lower than that range, the ball speed can actually be lower compared to the baseline example that does not include a flexure. It has been determined using FEA analysis of inventive example 1 that a flexure that is tuned to provide an extra mode with a frequency below 2900 Hz, particularly approximately 2157 Hz, the ball speed is reduced below the baseline golf club head that does not include a flexure. Additionally, including a flexure that is too rigid provides a golf club head that does not include the extra mode, as shown by inventive example 5, and only provides minimal increase in ball speed after impact.

Transmittal portion 46 of sole 14 extends between flexure 36 and leading edge 38.

Transmittal portion 46 is preferably constructed so that the force of a golf ball impact is transmitted to flexure 18 without transmittal portion 46 flexing significantly. For example, transmittal portion is oriented so that it is less inclined to bend. In particular, a transmittal plane that is tangent to the center of transmittal portion 46 (in both fore/aft and heel/toe directions) of sole 14 is angled relative to the ground plane by an angle $\alpha$. Angle $\alpha$ is preferably less than, or equal to, the loft angle of the golf club head at address, so that the angle between the transmittal plane and the ball striking surface is generally equal to, or less than, 90° so that transmittal portion 46 is less likely to bend during a ball impact.

Figure 5:
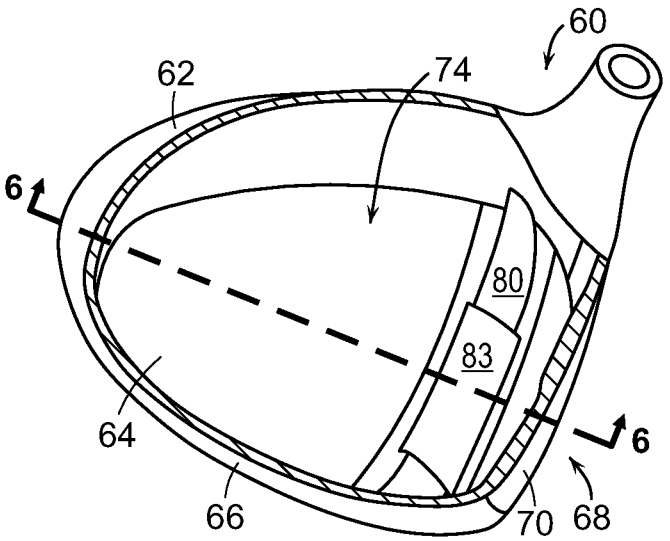
FIG. 5 is a perspective view of a portion of another embodiment of a golf club head of the present invention.
Figure 6:
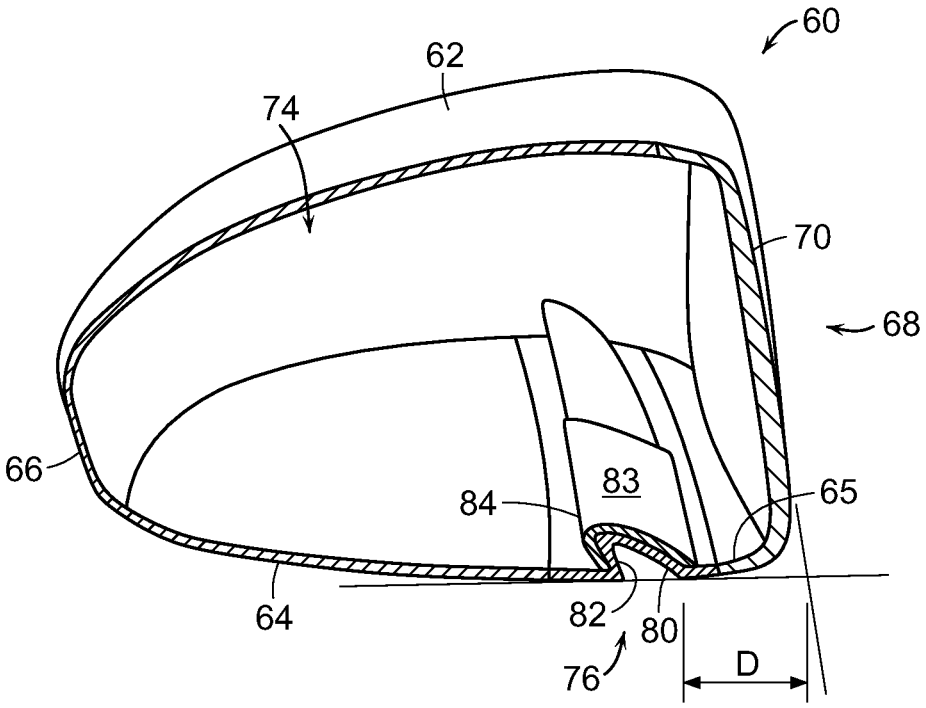
FIG. 6 is a cross-sectional view, corresponding to line 6-6 of FIG. 5.

Flexure 36 may be formed by any suitable manner. For example, flexure 36 may be cast as an integral part of sole 14. Alternatively, flexure 36 may be stamped or forged into a sole component. Additionally, the flexure may be formed by including a thickened region and machining a recess in that thickened region to form the flexure. For example, a spin-milling process may be used to provide a desired recess, the spin-milling process is generally described in U.S. Pat. No. 8,240,021 issued Aug. 14, 2012 as applied to face grooves, but a flexure with a desired profile may be machined using that process by increasing the size of the spin mill tool and altering the profile of the cutter. In general, that process utilizes a tool having an axis of rotation that is parallel to the sole and perpendicular to the leading edge of the golf club head and a cutting end that is profiled to create the desired profile of the flexure. The tool is then moved along a cutting path that is generally parallel to the leading edge. As a further alternative described in greater detail below, a separate flexure component may be added to a flexure on the sole to further tune the flexure of the sole, as shown in FIGS. 5 and 6.

As shown in the embodiment of FIG. 1, the face of the golf club head may include a face insert that is stamped, forged and/or machined separately and coupled to the body of the golf club head. Alternatively, the entire face may be stamped, forged or cast as part of a homogeneous shell, as shown in FIGS. 5 and 6, thereby eliminating the need to bond or otherwise permanently secure a separate face insert to the body. As a still further alternative, the face may be part of a stamped or forged face component, such as a face cup, that includes portions of the sole, crown and/or skirt. In such an embodiment, the face component is coupled to the remainder of the club head body away from the face plane by a distance from about 0.2 inches to about 1.5 inches. Preferably, the face component includes a transmittal portion of the sole that extends to a flexure or the face component includes both the transmittal portion and the flexure.

Figure 85:
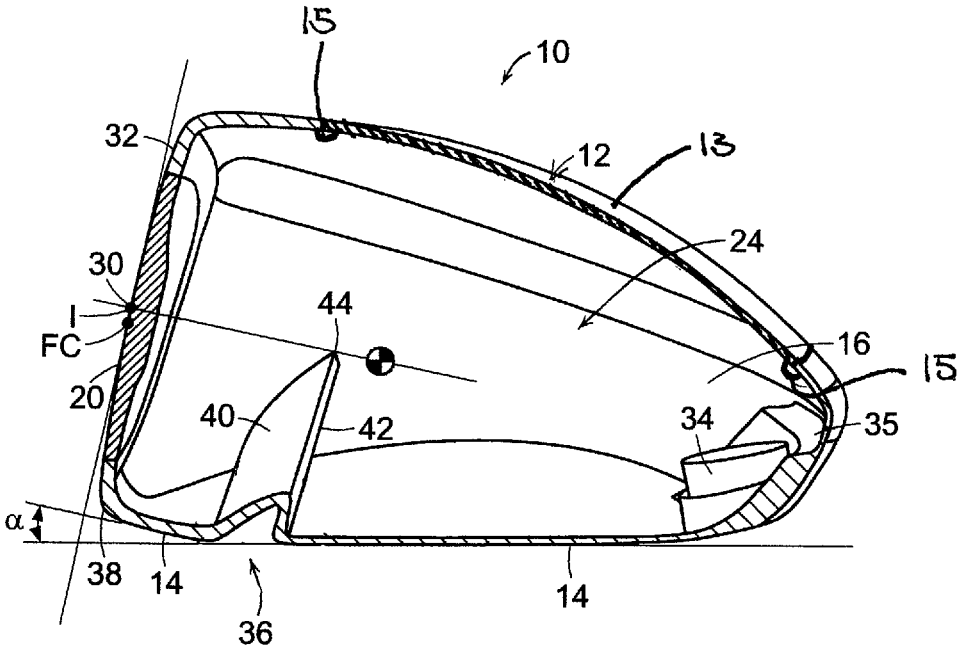
FIG. 85 is an alternative cross-sectional view, generally corresponding to line 3-3 of FIG. 2.

As a still further alternative, portions of the hollow body of golf club head 10 may be constructed as separate components and coupled to the remainder of the head, such as by welding, brazing or adhesives. Such a construction may be used to distribute mass to alter the location of the center of gravity or to alter the other physical properties of the head, such as moment of inertia. An example of a golf club head 10 including a crown 12 that is at least partially constructed from a separate crown component 13 is illustrated in FIG. 85. In an example, the crown component 13 is constructed from a titanium alloy as a separate component to provide improved control over the thickness of the component. In particular, the crown component 13 is constructed to have a thickness that is less than typically achievable with casting processes so that the mass of the crown can be minimized. Crown component 13 preferably has a thickness in a range of 0.30 to 0.40 mm, and more preferably about 0.35 mm in the final golf club head.

Various methods may be used to construct crown component 13. In one example, the chosen material may be rolled cold or hot and then formed such as by stamping. In additional examples, the material is formed in a flat sheet at a thickness greater than preferred, for example at a thickness of 0.6 mm. The sheet may be machined, chemically milled, or forged to form a recess, such as a 0.15 mm deep recess, before or after forming the sheet to the curvature required for the crown component. The component may then be coupled to the golf club head body and finally polished down another 0.1 mm to result in a final thickness of approximately 0.35 mm. Preferably, the crown component 13 is coupled to the remainder of the head body by a weld 15, such as by laser or plasma welding. In embodiments utilizing a titanium crown component, Ti-6Al-4V, ATI 425, and Ti-4Al-2.5V are examples of materials that may be used. Similar methods may be used to create thin components formed from other components such as steel or aluminum. It should be appreciated that any of the golf club heads described herein may include a crown component having a thickness, and manufactured, as described above.

In another embodiment, illustrated in FIGS. 5 and 6, a golf club head 60 is a hollow body that includes a crown 62, a sole 64, a skirt 66 that extends between crown 62 and sole 64, a face 68 that provides a ball striking surface 70, and a hosel 69. The hollow body defines an inner cavity 74 that may be left empty or it may be fully or partially filled.

A flexure 76 is formed in a forward portion of the sole, but it may alternatively be formed in the crown and/or skirt. Preferably, flexure 76 is an elongate corrugation that extends in a generally heel to toe direction and is formed in a forward portion of sole 64 of the body of golf club head 60. Flexure 76 provides a flexible portion in the club head 60 rearward from face 68 so that it allows at least a portion of face 68 to translate or rotate as a unit, in addition to flexing locally, when face 68 impacts a golf ball.

Flexure 76 allows the front portion of the club, including face 68, to flex differently than would otherwise be possible without altering the size and/or shape of face 68. That flexibility provides less reduction in ball speed that would otherwise be experienced for mis-hits, i.e., ball impacts located away from the ideal impact location, and less spin for impacts below the ideal impact location. For example, by providing flexure 76 in sole 64, close to face 68, the club head provides less of a reduction in ball speed when ball impact is located below the ideal impact location. Thus, during use, ball impacts that occur lower on the club face of the inventive club head will go farther than when compared with the same impact location on a club face of a conventional club head, for common swing characteristics.

In an embodiment, flexure 76 is provided such that it is substantially parallel to at least a portion of a leading edge 78 of the club head 60 and is provided within a certain distance D from ball-striking surface 70. Preferably, flexure 76 is provided a distance D within 30 mm of ball-striking surface 70, more preferably within 20 mm of ball-striking surface 70, and most preferably within 10 mm.

In the present embodiment, flexure 76 is constructed from a first member 80, a second member 82 and a third member 83 and is generally constructed as a separate component that is coupled to sole 64. First member 80 is coupled to a rearward edge of a forward transmittal portion 65 of sole 64 and curves into inner cavity 74 from the transmittal portion 65. Second member 82 is coupled to a forward edge of a rearward portion of sole 64 and also curves into inner cavity 74 from sole 64. The ends of first member 80 and second member 82 that are spaced away from sole 64 are coupled to each other at an apex 84. Preferably, the flexure is elongate and extends in a generally heel to toe direction. Flexure 76 may be bonded, welded or coupled to sole 64 using mechanical fasteners and the material of flexure 76 may be selected from materials having a plurality of densities, Young's moduli and dimensions to provide a plurality of flexures having different masses and stiffnesses. Furthermore, constructing the flexure as a separate component allows the repair of a broken flexure by replacing the flexure, and it allows the flexure to be constructed from different processes compared to the remainder of the golf club head such as by forging the flexure and casting the remainder of the golf club head.

Similar to previous embodiments, the dimensions of flexure 76 are selected to provide a desired elastic flex in response to a ball impact. Flexure 76 defines a height H, a width W, and a curl length C. Preferably, flexure 76 has a height that is greater than 4 mm, preferably about 5 mm to about 15 mm, and a width that is greater than 4 mm, preferably about 5 mm to about 10 mm, and a wall thickness between about 0.8 mm and about 2.0 mm, and those dimensions preferably extend over a length that is at least 25% of the overall club head length along the X-axis.

Flexure 76 includes third member 83 that may be used to tune the flexibility of flexure 76. Third member 83 may be coupled to an inner surface (as shown) or an outer surface of flexure 76 and locally increases the rigidity of flexure 76. Third member 83 is preferably constructed from a material that has a lower specific gravity than the material of at least one of first member 80 and second member 82. Third member 83 may be bonded, such as by using an adhesive, or mechanically coupled, such as by fasteners, welding or brazing, to first member 80 and second member 82. The third member may be constructed from any metallic material, such as aluminum, or non-metallic material, such as a carbon fiber composite material or polyurethane.

Figure 7:
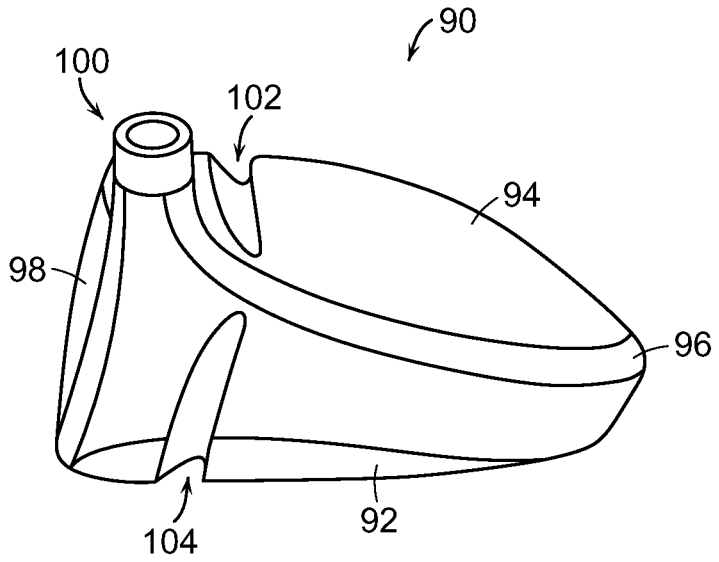
FIG. 7 is a side view of another embodiment of a golf club head of the present invention.
Figure 8:
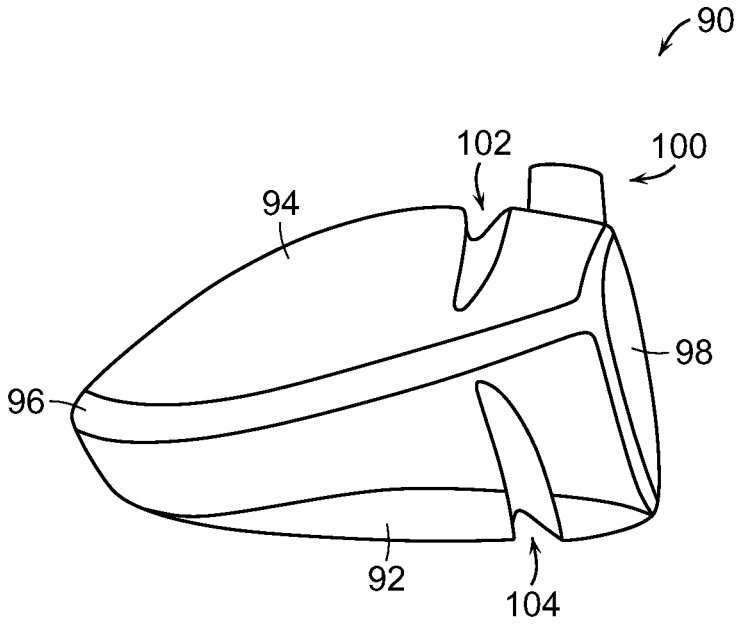
FIG. 8 is another side view of the golf club head of FIG. 7.

The location, dimensions and number of flexures in a golf club head may be selected to provide desired behavior. For example, a plurality of flexures may be included as shown in golf club head 90 of FIGS. 7 and 8. Golf club head 90 has a hollow body construction generally defined by a sole 92, a crown 94, a skirt 96, a face 98, and a hosel 100. A crown flexure 102 is disposed in a forward portion of crown 94 and a sole flexure 104 is disposed in a forward portion of sole 92. Each of the flexures 102, 104 is preferably shaped and dimensioned as the previously described flexures.

Figure 9:
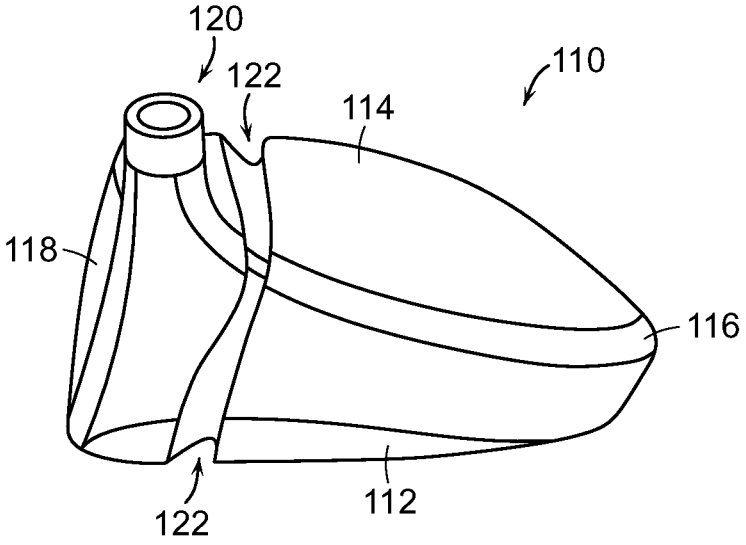
FIG. 9 is a side view of another embodiment of a golf club head of the present invention.
Figure 10:
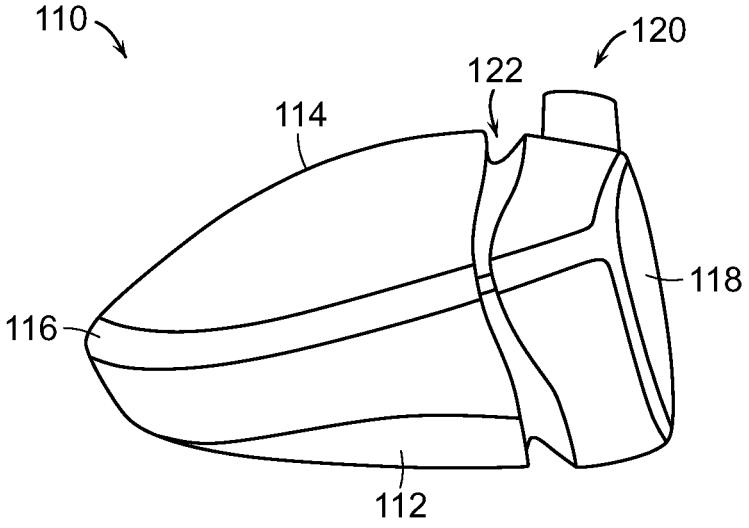
FIG. 10 is another side view of the golf club head of FIG. 9.

In other embodiments, flexures may be included that wrap around a portion of the golf club head body or entirely around the golf club head body. As shown in FIGS. 9 and 10, a golf club head 110 has a hollow body construction that is defined by a sole 112, a crown 114, a skirt 116, a face 118 and a hosel 120. A flexure 122 is formed in a forward portion of the golf club head and wraps around the perimeter of the golf club head. Flexure 122 is generally formed in a plane that is parallel to a face plane of golf club head 110. The distance between flexure 122 and face 118 may vary along its length to tune the local effect that flexure 122 provides to flexibility of the golf club head. For example, portions of flexure 122 may be spaced further from face 118 as compared to other portions. As illustrated, in an embodiment, heel and toe portions of flexure 122 are spaced further from face 118 than sole and crown portions of flexure 122. Additionally, the dimensions of flexure 122 may also be altered to tune the local effect that flexure 122 provides to the flexibility of the golf club head. As illustrated, portions of flexure 122 may have different height, width, and/or curl length to alter the behavior of the portions of flexure 122.

Figure 11:
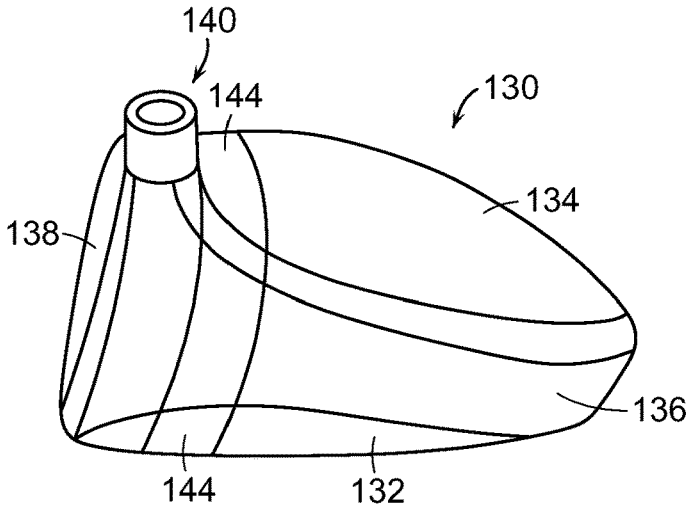
FIG. 11 is a side view of another embodiment of a golf club head of the present invention.
Figure 12:
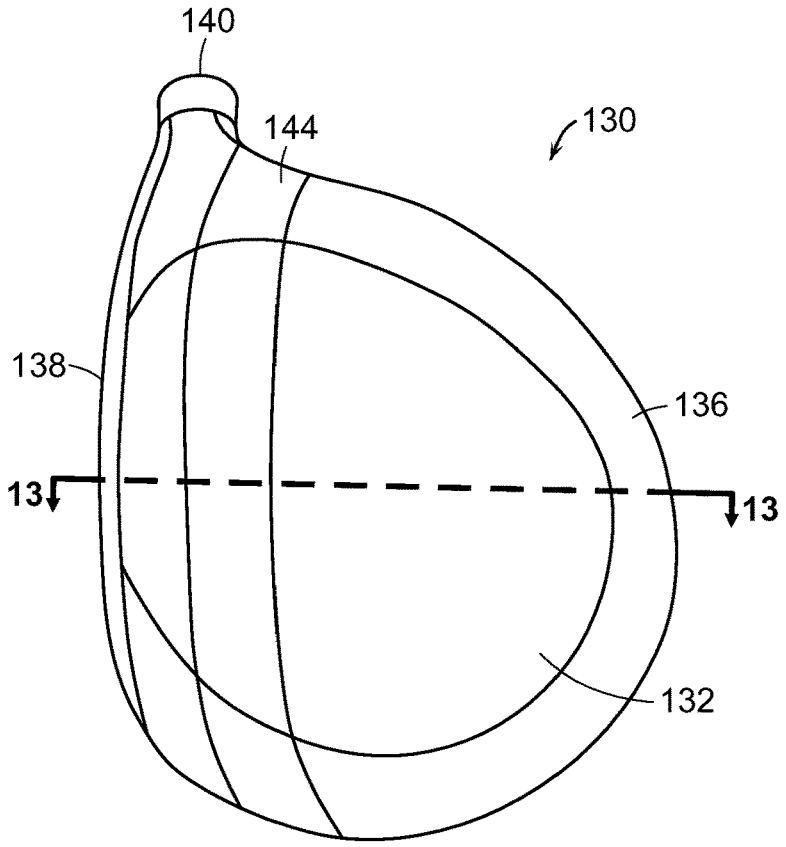
FIG. 12 is a bottom plan view of the golf club head of FIG. 11.
Figure 13:
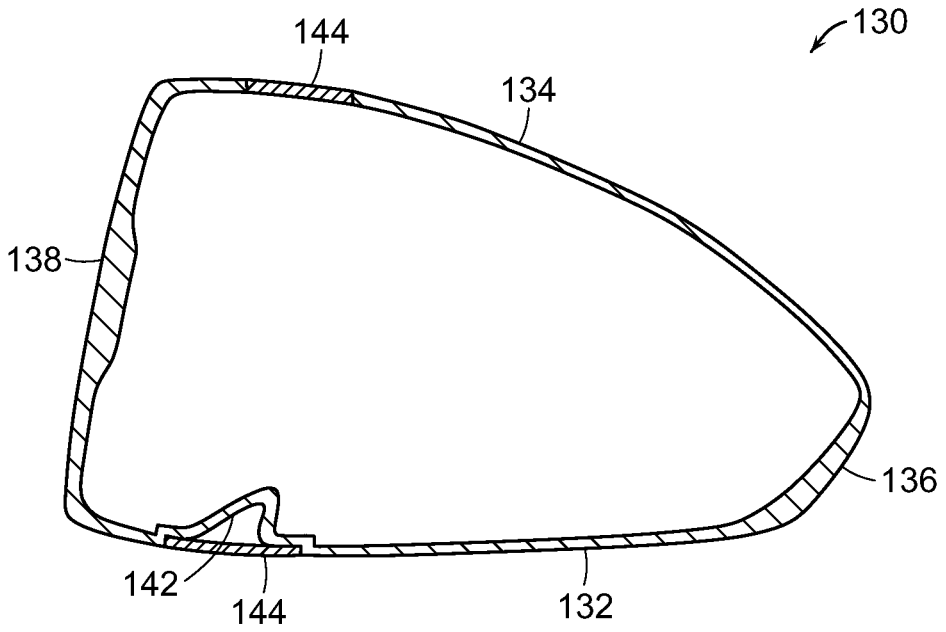
FIG. 13 is a cross-sectional view, corresponding to line 13-13 of FIG. 12.

In additional embodiments, a compliant flexure may be combined with a multi-material, light density cover member, as shown in FIGS. 11-13. For example, golf club head 130 generally has a hollow body construction that is defined by a sole 132, a crown 134, a skirt 136, a face 138 and a hosel 140. Golf club head 130 also includes a flexure 142 that is formed in a forward portion of sole 132 of golf club head 130. A cover 144 is also included in golf club head 130 and is configured to cover the outer surface of the flexure.

Cover 144 is generally a strip of material that is disposed across flexure 142 to generally enclose flexure 142. Cover 144 may be dimensioned so that it covers a portion or all of flexure 142, and it may extend into portions of golf club head 130 that do not include flexure. For example, and as shown in FIGS. 11 and 12, cover 144 extends across, and covers flexure 142 that is disposed on sole 132. Further, cover 144 forms a portion of skirt 136 and crown 134. Preferably, cover 144 is constructed of a material that is different than the materials of sole 132, crown 134 and skirt 136. Cover 144 is coupled to the adjacent portions of golf club head 130 by welding, brazing or adhering to those adjacent portions. Preferably, the flexure and cover are constructed from titanium alloys, such as beta-titanium alloys, and have widths between about 2.0 mm and about 20.0 mm, and thicknesses between about 0.35 mm to 2.0 mm.

Figure 77:
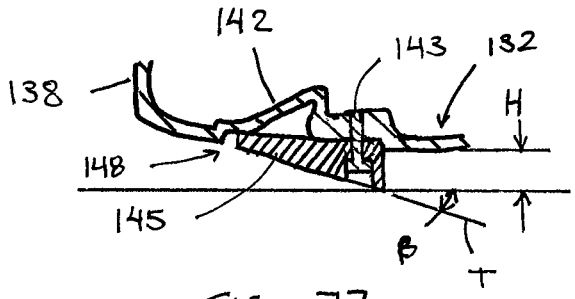
FIG. 77 is a cross-sectional view of a portion of an alternative embodiment of a golf club head, generally corresponding to line 13-13 of FIG. 12.
Figure 78:
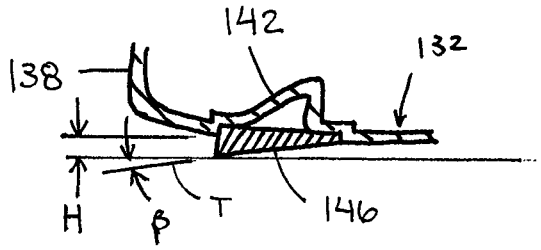
FIG. 78 is a cross-sectional view of a portion of an alternative embodiment of a golf club head, generally corresponding to line 13-13 of FIG. 12.
Figure 79:
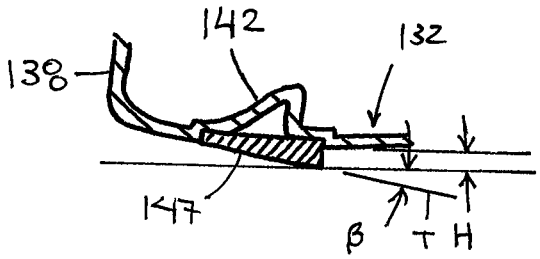
FIG. 79 is a cross-sectional view of a portion of an alternative embodiment of a golf club head, generally corresponding to line 13-13 of FIG. 12.

The cover may be included to both assist in the control of the address position of the golf club head when the sole is placed on the playing surface and to eliminate undesirable aesthetics of the flexure. In particular, the cover may be included to tune the visual face angle of the golf club head when the head is placed on the playing surface by altering the contact surface of the golf club head. For example, as shown in FIGS. 77-79, the shape of the cover is selected to provide a desired face angle at address. For example, in FIG. 77 a tapered cover 145 is provided that shifts a lowest portion rearward and lower than cover 144, which has an effect of creating an open visual face angle, i.e., rotating the toe of the golf club head rearward. The cover may be attached using mechanical fasteners, such as mechanical fastener 143 coupling cover 145 to sole 132. An edge of the cover may be in sliding contact with a portion of the sole 132 and a gap may be provided to allow for relative motion between the cover and the sole, such as shown at a leading edge 148 of cover 145. In another embodiment, shown in FIG. 78, another tapered cover 146 is provided that shifts the lowest portion forward compared to covers 144 and 145, which has the effect of creating a closed visual face angle. In a still further embodiment, shown in FIG. 79, a tapered cover 147 similar to cover 145 is constructed having a different taper angle θ (i.e., an angle formed between an axis T intersecting the end points of the outermost surface of the cover and the ground plane when the head is in the address position) and wedge height H (i.e., a height between the lowermost point on the cover when the golf club head is in the address position and the lowest point on the sole, not on the cover, relative to the ground plane when the golf club head is in the address position). Preferably, the cover has a taper angle between about 0° and about 25° and the wedge height is preferably in a range of about 0.1 mm to about 10.0 mm. The cover may be configured to wrap around a perimeter of the golf club head to the crown and may replace a portion of the material of the perimeter to create a lower density body structure to provide additional discretionary mass, a lower and/or deeper center of gravity location and a higher moment of inertia, thus improving performance and distance potential.

In effect, the cover provides crown compliance and the flexure provides sole compliance. As a further alternative, the cover may be removed from the flexure so that it only provides compliance in portions of the golf club head that are away from the sole. In such an example, the dimensions of the components are preferably in the ranges described with regard to FIGS. 11-13.

Figure 14:
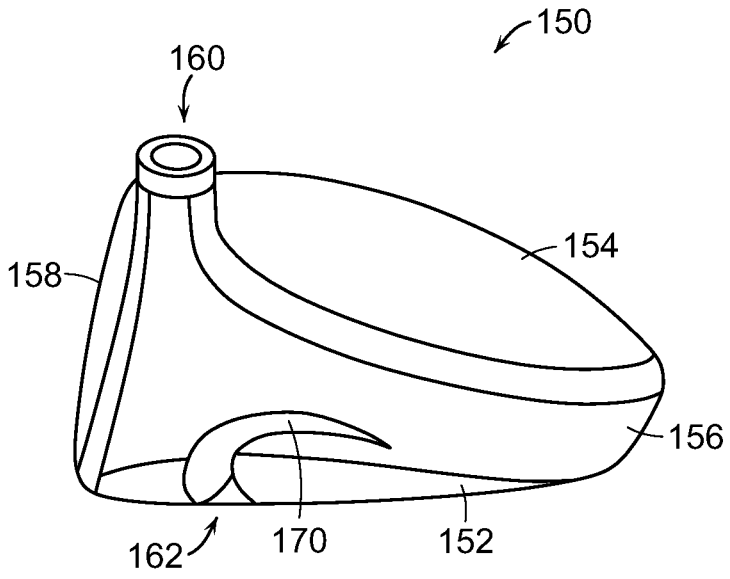
FIG. 14 is a side view of another embodiment of a golf club head of the present invention.
Figure 15:
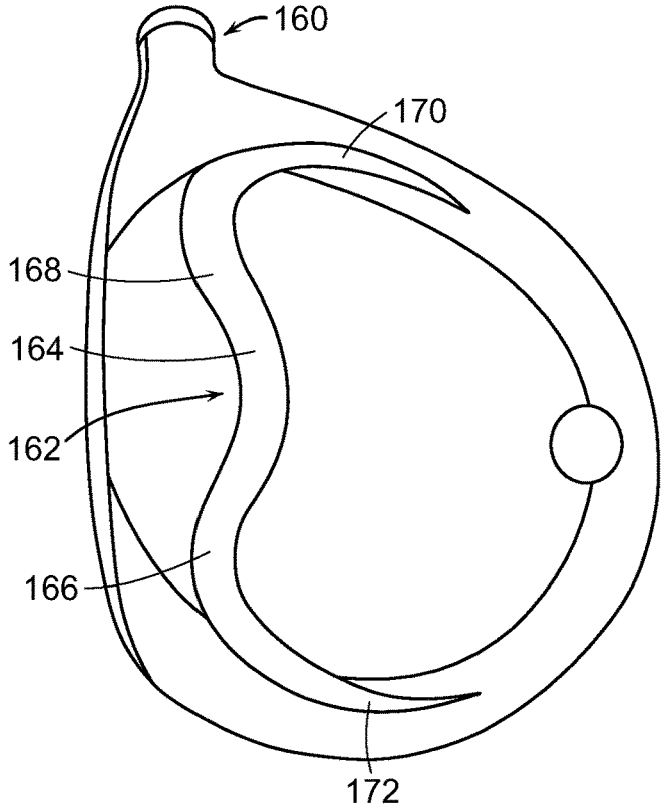
FIG. 15 is a bottom plan view of the golf club head of FIG. 14.

Referring now to FIGS. 14 and 15, a golf club head 150 including a flexure 162 having a varied spatial relationship to the face plane along its heel to toe length will be described. Due to the geometry of a golf club head face coupled with the circular shape of the stress imparted to the face during ball impact, the lower portion of the face generally experiences different magnitudes of stress at different heel-to-toe locations. Generally the portions of the golf club head at the heel and toe ends experience lower stresses than the portion of the golf club directly below the geometric center of the face and that stress gradient translates to the stress on the sole in the region of flexure 162. The distance of the flexure relative to the face plane and/or the leading edge of the face/sole intersection is altered to correspond to the relative amount of stress at the various portions. For example, the heel and toe portions of the flexure are preferably located closer to the face plane and leading edge of the golf club head so that those portions will be more likely to experience flexing even under the lower stress conditions, and especially during off-center ball impacts.

Golf club head 150 has a hollow body construction that is defined by a sole 152, a crown 154, a skirt 156, a face 158 and a hosel 160. Flexure 162 is formed in a forward portion of the golf club head and extends generally across the golf club head in a heel to toe direction through the sole and skirt. Flexure 162 generally includes a central portion 164, a toe portion 166 and a heel portion 168. As described above, the portions of flexure 162 are disposed at varied spatial relationships relative to the face plane so that central portion 164 is further aftward from the face plane compared to toe portion 166 and heel portion 168. Further, flexure 162 includes heel and toe extensions 170, 172 that extend from the heel and toe portions 168, 166, respectively along skirt 156 aftward. Heel and toe extensions 170, 172 may also extend aftward and meet at a location on the skirt or sole.

Figure 16:
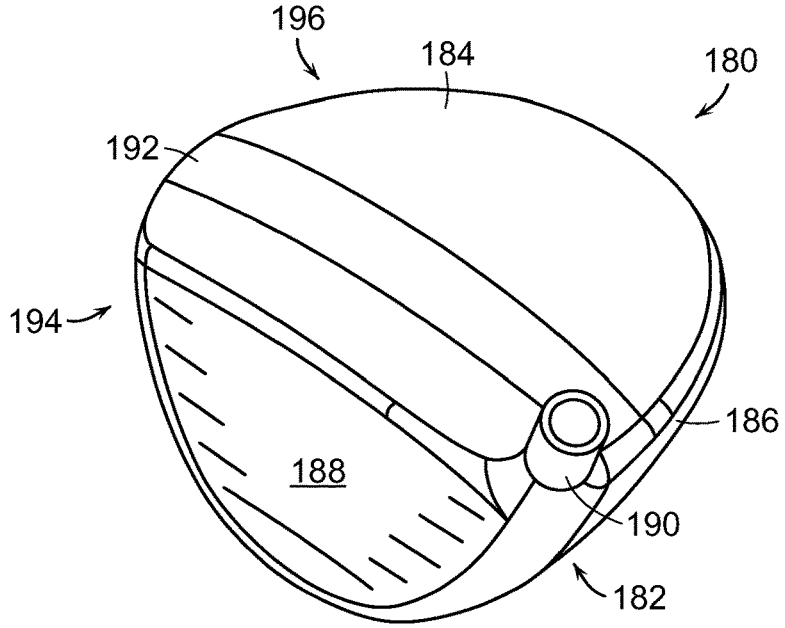
FIG. 16 is a perspective view of another embodiment of a golf club head of the present invention.
Figure 17:
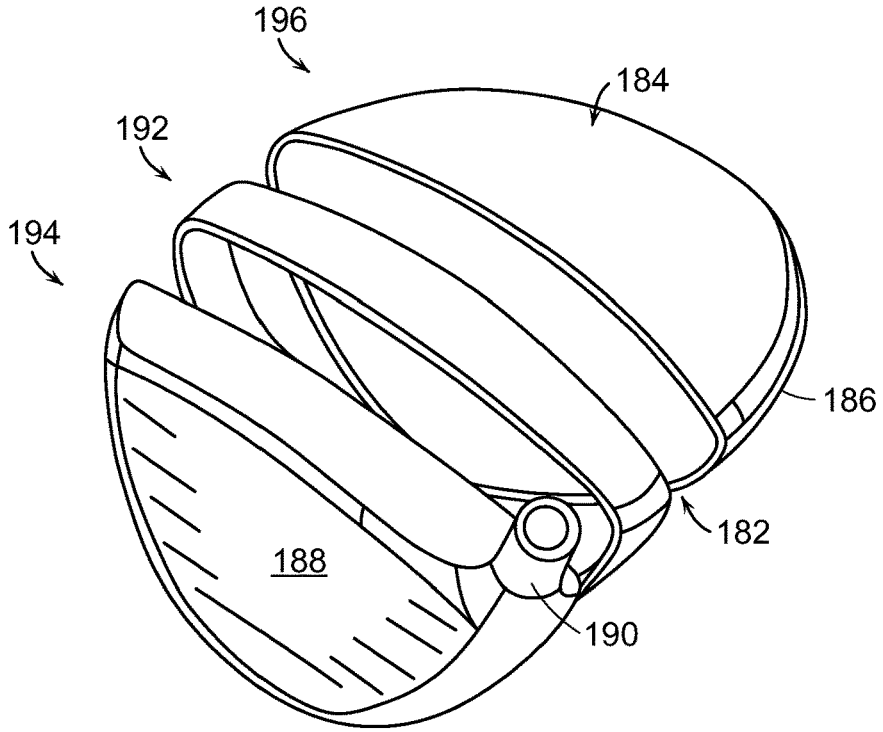
FIG. 17 is an exploded view of the golf club of FIG. 16.
Figure 18:
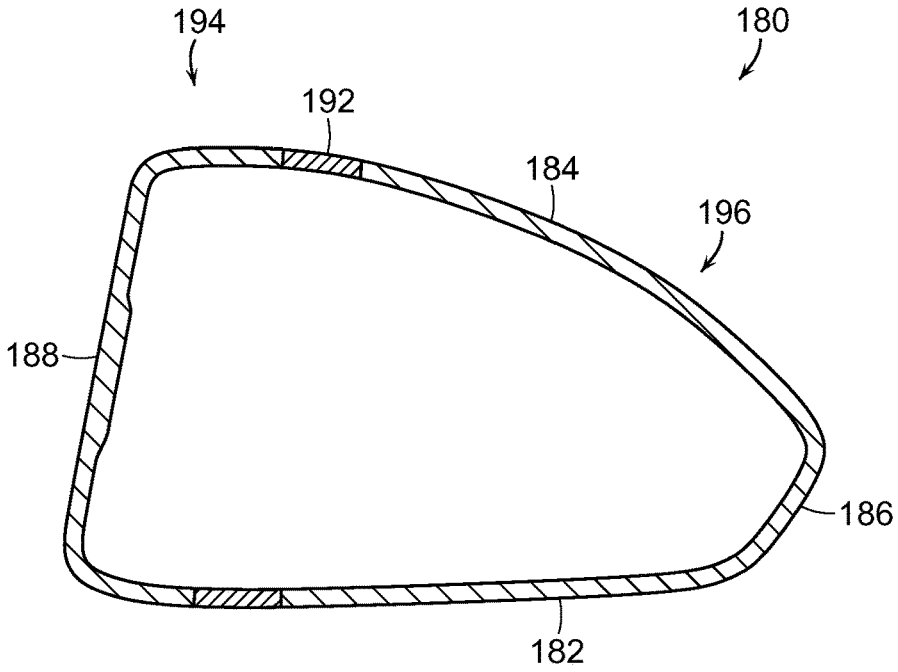
FIG. 18 is a cross-sectional view of the golf club of FIG. 16.

In additional embodiments, the flexure is provided primarily by a multi-material construction. Referring to FIGS. 16-18, a golf club head 180 generally has a hollow body construction that is defined by a sole 182, a crown 184, a skirt 186, a face 188 and a hosel 190, and includes a flexure 192. Flexure 192 is included in a forward portion of golf club head 180 and may be constructed as a tubular member, as shown, that is interposed between a face portion 194 and a rear body portion 196 so that it forms an intermediate ring. The ring has a selected stiffness to allow the face to deflect globally in concert with the deflection that occurs locally at the impact point. Similar to previous embodiments, flexure 192 is tuned so the impact imparts a frequency of vibration across the flexure that is about 2900 Hz to about 4000 Hz. The properties of the ring are selected as an additional means of controlling and optimizing the COR, and corresponding characteristic time (CT), values across the face, especially for ball impacts that are away from the ideal impact location.

Figure 19:
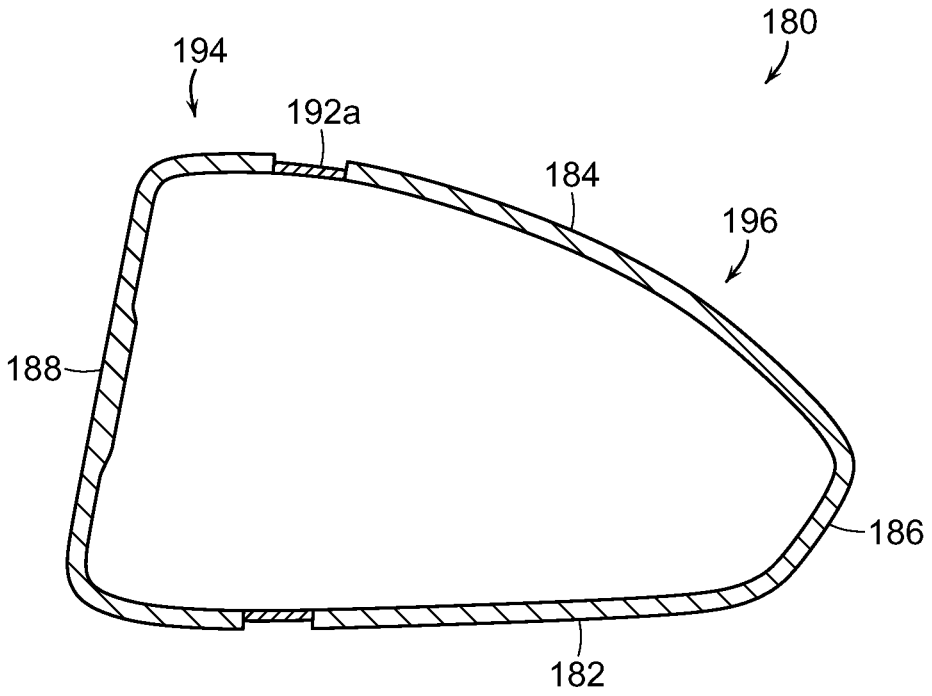
FIG. 19 is a cross-sectional view of an alternative construction of the golf club head of FIG. 16.

Flexure 192 is constructed of a material that provides a lower Young's Modulus than the adjacent portions of face portion 194 and rear body portion 196. Preferably, flexure 192, face portion 194, and rear body portion 196 are constructed from materials that can be easily coupled, such as by welding. For example, face portion 194 and rear body portion 196 are preferably constructed from a first titanium alloy and flexure 192 is constructed from a beta-titanium alloy as described in greater detail below. Flexure 192 may be constructed so that it has a thickness that is about equal to the thickness of the adjacent portions and so that the outer surface of flexure is flush with the outer surface of the adjacent portions, as shown in FIG. 18. Alternatively, as shown in FIG. 19, a flexure **192*a* may be constructed so that the thickness is different than the adjacent portions and so that the outer surface of flexure 192*a*** is recessed compared to the adjacent portions. As further alternatives, the flexure may be constructed so that the outer surface of the flexure is proud, or raised, compared to the adjacent portions.

Alternatively, a carbon composite ring may be incorporated for flexure 192 that provides a lower stiffness. The joint configuration, ring geometry (such as the ring width and thickness which may vary with the location in the ring), ring position, fiber orientation, resin type and percentage resin content are all parameters that are selected to optimize the flexibility of flexure 192 so that the outgoing ball speed is improved across the face of the driver while the durability of the golf club head is maintained. Preferably, a carbon composite flexure is bonded to an adjacent metallic face portion and an adjacent metallic rear body portion. As an example, the flexure may be a ring having a width in a range of about 12.0 mm to about 20.0 mm and a thickness of about 0.5 mm to about 3.0 mm and the thickness may vary depending on the location around the perimeter.

Figure 20:
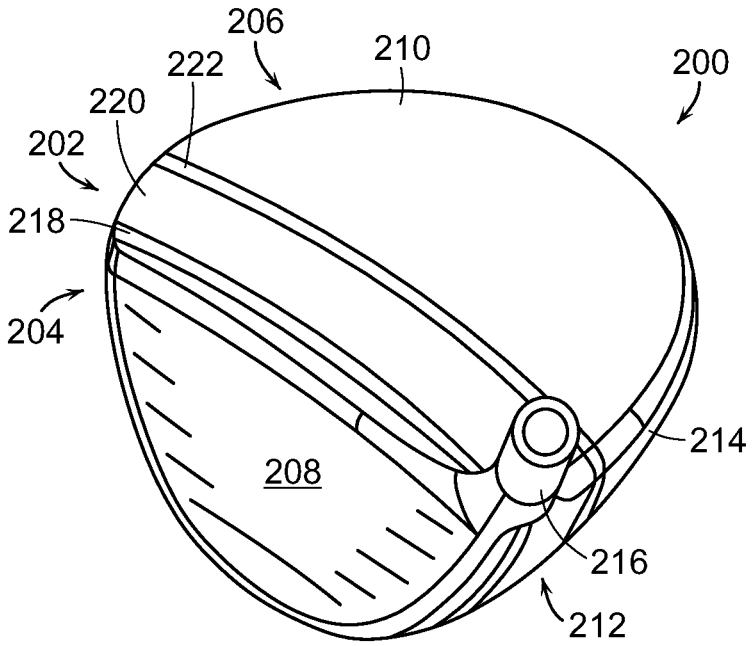
FIG. 20 is a perspective view of another embodiment of a golf club head of the present invention.
Figure 21:
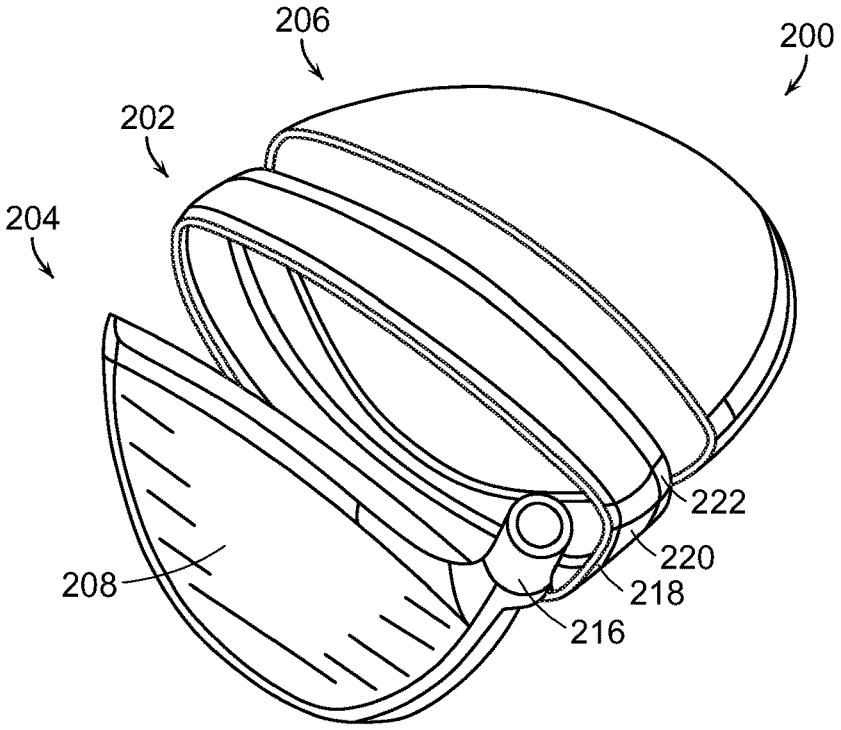
FIG. 21 is an exploded view of the golf club head of FIG. 20.

A multi-material flexure is incorporated into the golf club head of FIGS. 20 and 21. A golf club head 200 includes a flexure 202 that primarily relies upon the material properties to alter the stiffness, similar to flexure 192, but incorporates a multi-material construction. Golf club head 200 is generally constructed as a hollow body that is defined by a face portion 204, flexure 202 and rear body portion 206. When face portion 204, flexure 202 and rear body portion 206 are coupled, they generally form a face 208, a crown 210, a sole 212, a skirt 214 and a hosel 216.

Flexure 202 includes a front member 218, a central member 220, and an aft member 222. Preferably, the materials are chosen so that front member 218 and aft member 222 are easily coupled to face portion 204 and rear body portion 206 and so that central member 220 is thin and flexible enough to provide an extra vibration mode having a frequency in a range of about 2900 Hz to about 4000 Hz. In an embodiment, front member 218 and aft member 222 are metallic, and central member 220 is interposed between front member 218 and aft member 222 and is constructed of a carbon fiber composite. Preferably, aft member 222 is spaced from an interface between face 208 and front member 218 by at least 6.0 mm and more preferably, at least 12.0 mm. Hosel 216 may be constructed of metallic and/or non-metallic materials. In an embodiment, face portion 204 and rear body portion 206 are constructed of a titanium alloy, front member 218 and aft member 222 are constructed of a lower density, and preferably lower modulus, material than titanium, such as an aluminum or magnesium alloy, and central member 220 is constructed of a carbon fiber composite that is thin and flexible enough to provide the desired frequency response. Additionally, the front member and/or the aft member may be co-molded with the composite central member. Generally, the materials are selected to provide adequate bonding strength between the components using common practices, such as adhesive bonding.

Figure 22:
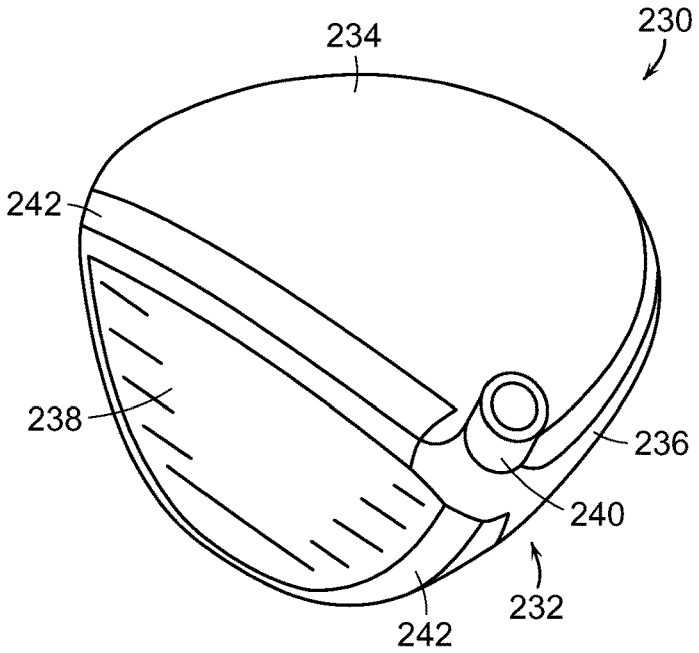
FIG. 22 is a perspective view of an embodiment of a golf club head of the present invention.
Figure 23:
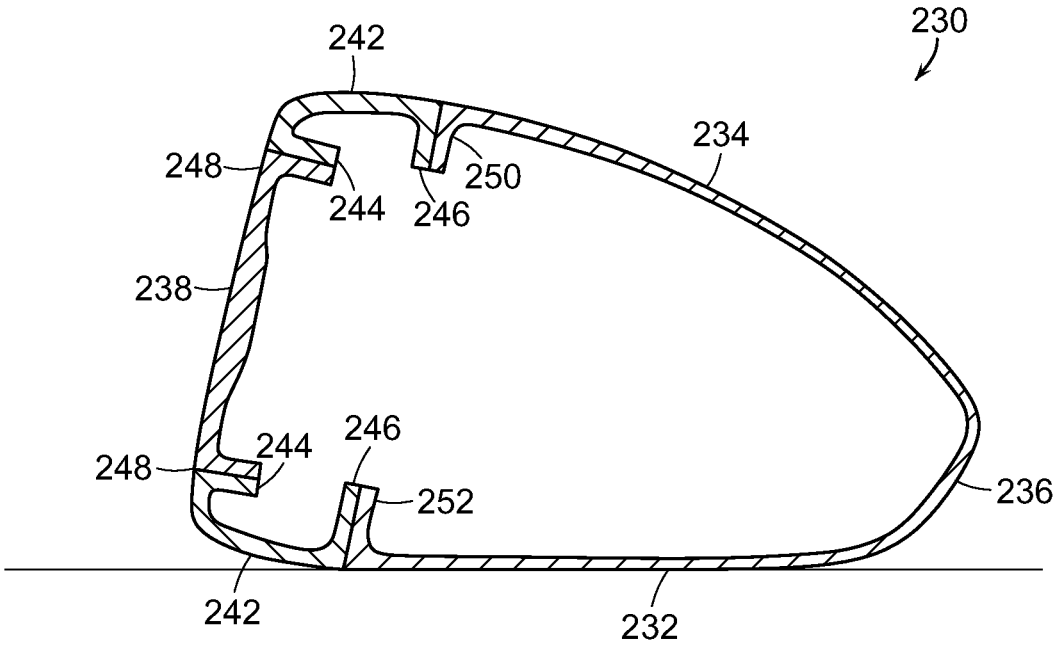
FIG. 23 is a cross-sectional view of an embodiment of a golf club head of the present invention.

Golf club heads of the present invention may also include a flexure that extends across the interface between the rear portion of the golf club head and the face, as shown in FIGS. 22 and 23. A golf club head 230 generally has a hollow body construction that is defined by a sole 232, a crown 234, a skirt 236, a face 238 and a hosel 240, and includes a flexure 242. Flexure 242 is included in a forward portion of golf club head 230 and is interposed between face 238 and sole 232, crown 234 and skirt 236.

The flexure has a selected stiffness to allow the face to deflect globally in concert with the deflection that occurs locally at the impact point. Similar to previous embodiments, flexure 242 is tuned so impact imparts a frequency of vibration across the flexure that is about 2900 Hz to about 4000 Hz. The properties of the ring are selected as an additional means of controlling and optimizing the COR, and corresponding characteristic time (CT), values across the face, especially for ball impacts that are away from the ideal impact location.

Flexure 242 is located generally around the perimeter of face 238 and so that it extends across the transitional curvature from the face of golf club head 230 to the rear portion of the golf club head, e.g., sole 232, crown 234 and skirt 236. Flexure 242 may be discontinuous, as shown, so that it is interrupted by the hosel portion of the golf club head. Flexure 242 terminates at flanges that provide coupling features for mounting flexure 242 in golf club head 230. It should be appreciated that coupling features may be surfaces provided to form butt joints, lap joints, tongue and groove joints, etc. Flexure 242 includes a face flange 244 and a rear flange 246. Face flange 244 is coupled to a perimeter edge 248 of face 238. Portions of rear flange 246 are coupled to portions of perimeter edges of sole 232, crown 234 and skirt 236, such as by being coupled to a crown flange 250 and a sole flange 252. Preferably, the face and rear flanges are between about 2.0 mm and about 12.0 mm.

Flexure 242 is preferably constructed of a material that provides a lower Young's modulus than the adjacent portions of the golf club head. Preferably, flexure 242, face 238, and the rear portion of golf club head 230 are constructed from materials that can be easily coupled, such as by welding. For example, face 238 and the rear portion are preferably constructed from a first titanium alloy and flexure 242 is constructed from a beta-titanium alloy as described in greater detail below.

Alternatively, flexure 242 may be constructed from a carbon fiber composite ring that provides a lower stiffness. The joint configuration, ring geometry, ring position, fiber orientation, resin type and percentage resin content are all parameters that are selected to optimize the flexibility of flexure 242 so that the outgoing ball speed is improved across the face of the driver while the durability of the golf club head is maintained. Preferably, a carbon composite flexure is bonded to an adjacent metallic face and an adjacent metallic rear body portion.

Figure 24:
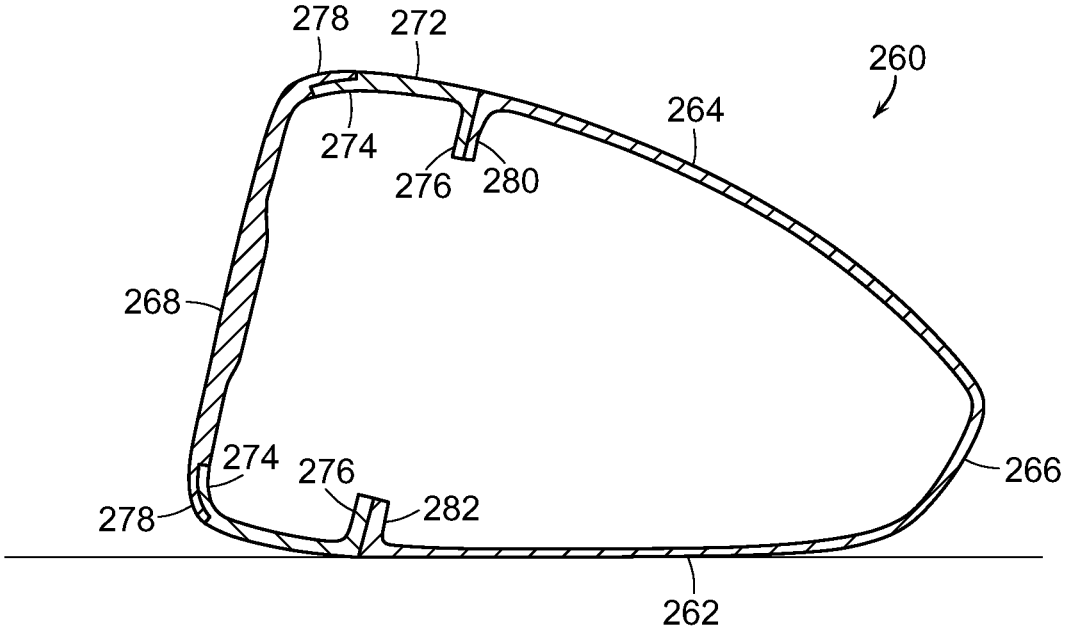
FIG. 24 is a cross-sectional view of an embodiment of a golf club head of the present invention.

In another embodiment, shown in FIG. 24, a flexure is coupled to a face member at the transition between the face and the rear portion of the golf club head. For example, a golf club head 260 generally has a hollow body construction that is defined by a sole 262, a crown 264, a skirt 266, a face 268, a hosel, and a flexure 272. Flexure 272 is included in a forward portion of golf club head 260 and is generally constructed as an annular member that is interposed between face 268, and sole 262, crown 264 and skirt 266.

Similar to previous embodiments, flexure 272 is tuned so impact imparts a frequency of vibration across the flexure that is about 2900 Hz to about 4000 Hz. Flexure 272 is located around the perimeter of face 268 and so that it extends across the transitional curvature from the face of golf club head 260 to the rear portion of the golf club head, e.g., sole 262, crown 264 and skirt 266. Flexure 272 terminates at flanges that provide examples of coupling features for mounting flexure 272 in golf club head 260. In particular, flexure 272 includes a face flange 274 and a rear flange 276. Face flange 274 is coupled to a perimeter flange 278 of face 268. Portions of rear flange 276 are coupled to portions of perimeter edges of sole 262, crown 264 and skirt 266, such as by being coupled to a crown flange 280 and a sole flange 282.

Flexure 272 is preferably constructed of a material that provides a lower Young's modulus than the adjacent portions of the golf club head. Preferably, flexure 272, face 268, and the rear portion of golf club head 260 are constructed from materials that can be easily coupled, such as by welding. For example, face 268 and the rear portion are preferably constructed from a first titanium alloy and flexure 272 is constructed from a beta-titanium alloy as described in greater detail below.

Figure 25:
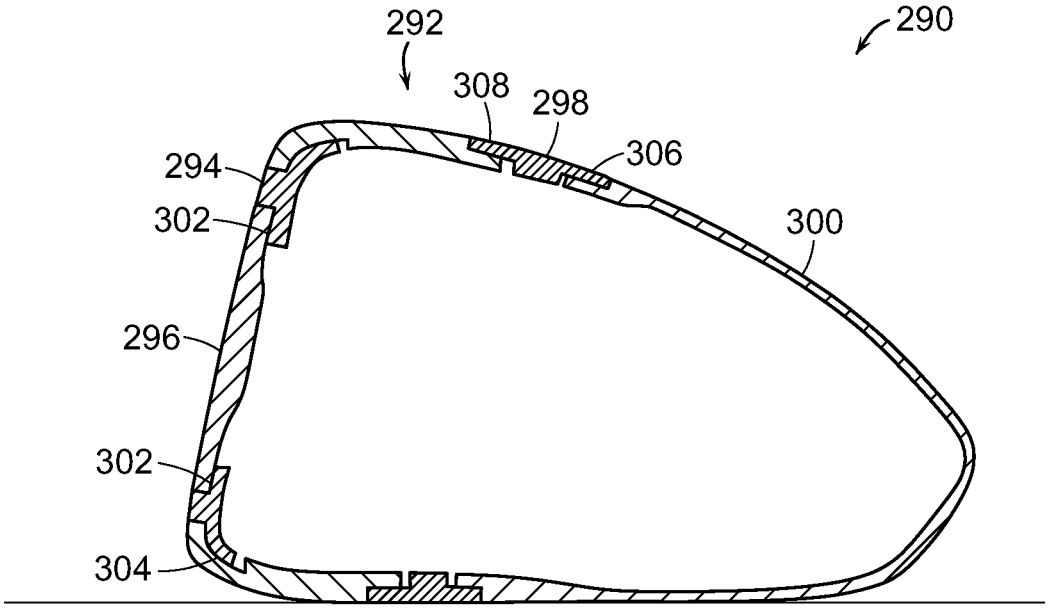
FIG. 25 is a cross-sectional view of an embodiment of a golf club head of the present invention.

In another embodiment, shown in FIG. 25, a golf club head 290 includes interface members that are included and are used to couple a flexure 292 to adjacent portions of golf club head 290. A front interface member 294 is interposed between flexure 292 and a face member 296. Similarly, an aft interface member 298 is interposed between flexure 292 and an aft body member 300.

In the present embodiment, front interface member 294 and aft interface member 298 are both constructed as annular members that are interposed between the adjacent components. Front interface member 294 includes a face flange 302 that is coupled to face member 296 with a lap joint, and a flexure flange 304 that is coupled to flexure 292 with a lap joint. A portion of front interface member 294 is exposed and forms a portion of the front surface of golf club head 290. Interface member 294 spaces a forward edge of flexure 292 from a perimeter edge of face member 296. Aft interface member 298 includes a rear body flange 306 that is coupled to aft body member 300 and a flexure flange 308 that is coupled to flexure 292. Aft interface member 298 space aft body member 300 and flexure 292.

Golf club head 290 has a multi-material construction. In an example, aft body member 300 and face member 296 are constructed of titanium alloys, and may be constructed of the same titanium alloy, such as Ti6-4. Front interface member 294 and aft interface member 298 are constructed of a material selected to be coupled to the materials of face member 296, flexure 292 and aft body member 300. In an example, the interface members are constructed of an aluminum alloy and flexure is constructed from a carbon fiber composite. It should further be appreciated, that the interface member 298 need not be constructed with a constant cross-sectional shape.

Figure 26:
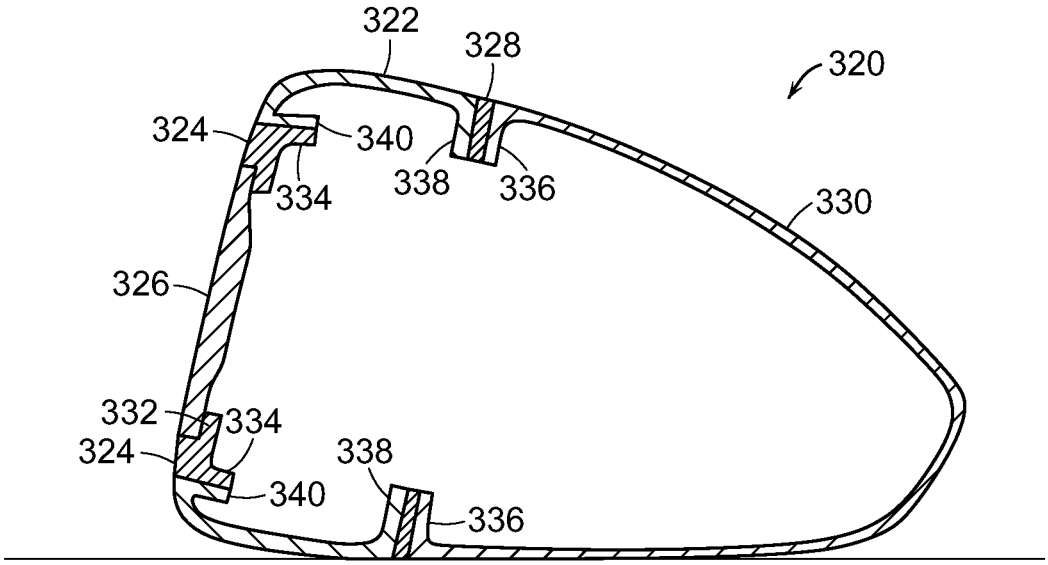
FIG. 26 is a cross-sectional view of an embodiment of a golf club head of the present invention.

A golf club head 320, shown in FIG. 26, includes interface members that are used to couple a flexure 322 to adjacent portions of golf club head 320. A front interface member 324 is interposed between flexure 322 and a face member 326.

Similarly, an aft interface member 328 is interposed between flexure 322 and an aft body member 330.

Front interface member 324 and aft interface member 328 are both constructed as annular members that are interposed between the adjacent components. Front interface member 324 includes a face flange 332 that is coupled to face member 326 with a lap joint. Front interface member 324 also includes a flexure flange 334 that is coupled to a front flange 340 of flexure 322. A portion of front interface member 324 is exposed and forms a portion of the front surface of golf club head 320. Interface member 324 spaces a forward edge of flexure 322 from a perimeter edge of face member 326. Aft interface member 328 includes a rear body flange 336 that is coupled to aft body member 330 and a flexure flange 338 that is coupled to flexure 322. Aft interface member 328 spaces aft body member 330 and flexure 322.

Golf club head 320 has a multi-material construction. In an example, aft body member 330 and face member 326 are constructed of titanium alloys, and may be constructed of the same titanium alloy, such as Ti6-4. Front interface member 324 and aft interface member 328 are constructed of a material selected to be coupled to the materials of face member 326, flexure 322 and aft body member 330. In an example, the interface members are constructed of an aluminum alloy and flexure is constructed from a carbon fiber composite.

Figure 27:
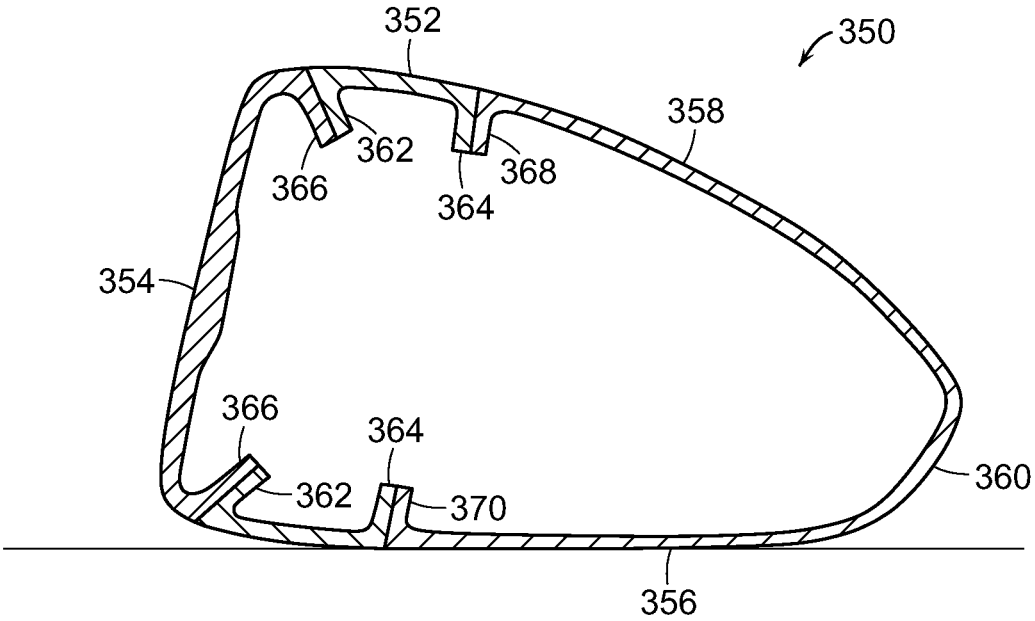
FIG. 27 is a cross-sectional view of an embodiment of a golf club head of the present invention.

Referring to FIG. 27, a golf club head 350 includes a flexure 352 that is spaced from the transition between the rear portion of the golf club and a face 354. Generally, golf club head 350 has a hollow body construction that is defined by a sole 356, a crown 358, a skirt 360, face 354, a hosel, and flexure 352.

Flexure 352 is interposed between face 354 and a rear portion of golf club head 350. Flexure 352 is generally an annular member that has a U-shaped cross-sectional shape so that it includes a forward flange 362 and an aft flange 364. Forward flange 362 is coupled to a face flange 366 of face 354, and aft flange 364 is coupled to a flange of the rear portion of the golf club that includes a crown flange 368 and a sole flange 370.

Figure 28:
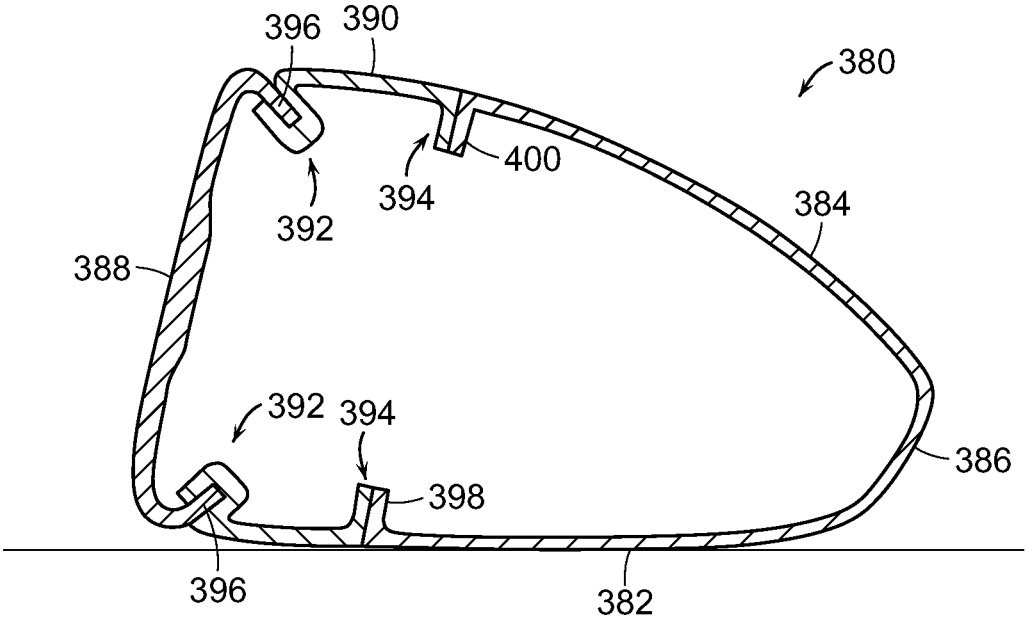
FIG. 28 is a cross-sectional view of an embodiment of a golf club head of the present invention.
Figure 29:
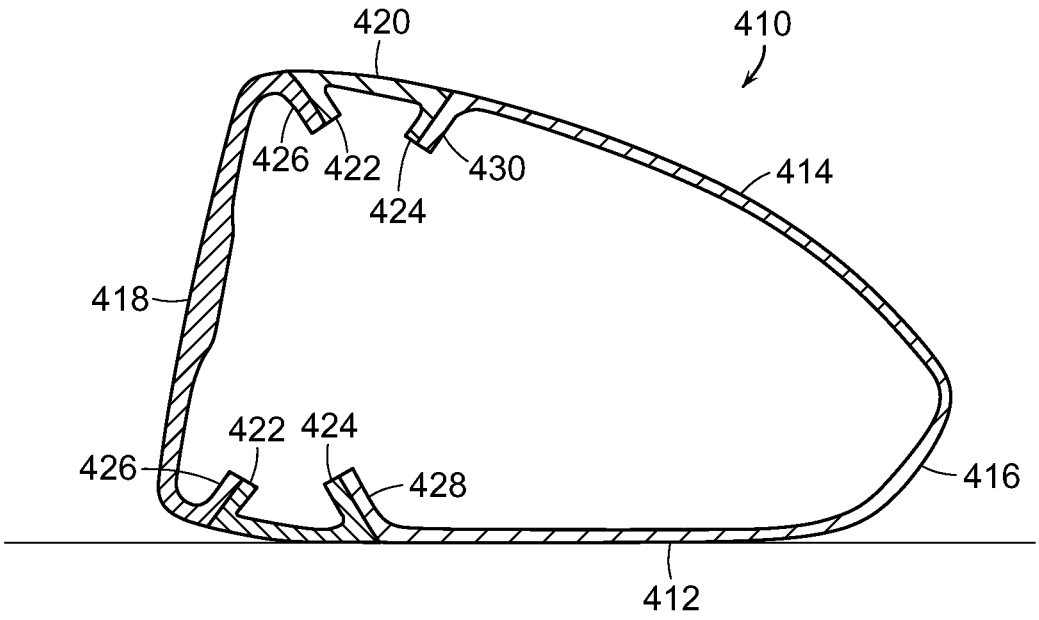
FIG. 29 is a cross-sectional view of an embodiment of a golf club head of the present invention.
Figure 30:
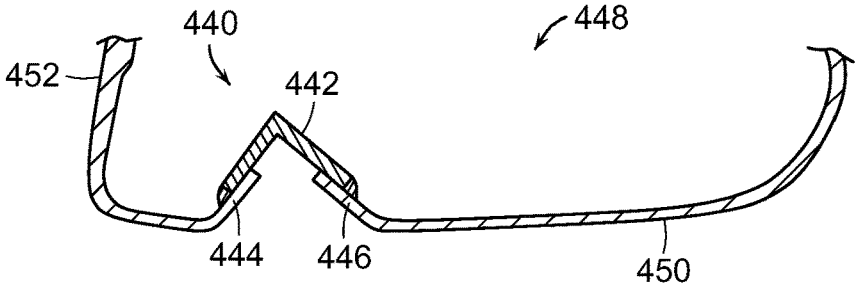
FIG. 30 is a cross-sectional view of a portion of an embodiment of a golf club head of the present invention.

Embodiments are illustrated in FIGS. 28 and 29 that are similar to that of FIG. 27, but include alternative flange configurations. As shown in FIG. 28, a golf club head 380 has a hollow body construction that is defined by a sole 382, a crown 384, a skirt 386, face 388, a hosel, and flexure 390. Flexure 390 is interposed between face 388 and the rear portion of the golf club head that includes sole 382 and crown 384. Flexure 390 is a generally annular member that includes a forward coupling portion 392 and an aft flange 394. Forward coupling portion 392 is a portion of flexure 390 that wraps around and is coupled to a face flange 396, so that it receives at least a portion of face flange 396. Portions of aft flange 394 abut and are coupled to a sole flange 398 and a crown flange 400.

As shown in FIG. 29, a golf club head 410 has a hollow body construction that is defined by a sole 412, a crown 414, a skirt 416, face 418, a hosel, and flexure 420. Flexure 420 is interposed between face 418 and the rear portion of the golf club head that includes sole 412 and crown 414. Flexure 420 is a generally annular member that includes a forward flange 422 and an aft flange 424. Forward flange 422 abuts, and is coupled to, a face flange 426. Portions of aft flange 424 abut and are coupled to a sole flange 428 and a crown flange 430.

The configuration of the flexure of each of the embodiments may be selected from many different alternatives to provide a tuned behavior during impact with a golf ball. FIGS. 30-34 illustrate various alternative multi-piece constructions of a flexure. In particular, the illustrated flexures include flexure components that have various alternative geometries. For example, a flexure 440 of FIG. 30, includes an angular cross-sectional shape that includes a flexure component 442 that is generally formed as an L-shaped member. Flexure component 442 is coupled to a forward flange 444 and an aft flange 446 of a golf club body 448. As shown, forward flange 444 and aft flange 446 are convergent flanges that are angled toward each other. Forward flange 444 and aft flange 446 are integrated into a sole 450 of golf club head body 448 generally in a location near a face 452 of the golf club head. As mentioned previously, flexure 440 is preferably located within about 20 mm of the ball-striking surface of face 452, and more preferably between about 5.0 mm and about 20.0 mm. Flexure component 442 may be coupled to forward flange 444 and aft flange 446 by any mechanical coupling process, such as welding, brazing, mechanical fasteners, diffusion bonding, liquid interface diffusion bonding, super plastic forming and diffusion bonding, and/or using an adhesive. A construction that allows for access to the internal cavity of the golf club head during manufacture may be employed, such as a crown pull construction or a face pull construction, so that the coupling process may be easily accomplished.

Figure 31:
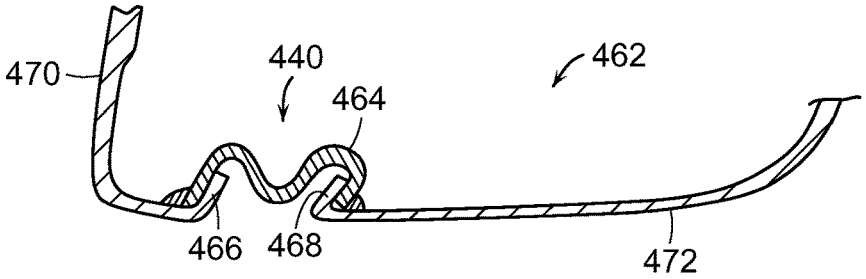
FIG. 31 is a cross-sectional view of a portion of an embodiment of a golf club head of the present invention.

In another embodiment, shown in FIG. 31, a flexure 460 that has a wavy, or corrugated, cross-sectional shape is included in a golf club head 462. Flexure 460 is constructed from a flexure component 464 that is coupled to a forward flange 466 and an aft flange 468 of golf club head 462. Forward flange 466 and aft flange 468 are integrated into a sole 472 of golf club head body 462 generally in a location near a face 470 of the golf club head. As mentioned previously, flexure 460 is preferably located within about 20 mm of the ball-striking surface of face 470, and more preferably between about 5.0 mm and about 20.0 mm. Flexure component 464 may be coupled to forward flange 466 and aft flange 468 by any mechanical coupling process, such as welding, brazing, mechanical fasteners and/or using an adhesive.

Figure 32:
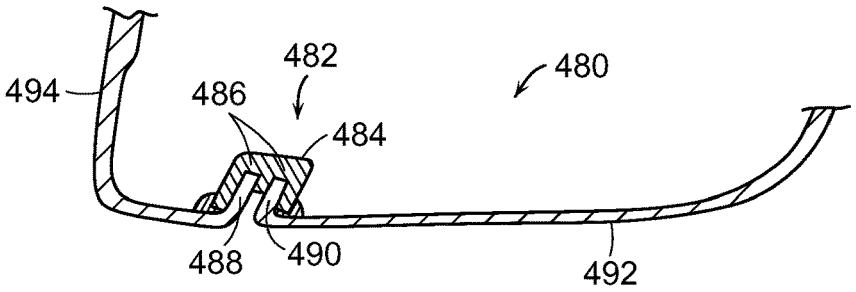
FIG. 32 is a cross-sectional view of a portion of an embodiment of a golf club head of the present invention.

In additional embodiments, a flexure is formed from flanges and a generally channel-shaped flexure component. Referring to FIG. 32, a golf club head 480 includes a flexure 482 that is formed by a flexure component 484 that is coupled to flanges of a sole 492 of golf club head 480, such as by welding, brazing and/or an adhesive. Flexure 482 is preferably located within about 20 mm of the ball-striking surface of a face 494, and more preferably between about 5.0 mm and about 20.0 mm. In particular, flexure component 484 is a generally channel-shaped member that includes recesses 486 that receive portions of a forward flange 488 and an aft flange 490. Recesses 486 are spaced by a portion of flexure component 484 that is selected to provide a desired spacing between forward flange 488 and aft flange 490.

Figure 33:
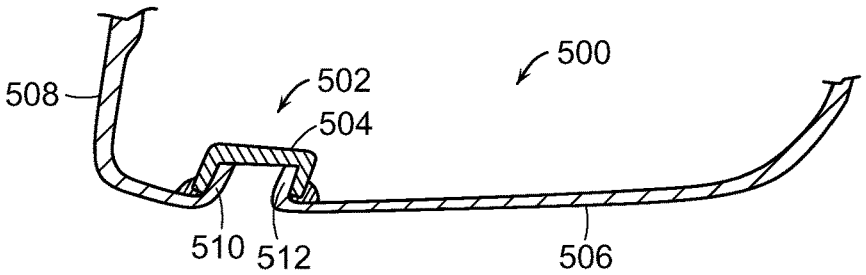
FIG. 33 is a cross-sectional view of a portion of an embodiment of a golf club head of the present invention.

In a similar embodiment, illustrated in FIG. 33, a golf club head 500 includes a flexure 502 that is formed by a flexure component 504 that has a channel-shaped cross section. Flexure component 504 is coupled to flanges formed on a sole 506 of golf club head 500, such as by welding, brazing and/or an adhesive. Flexure 502 is preferably located within about 20 mm of the ball-striking surface of a face 508, and more preferably between about 5.0 mm and about 20.0 mm. In particular, flexure component 504 is a generally channel-shaped member that defines a slot that receives portions of a forward flange 510 and an aft flange 512.

Figure 34:
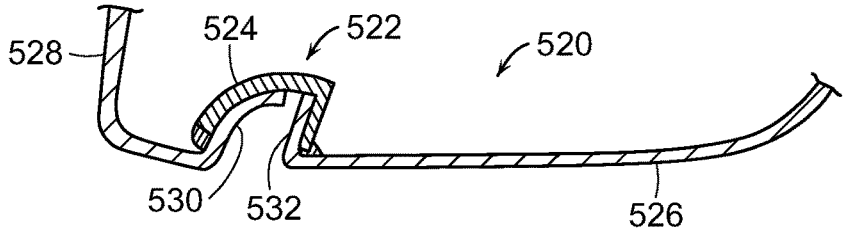
FIG. 34 is a cross-sectional view of a portion of an embodiment of a golf club head of the present invention.

In another embodiment, illustrated in FIG. 34, a golf club head 520 includes a flexure 522 that is formed by a flexure component 524 that has a channel-shaped cross section. Flexure component 524 is constructed having a generally sharktooth-shaped cross section, and in particular includes a first curved portion and a generally planar portion that meet at an apex. Flexure component 524 is coupled to flanges formed on a sole 526 of golf club head 520, such as by welding, brazing and/or an adhesive. Flexure 522 is preferably located within about 20 mm of the ball-striking surface of a face 528, and more preferably between about 5.0 mm and about 20.0 mm. In particular, flexure component 524 is a generally channel-shaped member that defines a slot that receives portions of a forward flange 530 and an aft flange 532.

Figure 35:
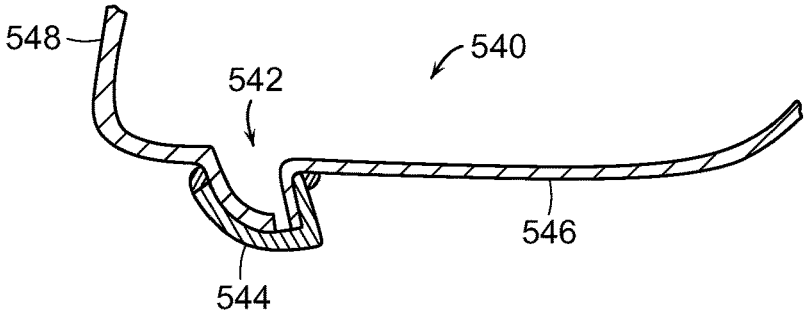
FIG. 35 is a cross-sectional view of a portion of an embodiment of a golf club head of the present invention.

Referring to FIG. 35, another embodiment of a golf club head 540 includes a flexure 542 that is similar in shape to the embodiment illustrated in FIG. 34, but flexure 542 extends outward from a sole 546 of the golf club head. Flexure 542 is formed by a flexure component 544 that has a cross section that forms a channel. Flexure component 544 is constructed having a generally sharktooth-shaped cross-sectional shape, and in particular includes a first curved portion and a generally planar portion that meet at an apex. Flexure component 544 is coupled to flanges formed on sole 546 of golf club head 540, such as by welding, brazing and/or an adhesive. Flexure 542 is preferably located within about 20.0 mm of the ball-striking surface of a face 548, and more preferably between about 5.0 mm and about 20.0 mm.

Figure 36:
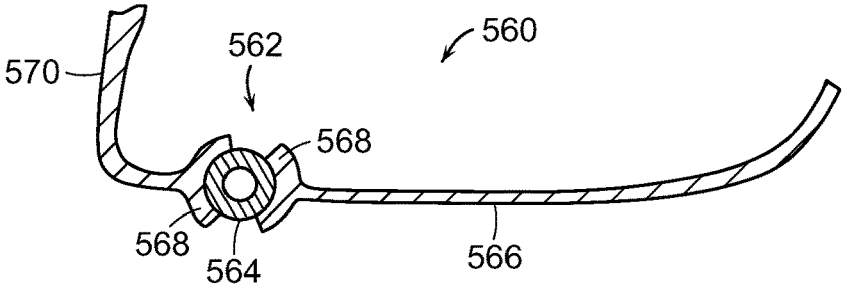
FIG. 36 is a cross-sectional view of a portion of an embodiment of a golf club head of the present invention.

In another embodiment, illustrated in FIG. 36, a golf club head 560 includes a flexure 562. Flexure 562 is formed by a flexure component 564 that has a generally tubular cross-section. Flexure component 564 is constructed having a generally tubular cross-sectional shape, and although it is illustrated as having an annular cross-sectional shape, it should be appreciated that it may have any cross-sectional shape. Flexure component 564 is coupled to flanges 568 formed on sole 566 of golf club head 560, such as by welding, brazing and/or an adhesive. Flexure component 564 has an exterior shape that complements flanges 568 and provides a coupling surface so that flexure component 564 may be coupled to flanges 568. Flexure 562 is preferably located within about 20.0 mm of the ball-striking surface of a face 570, and more preferably between about 5.0 mm and about 20.0 mm.

Figure 37:
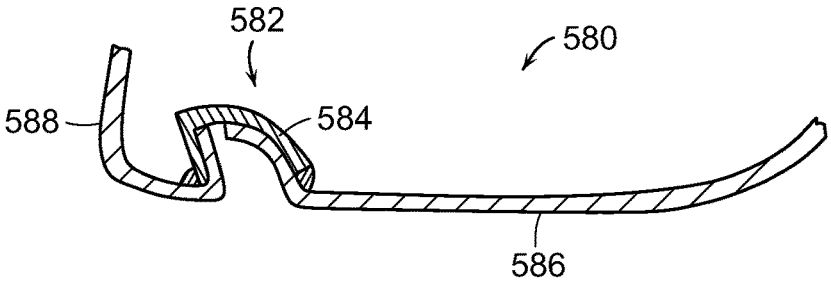
FIG. 37 is a cross-sectional view of a portion of another embodiment of a golf club head of the present invention.

Referring to FIG. 37, in an additional embodiment, a golf club head 580 includes a flexure 582. Flexure 582 is similar in shape to the embodiment illustrated in FIG. 34, but flexure 582 is oriented so that the generally sharktooth-shaped cross-section is reversed. In particular, the curved portion of flexure 582 is further rearward than in other illustrated embodiments. As shown, flexure 582 is formed by a flexure component 584 that has a cross section that forms a channel, but it should be appreciated that flexure 582 may be formed as a monolithic structure with a sole 586 of golf club head 580. By altering the orientation of the flexure relative to the remainder of the golf club head, the stress exerted on the flexure is applied in an alternative direction and the behavior of the flexure is different so that the flexure is effectively stiffer. As a result, the flexure may be tuned for the golf club head by altering the orientation. Flexure component 584 is coupled to flanges formed on sole 586 of golf club head 580, such as by welding, brazing and/or an adhesive. Flexure 582 is preferably located within about 20.0 mm of the ball-striking surface of a face 588, and more preferably between about 5.0 mm and about 20.0 mm, and has a thickness that is preferably between about 0.35 mm and 2.0 mm.

Figure 38:
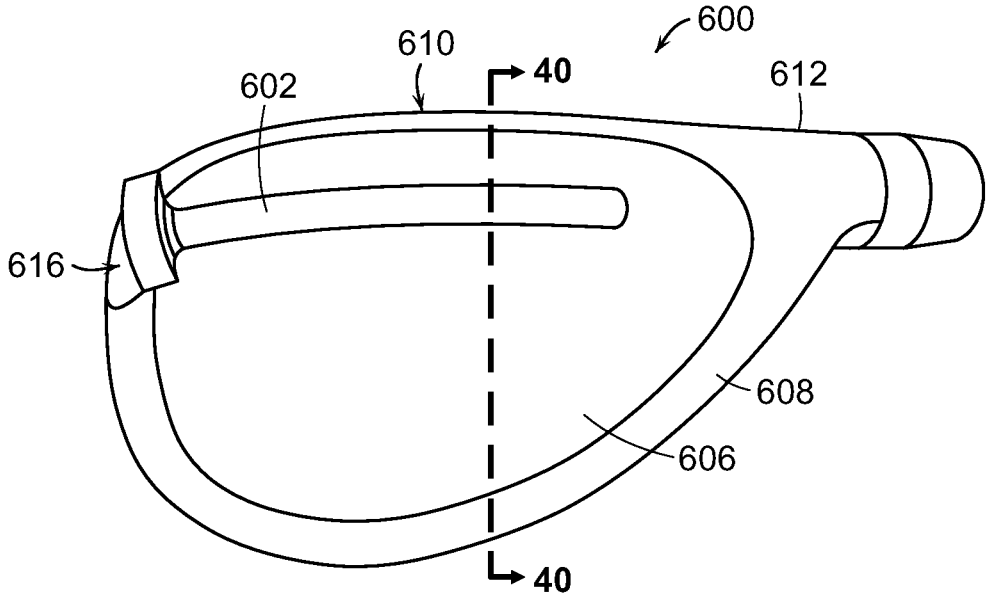
FIG. 38 is a bottom view of another embodiment of a golf club head of the present invention.
Figure 39:
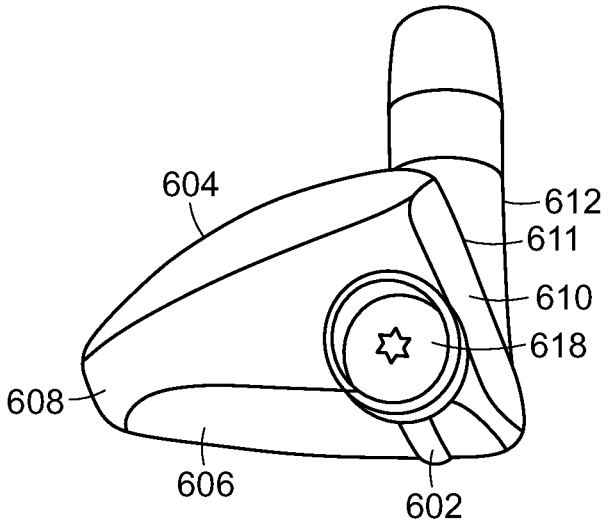
FIG. 39 is a side view of the golf club head of FIG. 38.
Figure 40:
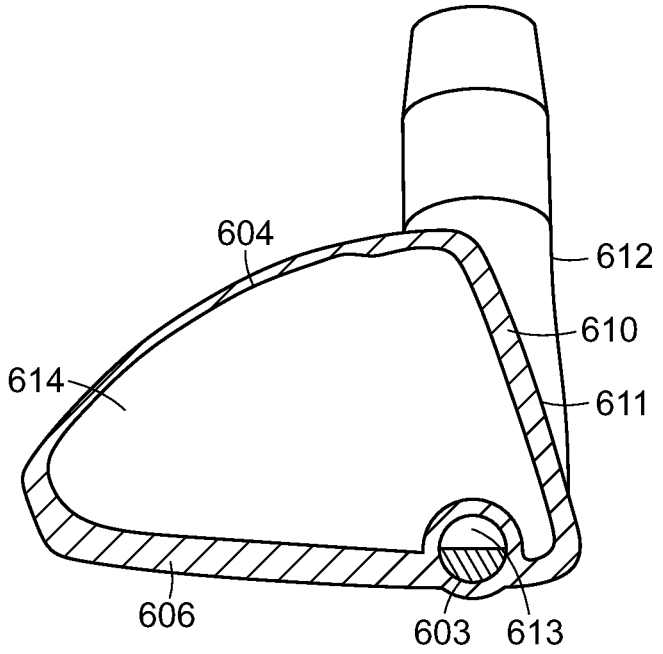
FIG. 40 is a cross-sectional view of the golf club head of FIG. 38, taken along line 40-40.

Referring to FIGS. 38-40, a golf club head 600 includes an elongate cavity that provides a flexure 602 that may be tuned to provide a desired compliance. For example, the golf club head includes a compliant tube that may be filled, or partially filled, with a compliant material, to adjust sound, feel and compliance, or left empty. Golf club head 600 includes a crown 604, a sole 606, a skirt 608, a face 610 that defines a ball-striking surface 611, and a hosel 612 that combine to form hollow-bodied golf club head construction that defines an interior cavity 614. Flexure 602 is an elongate tubular structure that extends generally in a heel-to-toe direction, and defines a flexure cavity 613. In an embodiment, flexure 602 extends across golf club head 600 so that it intersects a vertical, fore-aft plane extending through the geometric center of the face of golf club head 600 when the golf club head is in the address position.

An aperture 616 is included that provides access to the interior of flexure 602 and may be closed with a cover 618 that is preferably removeably coupled to flexure 602 in aperture 616. As an example, aperture 616 may be threaded and cover 618 is threaded into aperture 616 and includes a tool engagement feature that allows cover 618 to be installed and removed.

As a further alternative, flexure 602 may be completely or partially filled with an insert 603, such as a high density elastomeric insert. For example, an elastomeric material that is infused with a high density material, such as Tungsten, to create a high density flexible insert with is inserted into the tubular flexure, or into one of the other embodiments described herein including open slots, behind the face. The insert may be used to fill, or partially fill, the flexure to alter the acoustic behavior of the golf club head. A plurality of inserts constructed from materials with different densities and/or having different weight distributions may be provided to create inserts that fit into the flexure with different masses and weight distributions so that the final weight and mass distribution of the golf club head may be selected. Further, the flexure may include an opening that extends into the interior cavity and the insert may be used to plug the opening so that the interior cavity is not exposed to the environment so debris and water are not able to enter the interior cavity. Exemplary suitable materials include polyurethane, rubber, thermoset polymers, thermoplastic polymers, epoxy, foam, and neoprene. The selected material has a hardness that is selected to combine with the flexure to provide a combined flexibility. Preferably, the selected material has a hardness generally in a Durometer A range of 30-95 or a Durometer D range of 45-85.

Figure 41:
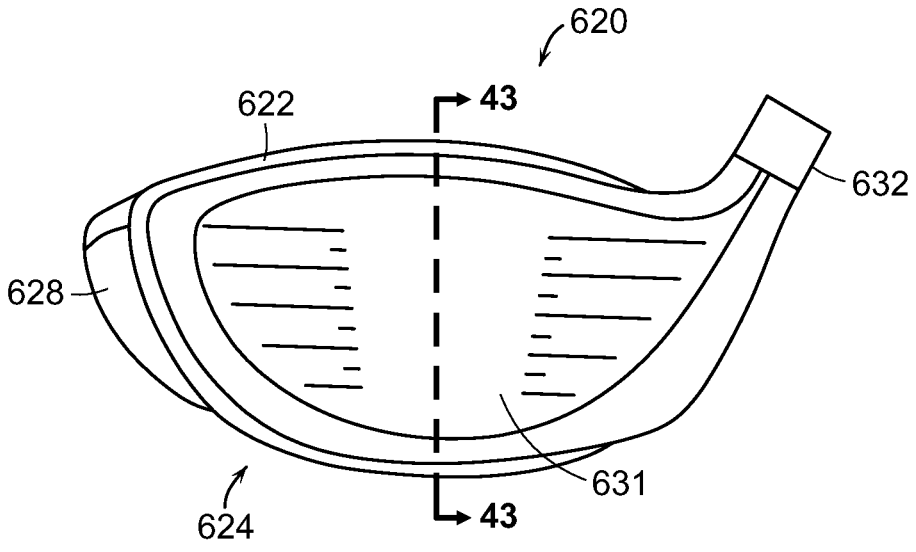
FIG. 41 is a front view of an embodiment of a golf club head of the present invention.
Figure 42:
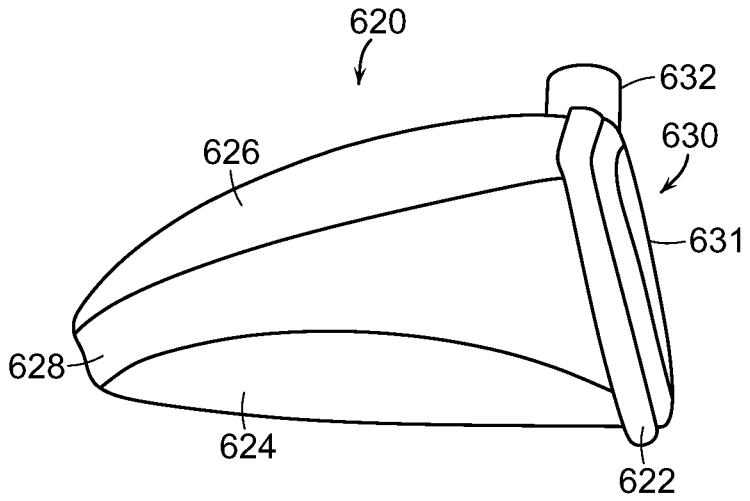
FIG. 42 is a side view of the golf club head of FIG. 41.
Figure 43:
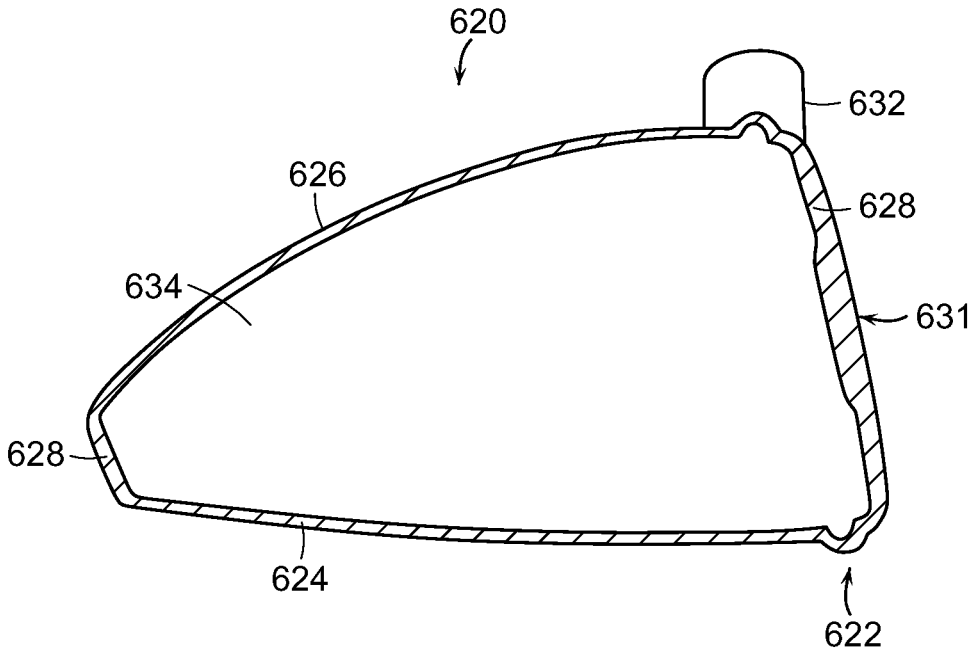
FIG. 43 is a cross-sectional view of the golf club head of FIG. 41, taken along line 43-43.

Referring to FIGS. 41-43, another embodiment of a golf club head 620 including a flexure 622 that extends outward from a sole 624 of the golf club head will be described. Golf club head 620 is constructed with a crown 626, sole 624, a skirt 628, a face 630 that defines a ball-striking surface 631, and a hosel 632 that combine to form a hollow-body construction and to define an interior cavity 634. In the present embodiment, flexure 622 extends across sole 624, across skirt 628, and across crown 626 continuously so that it wraps over the toe portion of skirt 628 of golf club head 620.

Figure 44:
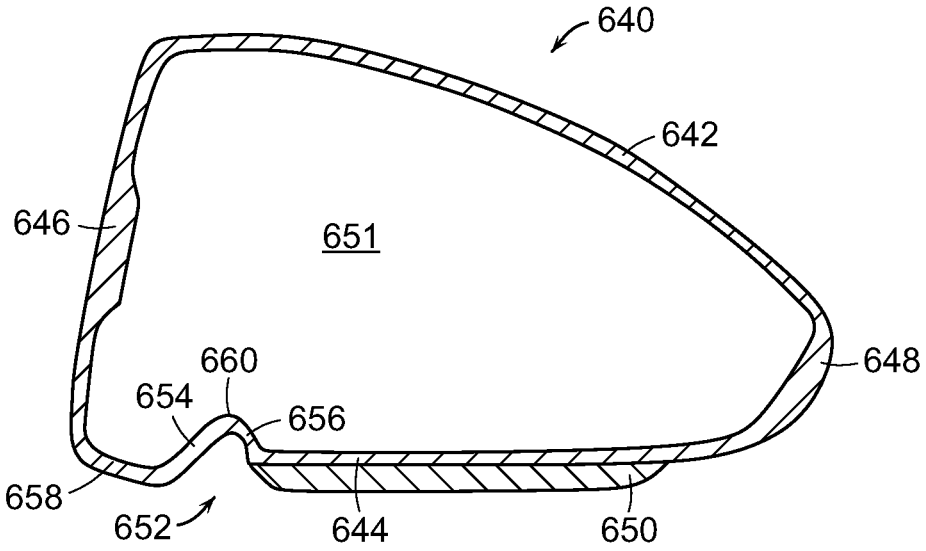
FIG. 44 is a cross-sectional view of a portion of an embodiment of a golf club head of the present invention.

In additional embodiments, a sole plate is integrated into the golf club head and is at least partially integrated into a flexure. As illustrated in FIG. 44, a golf club head 640 includes a crown 642, a sole 644, a face 646, a skirt 648 and a sole plate 650 that combine to form a hollow body defining an inner cavity 651. Sole 644 and sole plate 650 combine to form a flexure 652. Flexure 652 is a channel-shaped feature that extends in a generally heel-to-toe direction and is formed from a first member 654, a second member 656, and sole plate 650. First member 654 is coupled to a rearward edge of a forward transmittal portion 658 of sole 644 and curves into inner cavity 651 from sole 644. Second member 656 is coupled to a forward edge of a rearward portion of sole 644 and also curves into inner cavity 651 from sole 644. The ends of first member 654 and second member 656 that are spaced away from sole 644 are coupled to each other at an apex 660. A second, lower, end of second member 656 is joined with a forward portion of sole plate 650 to complete the rear portion of flexure 652 that extends from apex 660 to a lower, outer sole surface of golf club head 640, so that the depth of flexure 652 is greater than the thickness of sole plate 650.

In fairway wood or hybrid embodiments, which are generally constructed to provide a ground-contacting surface, sole 644 has a generally stepped configuration so that only the forward transmittal portion 658 of sole 644 provides a ground surface contacting surface, and the remainder of the ground contacting surface is provided by a lower surface of sole plate 650. Preferably, the flexure is elongate and extends in a generally heel to toe direction.

Figure 62:
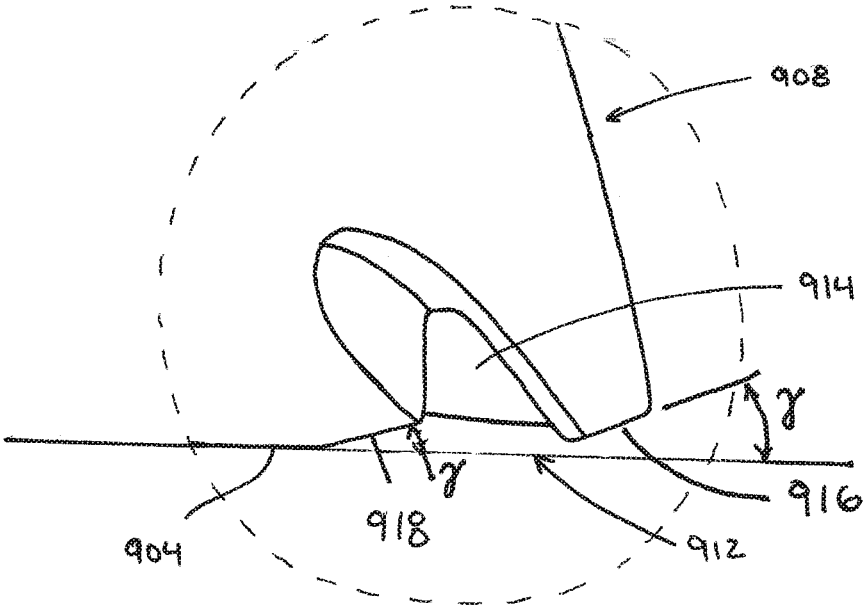
FIG. 62 is a side view of a portion, shown in FIG. 61 as detail B, of the golf club head of FIG. 61.

Portions of the sole adjacent the flexure may also include shaping to provide relief in the event that they contact the ground during use, especially in fairway wood and hybrid embodiments. The shaping prevents edges of the golf club head from digging into the turf during use and provides additional bounce to the sole to encourage deflection of the golf club head off of the turf. In addition to the stepped configuration described above, portions of the sole may have bevel surfaces as also shown in FIGS. 44, 61, 62, 77 and 79. In particular, a portion of the sole rearward of the flexure may be angled or radiused similar to the leading edge of the golf club head. In the example shown in FIGS. 61 and 62, golf club head 900 includes a first positive angled bounce surface 916 in the transmittal portion at the leading edge of the golf club head forward of the flexure toward the face, and a second positive angled bounce surface 918 rearward of and adjacent to the flexure 912. A positive angled bounce surface is a surface that is defined by a tangent plane that is angled so that it is higher from a ground plane at a forward location toward the face than at a rearward location toward the rear of the golf club head. Preferably, a portion of each of the positive angled bounce surfaces is linear in cross-section, as shown in FIG. 62, or planar. Additionally, the bounce angle $\gamma$ of each of the positive angled bounce surfaces is between about 2° and about 20°, and more preferably between about 6° and about 16°.

Additionally, in this embodiment and following examples, the material of the sole plate is selected to provide a desired mass distribution in the golf club head, and the material may have a higher or lower density than the remainder of the body material. For example, because the sole plate is generally integral with a flexure that is relatively close to the face of the golf club head, it may be beneficial to utilize a high density material for fairway and hybrid embodiments to maintain the center of gravity of the golf club head low, while a lower density material may be beneficial in driver embodiments so that material mass that would otherwise be dedicated to the sole structure may be distributed to the perimeter of the golf club head. The sole plate material is preferably selected from aluminum, titanium, magnesium, zirconium, steel, tungsten, and the sole plate may be coupled to the golf club head body by fasteners, brazing, welding, adhesives or any other suitable attachment method. In an example, a fairway wood may be constructed using titanium for the majority of the body while a steel or tungsten sole plate is brazed to the titanium body.

Figure 45:
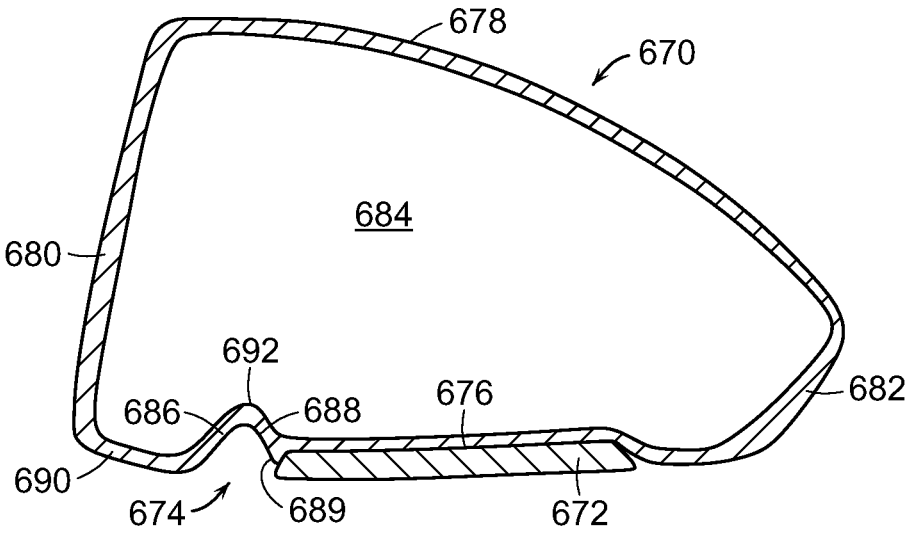
FIG. 45 is a cross-sectional view of a portion of an embodiment of a golf club head of the present invention.

In another embodiment, shown in FIG. 45, a golf club head 670 is constructed similar to that of FIG. 44 so that it includes a sole plate 672 that forms a portion of a flexure 674, but in the present embodiment, sole plate 672 is received in a recessed portion of a sole 676 of golf club head 670. Golf club head 670 is generally hollow and is constructed from a crown 678, sole 676, a face 680, a skirt 682 and sole plate 672 that combine to form a hollow body defining an inner cavity 684.

Flexure 674 is generally formed from a first member 686, a second member 688, and sole plate 672. First member 686 is coupled to a rearward edge of a forward transmittal portion 690 of sole 676 and curves into inner cavity 684 from sole 676. Second member 688 is coupled to a forward edge of a rearward portion of sole 676 and also curves into inner cavity 684 from sole 676. The ends of first member 686 and second member 688 that are spaced away from sole 676 are coupled to each other at an apex 692. A second, lower, end of second member 688 is joined with a forward portion of sole plate 672 to complete the rear portion of flexure 674 that extends from apex 692 to a lower, outer sole surface of golf club head 670.

Sole 676 and second member 688 combine to form a recess in the lower wall of golf club head 670 that receives sole plate 672. In particular the lower end of second member 688 extends below the junction between second member 688 and sole 676 to form a shoulder, such as tab 689, which extends below the adjacent lower surface of sole 676. As a result, in fairway wood and hybrid embodiments that utilize the lower surface for ground contact, the forward transmittal portion 658, sole plate 650, and a rear portion of sole 676 provide the ground-contacting lower surface of golf club head 670.

Figure 46:
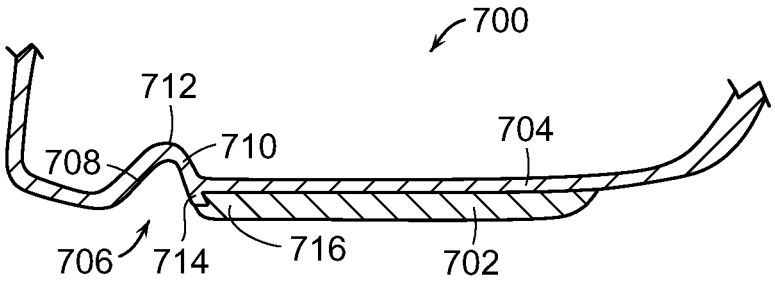
FIG. 46 is a cross-sectional view of a portion of an embodiment of a golf club head of the present invention.

Referring to FIG. 46, another embodiment of a golf club head is illustrated that includes a sole plate. Golf club head 700 includes a sole plate 702 that is coupled to a sole 704 and that forms a portion of a flexure 706. Flexure 706 is constructed from a first member 708, a second member 710 and a portion of sole plate 702. First member 708 and second member 710 extend into an interior cavity of golf club head 700 and meet at an apex 712. The lower end of second member 710 extends below the junction between second member 710 and sole 704 to form a shoulder, or tab 714, that complements and engages a shoulder 716 of sole plate 702. Sole 704 has a stepped configuration so that sole plate 702 provides the lowest surface of golf club head 700.

Figure 47:
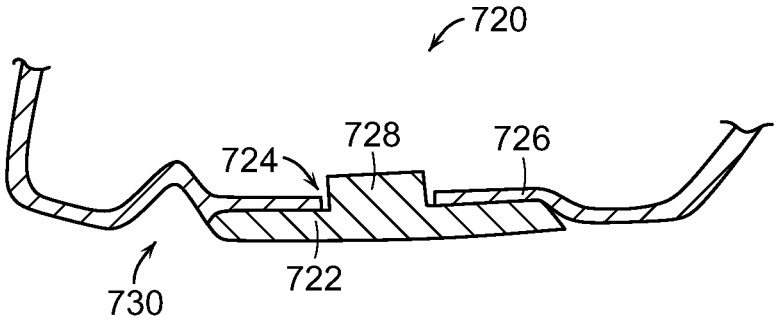
FIG. 47 is a cross-sectional view of a portion of an embodiment of a golf club head of the present invention.

In another embodiment, shown in FIG. 47, a golf club head 720 includes a sole plate 722 that covers an aperture 724 included in a sole 726 of golf club head 720 and forms a portion of a flexure 730. Aperture 724 may be used to provide access to an interior cavity of the golf club head, to locate sole plate 722, and/or to allow for greater adjustment in the mass of sole plate 722 while maintaining the overall outer shape of golf club head 720. For example, sole plate 722 may include a projection 728 that increases the mass of sole plate 722 and that extends into aperture 724 and/or into the interior cavity.

Figure 48:
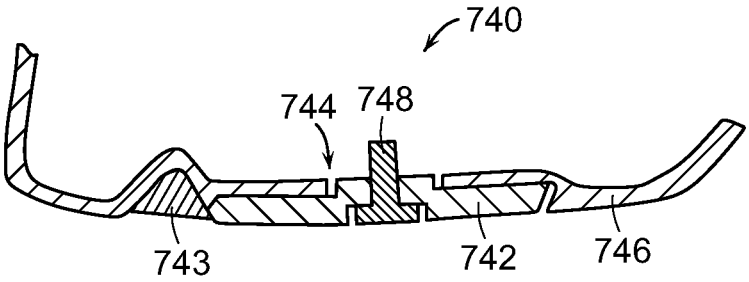
FIG. 48 is a cross-sectional view of a portion of an embodiment of a golf club head of the present invention.

In another embodiment, illustrated in FIG. 48, a golf club head 740 includes a sole plate 742 that covers an aperture 744 included in a sole 746 of golf club head 740 and provides a weight port for coupling a weight member 748 to the golf club head. Preferably, the weigh port is located so that changing, or removing, weight member 748 does not alter the location of the center of gravity of the combined sole plate 742 and weight member 748 to provide a more effective mechanism to alter the swingweight of a golf club including golf club head 740. In particular, sole plate 742 includes a mounting feature, such as a threaded bore, that is coupled to a removable weight member 748.

As a further alternative, any of the open flexures described herein may be completely or partially filled with an insert, such as insert 743, which may be a high density elastomeric insert. For example, an elastomeric material that is infused with a high density material, such as Tungsten, to create a high density flexible insert with is inserted into the tubular flexure, or into one of the other embodiments described herein including open slots, behind the face. The insert may be used to fill, or partially fill, the flexure to alter the acoustic behavior of the golf club head. A plurality of inserts constructed from materials with different densities and/or having different weight distributions may be provided to create inserts that fit into the flexure with different masses and weight distributions so that the final weight and mass distribution of the golf club head may be selected. Further, the flexure may include an opening that extends into the interior cavity and the insert may be used to plug the opening so that the interior cavity is not exposed to the environment so debris and water are not able to enter the interior cavity. Exemplary suitable materials include polyurethane, rubber, thermoset polymers, thermoplastic polymers, epoxy, foam, and neoprene. The selected material has a hardness that is selected to combine with the flexure to provide a combined flexibility. Preferably, the selected material has a hardness generally in a Durometer A range of 30-95 or a Durometer D range of 45-85.

Figure 49:
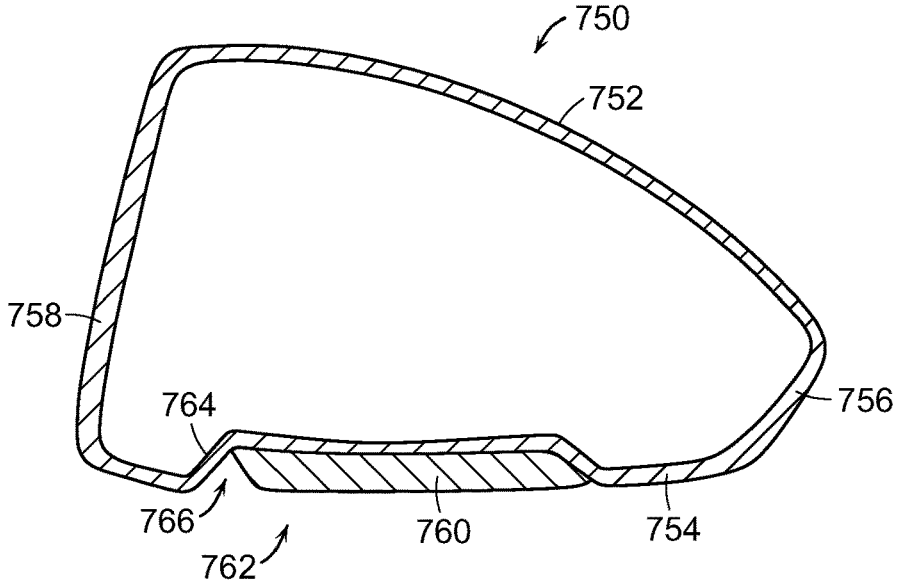
FIG. 49 is a cross-sectional view of an embodiment of a golf club head of the present invention.

Referring to FIG. 49, an embodiment of a golf club head including a sole plate and a flexure will be described. Golf club head 750 includes a crown 752, a sole 754, a skirt 756, a face 758, and a sole plate 760. A recess 762 is included in sole 754 that receives sole plate 760, but is shaped so that a gap is formed between a forward wall 764 of recess 760 and a forward end of sole plate 760, when sole plate 760 is installed. As a result, the gap forms a flexure 766 in the lower portion of the golf club head close to face 758.

Figure 50:
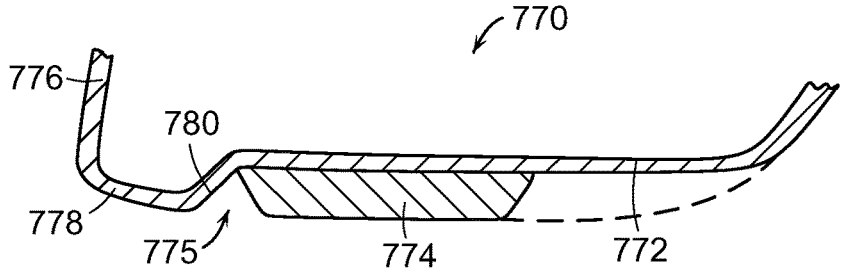
FIG. 50 is a cross-sectional view of a portion of an embodiment of a golf club head of the present invention.

In another embodiment, shown in FIG. 50, a golf club head 770 includes a stepped sole 772 and a sole plate 774 that combine to form a flexure 775. Sole 772 includes a front transmittal portion 778 that extends from a face 776 rearward toward a transition wall 780 of sole 772 that forms a forward wall of flexure 775. Sole plate 774 is coupled to sole 772 so that it is spaced from transition wall 780 to form flexure 775. Sole plate 774 extends rearward from transition wall 780 and desired distance as indicated by the dashed line.

Figure 51:
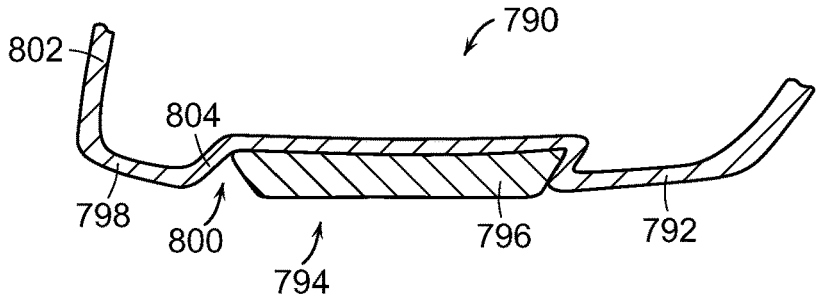
FIG. 51 is a cross-sectional view of a portion of an embodiment of a golf club head of the present invention.

Another embodiment of a golf club head includes a recessed sole and a sole plate that combine to form a flexure, and a portion of the golf club is shown in FIG. 51. Golf club head 790 includes a sole 792 that defines a recess 794 that receives a sole plate 796 and the sole and the sole plate combine to define a flexure 800. In particular, sole 792 includes a forward transmittal portion 798 that extends between a face 802 of the golf club head and a transition wall 804 that extends inward from the forward transmittal portion 798 and forms a portion of recess 794. Sole plate 796 is received in recess 794 and coupled to sole 792 so that the forward portion of sole plate 796 is spaced from transmittal portion 798 so that a generally V-shaped gap is formed at flexure 800.

Figure 52:
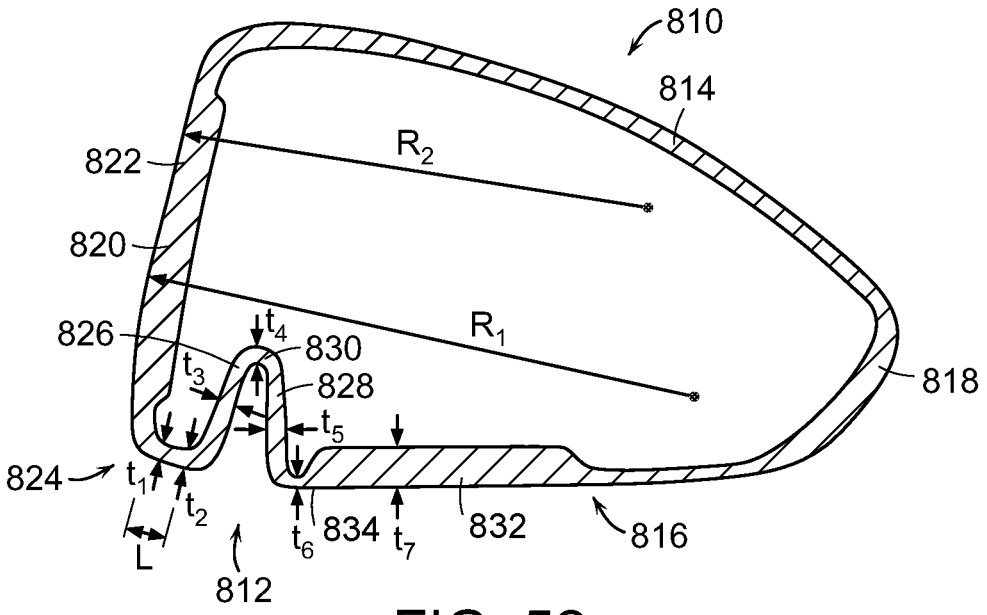
FIG. 52 is a cross-sectional view of a portion of an embodiment of a golf club head of the present invention.

Referring to FIG. 52, an embodiment of a golf club head 810 that includes a flexure 812 and flexure tuning features. Golf club head 810 includes a crown 814, a sole 816, a skirt 818, and a face 820 that defines a ball-striking surface 822. Sole 816 includes a front transmittal portion 824 that extends rearward from face 820 toward a front wall 826 of flexure 812. Front wall 826 is coupled to a rear wall 828 at an apex 830 to form flexure 812. A rear portion of sole 816 extends rearward from rear wall 828 and forms the remainder of sole 816. As illustrated, the rear portion of sole 816 may have a thickness that varies, such as by including a thickened region 832 spaced rearward from flexure 812 by an isolation portion 834.

Flexure 812 is elongate and extends in a heel-to-toe direction and forms an exterior channel in sole 816. The thickness of transmittal portion 824, front wall 826, apex 830, rear wall 828, and isolation portion 834 are selected to tune the flexure 812 to a desired frequency of vibration during impact with a golf ball. Thicknesses t1-t7 are defined having a specific relationship so that transmittal portion 824 transitions from a first thickness t1 adjacent the face to a second thickness t2 adjacent front wall 826. Front wall 826 varies in thickness from approximately t2 where it is coupled to transmittal portion 824 to a central thickness t3 and to a thickness approximately equal to a thickness t4 of apex 830. Similarly, rear wall 828 varies in thickness from approximately t4 where it joins apex 830 to a central thickness t5 and to a thickness approximately equal to a thickness t6 of isolation portion 834. Rearward of isolation portion 834, the thickness of sole 816 varies from thickness t6 of isolation portion 834 to thickness t7.

As described above, the flexibility added to golf club heads of the present invention having flexures located in the sole reduces the backspin for ball impacts located below the ideal impact location. Because of that reduction in backspin, the curvature of the ball-striking surface of the golf club head is different above and below the ideal impact location so that the launch of the golf ball may be tuned to the amount of backspin reduction. The curvature of the ball-striking surface of a golf club between the top edge of the face and the leading edge of the golf club is defined as the "roll" of the face. The golf club heads of the present invention preferably have a roll radius above the ideal impact location that is different than the roll radius below the ideal impact location. Alternatively, the roll radius above the geometric face center of the golf club face is different than the roll radius below the geometric face center of the golf club face. As a further alternative, the upper ⅔ of the face of the golf club head has a roll radius that is different than the lower ⅓ of the face. Preferably, the roll radius of the portion of the ball-striking surface closer to the flexure is greater than the portion of the face further from the flexure so that the portion of the ball-striking surface closer to the flexure is flatter than the other portion. For example, in golf club head 810, flexure 812 is located in the lower surface of the golf club head and a portion of the ball-striking surface below the ideal impact location has a roll radius R1 that is greater than the roll radius R2 of the portion of the ball-striking surface above the ideal impact location. Preferably the portion of the ball-striking surface closest to the flexure has a roll radius that is greater than about 12.0 inches, and more preferably greater than 12.5 inches.

Similarly, the curvature of the ball-striking surface of a golf club between the heel and toe of the face is defined as the "bulge" of the face. Golf club heads of the present invention that include a flexure that extends to the skirt of the golf club head provide a similar reduction in sidespin of a struck golf ball for off-center impacts and therefore have a bulge radius that is greater than a golf club head without a flexure on the skirt. Increasing the bulge radius creates a flatter face increases the hot spot area of the golf club face by reducing the obliqueness of impact for off-center hits to provide a more efficient transfer of energy between the golf club head and the ball. Preferably, the portion of the ball striking surface closest to a flexure in the skirt of the golf club head has a bulge radius that is greater than about 12.0 inches, and more preferably greater than 12.5 inches.

Figure 53:
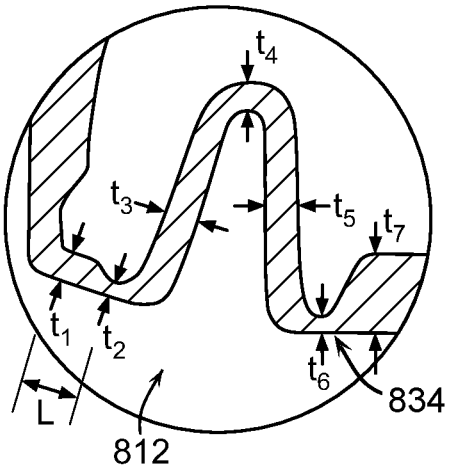
FIG. 53 is a cross-sectional view of a portion of an embodiment of a golf club head of the present invention.
Figure 54:
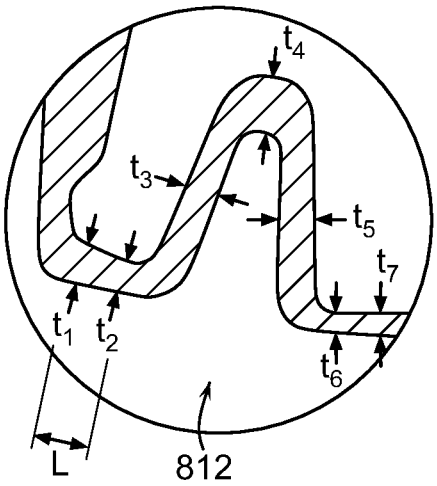
FIG. 54 is a cross-sectional view of a portion of another embodiment of a golf club head of the present invention.

Alternative embodiments of the thickness transitions are illustrated in FIGS. 52-54. The thickness relationships used herein are utilized to provide a desired distribution of flexing throughout the flexure and the portions of the golf club head adjacent the flexure. In an embodiment shown in FIG. 52, the thickness in the transmittal portion t1 and t2 are at least 50% of the minimum face thickness, and more preferably at least 60% of the minimum face thickness, and preferably thickness t1 is greater than t2 (t1>t2). Additionally, the thickness of the front wall t3 and the thickness of the rear wall t5 of the flexure are different by less than 40%, more preferably by less than 30%, and even more preferably by less than 20%. Furthermore, the thicknesses of the front wall t3 and rear wall t5 of the flexure are preferably less than 90% of the minimum thickness of the face, and the thicknesses of the walls of the flexure are preferably less than or equal to the thickness of the transmittal portion t1, t2. The apex of the flexure preferably has a thickness that is preferably greater than or equal to the minimum thickness of the front wall t3 and the thickness of the rear wall t5 of flexure. Additionally, the thickness of the apex t4 is preferably within 30% of the larger of the thickness of front wall t3 and the thickness of the rear wall t5, and more preferably within 15% of the larger of those thicknesses.

The thickness of the sole adjacent the rear wall of the flexure is preferably reduced if a portion of the sole within about 30.0 mm of the rear wall of the flexure has a thickness that is greater than the thickness of the transmittal portion forward of the front wall of the flexure. For example, if sole thickness t7 is greater than the minimum thickness of the transmittal portion within 30.0 mm of the rear wall of the flexure, then thickness t6 of the portion of the sole immediately rearward of the flexure is preferably less than the minimum thickness of the transmittal portion and less than the minimum face thickness. Preferably, thickness t6 is less than 70% of the minimum thickness of the transmittal portion, and more preferably less than 60% of the minimum thickness of the transmittal portion. Additionally, thickness t6 is less than 60% of the minimum face thickness, and more preferably less than 50% of the minimum face thickness.

In another embodiment, shown in FIG. 53, the transmittal portion is modified to include a thickness that changes over the length L of the transmittal portion. The thickness relationships for the other portions of the flexure and sole described above are the same as the previous embodiment and will not be repeated. In the transmittal portion the thickness of the transmittal is about constant over at least 60% of the length L of the transmittal portion, and more preferably over at least 70% of the length L of the transmittal portion. Additionally, the maximum thickness of the transmittal portion is closer to the face of the golf club head than the front wall of the flexure. The maximum thickness is generally located at thickness t1 and the minimum thickness of the transmittal portion is generally located at thickness t2, shown in FIG. 53. Preferably, the minimum thickness of the transmittal portion is greater than or equal to the minimum thickness of the sole of the golf club head. The minimum thickness of the transmittal portion is preferably less than 70% of the maximum thickness of the transmittal portion, and more preferably less than 60% of the maximum thickness of the transmittal portion.

In another embodiment, shown in FIG. 54, the transmittal portion is modified to include a thickness that changes over the length L of the transmittal portion, the apex thickness is illustrated greater than the minimum thickness of the front wall t3 and the thickness of the rear wall t5 of flexure, and the thicknesses of the sole rearward of the flexure are illustrated as about constant and generally less than the maximum thickness of the transmittal portion. In this embodiment, the thickness of the transmittal portion has a generally linear taper from adjacent the face to the front wall of the flexure. The linear taper, or linear reduction in thickness, is preferably greater than about 4% (i.e., 0.4 mm reduction in thickness over 10.0 mm length), and more preferably greater than about 5%, from the adjacent the face to the flexure. In the present embodiment, the thickness of the portion of the sole adjacent the rear wall of the flexure t6 and the sole thickness t7 further rearward from the flexure are about equal and are less than the maximum thickness of the transmittal portion.

In embodiments of golf clubs according to the present invention having loft angle in a range of about 13°-30°, such as in fairway wood and hybrid type golf club heads, the thicknesses are generally in the following ranges: t1) 1.4-2.0 mm; t2) 1.2-1.6 mm; t3) 1.2-1.7 mm; t4) 1.2-2.0 mm; t5) 1.2-1.7 mm; t6) 0.6-1.2 mm; and t7) 0.6-4.0 mm. Similarly, in embodiments of golf clubs according to the present invention having loft angle in a range of about 6°-12°, such as in driver type golf club heads, the thicknesses are generally in the following ranges: t1) 1.4-2.0 mm; t2) 0.6-1.6 mm; t3) 0.5-1.7 mm; t4) 0.5-2.0 mm; t5) 0.5-1.7 mm; t6) 0.5-1.2 mm; and t7) 0.5-3.0 mm.

Figure 86:
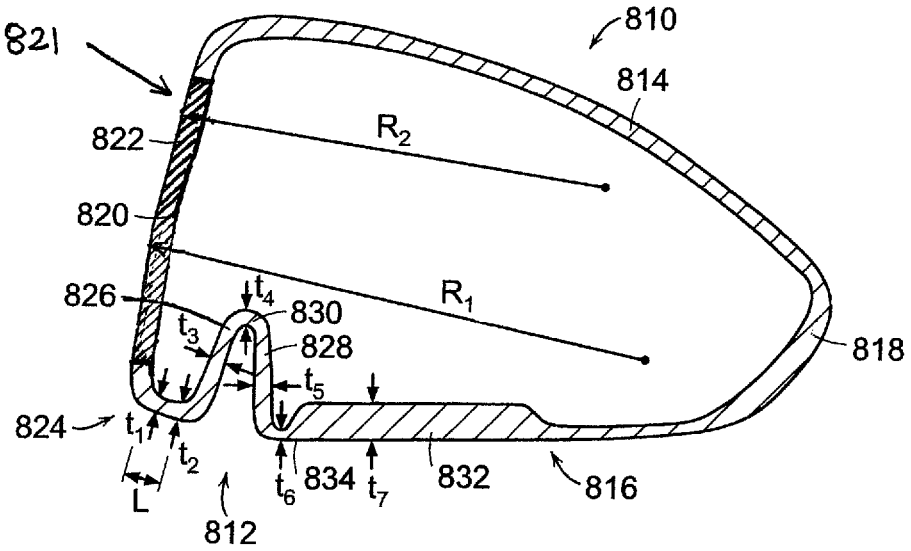
FIG. 86 is an alternative cross-sectional view of a portion of an embodiment of a golf club head of the present invention.

In another embodiment, shown in FIG. 86, an alternative fairway wood construction of golf club head 810 includes a face insert 821 that is optimized with the flexure 812 to distribute stress over a greater area, thereby improving the performance and durability of the golf club head 810. The face insert 821 is preferably constructed from a maraging steel, and the face insert is preferably welded to a cast 17-4 stainless steel golf club head body. In an embodiment, a fairway wood is constructed with a cast 17-4 body with a face insert constructed of maraging steel having a ultimate tensile strength above 2.4 GPa and a thickness less than 2.0 mm and more preferably a thickness of 1.8 mm.

Figure 55:
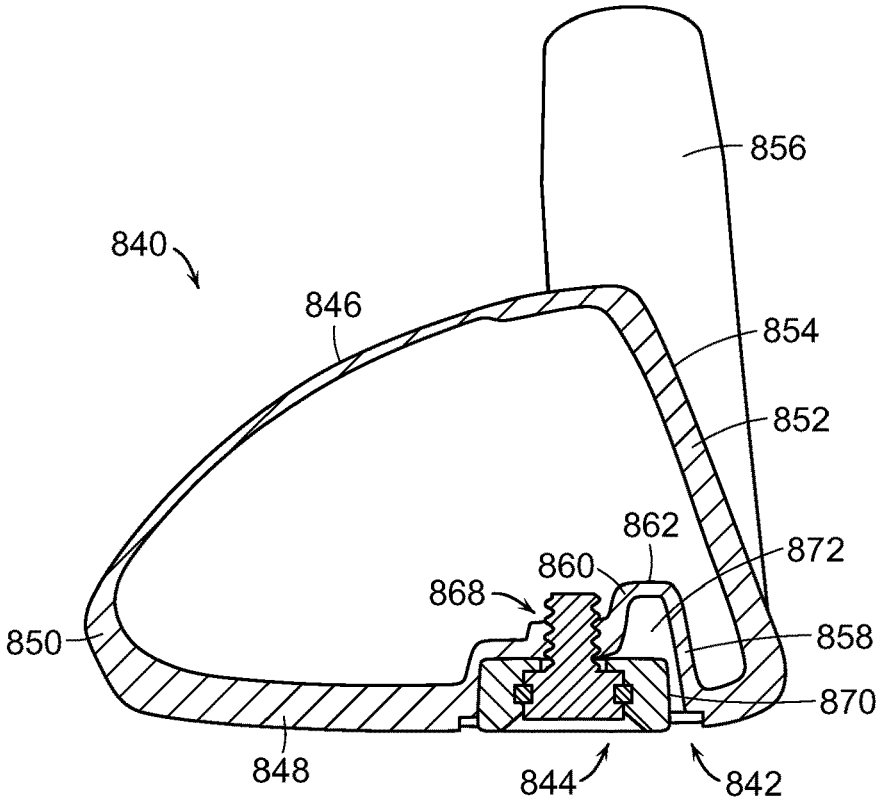
FIG. 55 is a cross-sectional view of an embodiment of a golf club head of the present invention.
Figure 56:
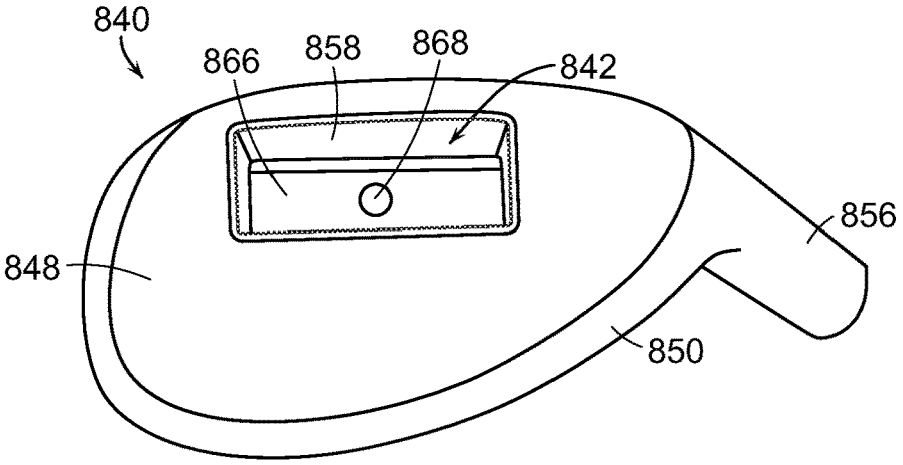
FIG. 56 is a bottom view of the golf club head of FIG. 55.

Referring now to FIGS. 55 and 56, a golf club head 840 includes a flexure 842 that is at least partially covered by a removable member 844. Golf club head 840 includes a crown 846, a sole 848, a skirt 850, a face 852 that defines a ball-striking surface 854, and a hosel 856 that is attached to an elongate golf club shaft and grip in an assembled golf club.

Flexure 842 is located in a forward portion of sole 848, generally adjacent to face 852, and includes a mounting portion for removable member 844. Flexure 842 includes a front wall 858 that is joined with a rear wall 860 at an apex 862. Rear wall 860 extends between apex 862 and the mount 864 for removable member 844. Mount 864 includes a recessed support portion 866 that receives removable member 864 and positions it so that, when it is mounted, the lower surface of removable member 844 is flush or recessed relative to the adjacent exterior surface of sole 848. A coupling feature 868 is included so that removable member 864 may be removably attached to golf club head 840. For example, coupling feature 868 may be a threaded bore and removable member 844 may be a weighted sole plate that is coupled to the threaded bore using a threaded fastener.

Removable member 844 is sized to fit within the recessed mount 864 so that it is spaced from front wall 858 of flexure 842 to form a gap 870. Gap 870 provides an opening into flexure 842 and the opening provides a pathway into a cavity 872 defined by removable member 844 and flexure 842. Gap 870 provides a space so that during a golf ball impact, flexure 842 is able to flex and gap 870 allows front wall 858 to move relative to removable member 844 in a fore-aft direction.

Figure 57:
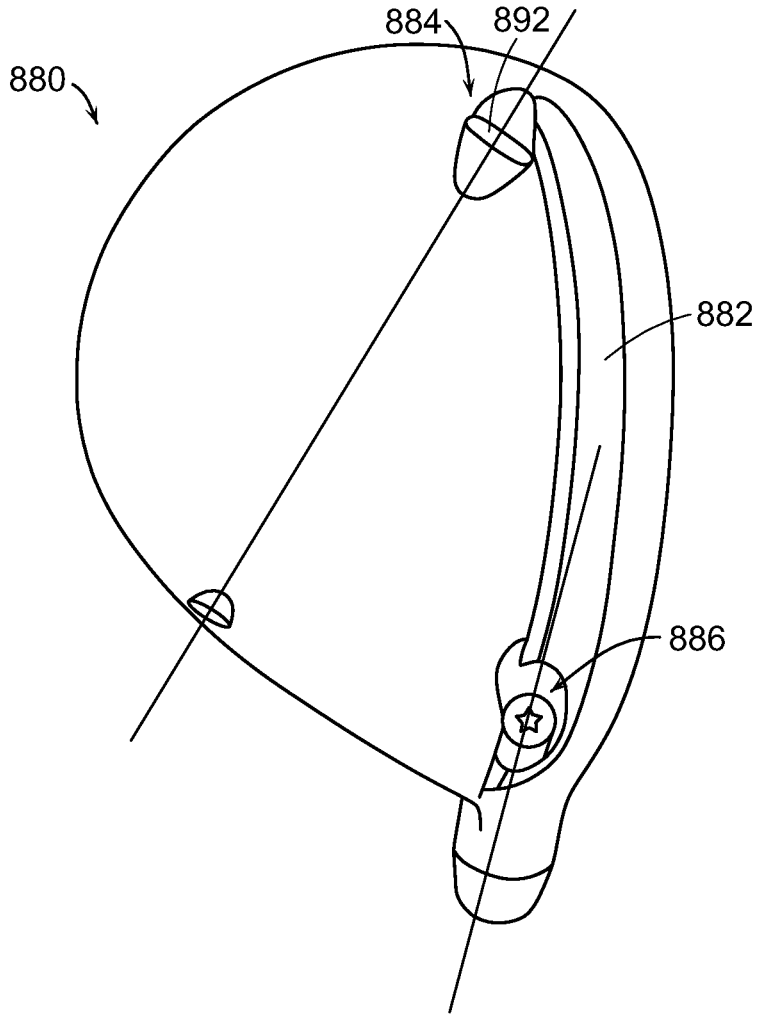
FIG. 57 is a bottom view of another embodiment of a golf club head of the present invention.

Referring to FIG. 57, a golf club head 880 includes a flexure 882 that intersects a removable member 884 mount and an interchangeable shaft system 886. In the present embodiment, golf club head 880 includes a hollow-body construction that is formed by a crown, a sole 888, a skirt, and a hosel 890. Golf club head 880 includes a removable member 884, such as a weight member and a portion of sole 888 includes a mounting feature for the weight member. In the present embodiment the mounting feature includes a generally cylindrical receiver 892 that extends from an outer surface of sole to the interior of golf club head 880.

Golf club head 880 also includes flexure 882 extending in a generally heel to toe direction across a forward portion of sole 888. Flexure 882 may have any of the specific constructions described with regard to the other embodiments described herein.

Golf club head 880 includes an interchangeable shaft system that includes a fastener 894 that is engaged with the head from the sole side. An access bore 896 is included that receives fastener 894 and extends toward hosel 890 from sole 888.

The sole structures of receiver 892, flexure 882 and access bore 896 intersect so that the structures are created by common portions. In particular, a side wall of receiver 892 intersects a side wall of flexure 882 so that the structures are combined in a toe portion of golf club head 880. Similarly, a side wall of access bore 896 intersects a side wall of flexure 882 so that the structures are combined in a heel portion of golf club head 880. The intersection of the structures of receiver 892, flexure 882 and access bore 896, reduces the amount of mass that is dedicated to the extra structures by combining the structures.

Figure 63:
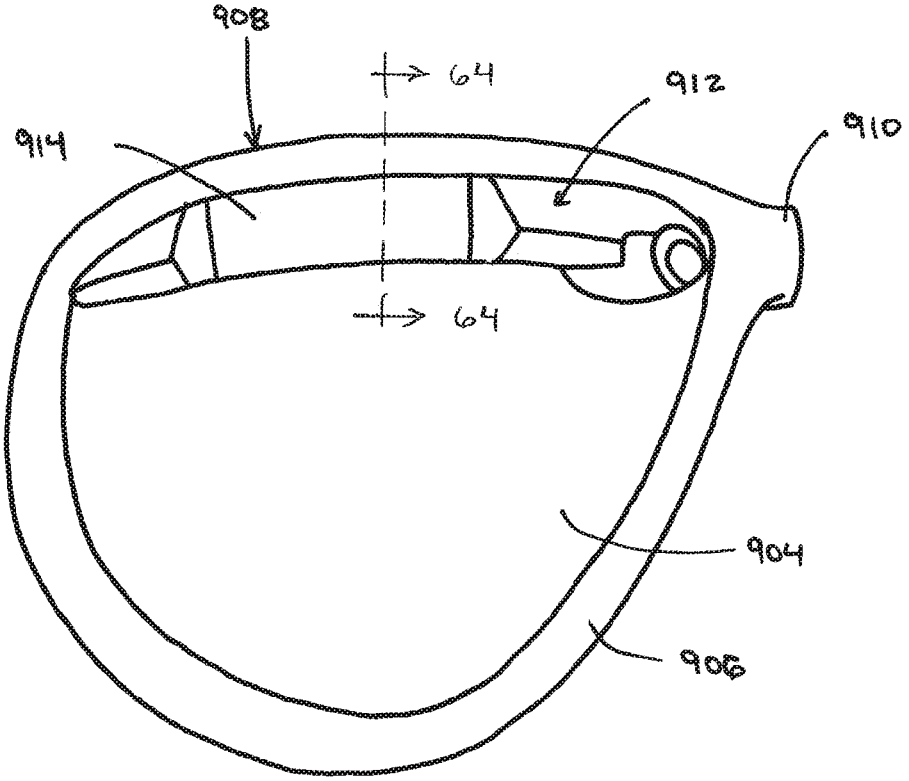
FIG. 63 is bottom view of the golf club head of FIG. 61.
Figure 64:
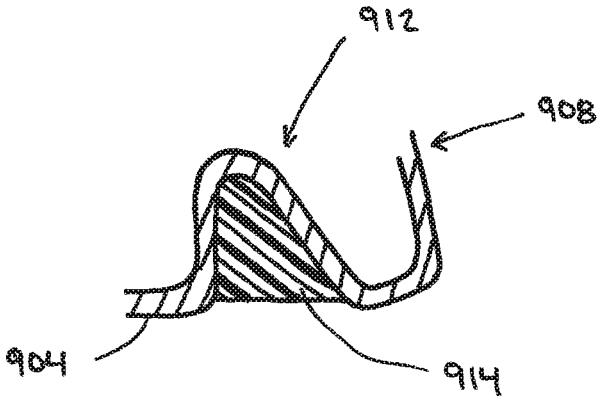
FIG. 64 is a cross-sectional view of the golf club head of FIG. 61, taken along line 64-64 shown in FIG. 63.

As described above, any of the flexures described herein may be completely or partially filled with an insert. As an example, a golf club head 900 of FIGS. 61-64 is shown having a flexure that is partially filled with an insert. The insert may be used to tune the mechanical behavior of the flexure, to locate mass in the recess formed by the flexure, and/or to prevent debris from becoming lodged in the flexure during use. Golf club head 900 is generally constructed as a hollow body formed by a crown 902, a sole 904, a skirt 906, a face 908 and a hosel 910. Golf club head 900 includes a flexure 912 that extends across a portion of sole 904 in a generally heel-to-toe direction. Flexure 912 generally extends toward the interior cavity of the golf club head to form an elongate recess on the exterior of golf club head 900. An insert 914 is included in the elongate recess of flexure 912 and alters the mechanical behavior of flexure 912 caused by an impact between golf club head 900 and a golf ball. The insert may be constructed to fill all or any portion of the length of the flexure to create the desired behavior. As shown in FIG. 63, insert 914 fills a central portion of flexure 912. As an alternative, a plurality of inserts may be included in the flexure and each of the plurality of inserts may have different physical properties, such as mass, hardness, flexibility, etc.

The construction of the insert is selected to tune the mechanical behavior of the flexure. For example, the insert may be constructed of a non-metallic material, such as a plastic or rubber compound. Furthermore, the material preferably has a hardness of less than 40 on a Shore D hardness scale.

Figure 65:
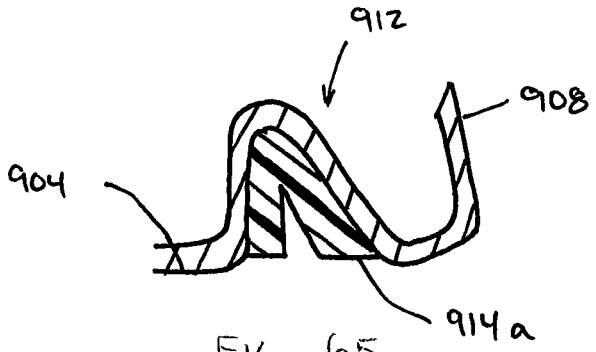
FIG. 65 is an alternative cross-sectional view of the golf club head of FIG. 61, corresponding to line 64-64 of FIG. 63.

In addition to material choices and size, the insert may have a construction that provides a desired flexibility. For example, as shown in FIG. 65, an insert 914*a* may be constructed with a void, or cavity, to allow for bending of portions of the insert 914*a*. In the illustrated example, the void is shaped as a wedge in cross section, and is open to the exterior of the golf club head 900, but it should be appreciated that the void may be located so that it is not exposed to the exterior, such as by creating a void that is fully internal, to prevent debris from collecting in the void. In another alternative, the insert may be constructed so that it includes a plurality of voids, or cavities, distributed in different parts of the insert. For example, the voids, or cavities may be distributed so that they collapse in succession based on the amount of force applied to the flexure 912.

Figure 66:
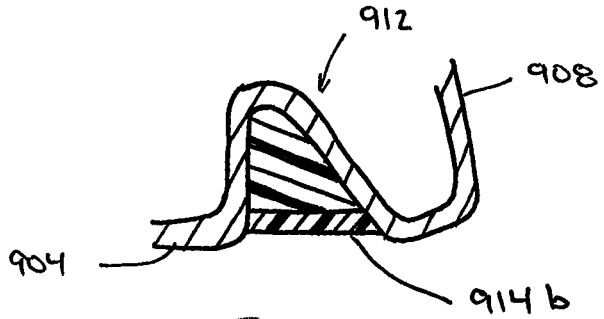
FIG. 66 is an alternative cross-sectional view of the golf club head of FIG. 61, corresponding to line 64-64 of FIG. 63.
Figure 67:
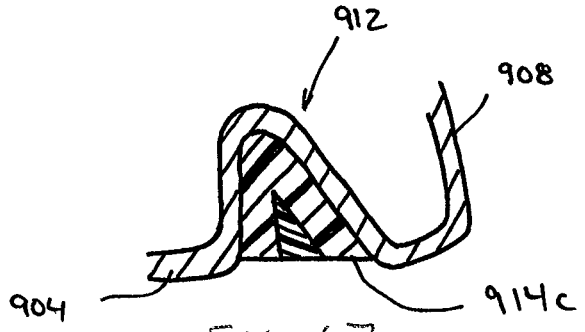
FIG. 67 is an alternative cross-sectional view of the golf club head of FIG. 61, corresponding to line 64-64 of FIG. 63.

Alternatively, the insert may be constructed of a combination of materials, such as by co-molding two materials, or forming an insert from multiple insert components that are adhered together, as shown by inserts 914*b* and 914*c* of FIGS. 66 and 67. In an example, the materials may be selected to have different hardness values, such as by including one material having a hardness value that is less than 40 on a Shore D hardness scale, while the other has a hardness value that is greater than 40 on a Shore D hardness scale. Additionally, the materials may be selected so that the densities of the two materials are different to adjust the insert to a desired mass and the materials may be distributed through the insert so that, for example, an elongate insert has the mass concentrated toward one end, such as a heel or toe end, to shift the center of gravity of the assembled golf club head.

Figure 68:
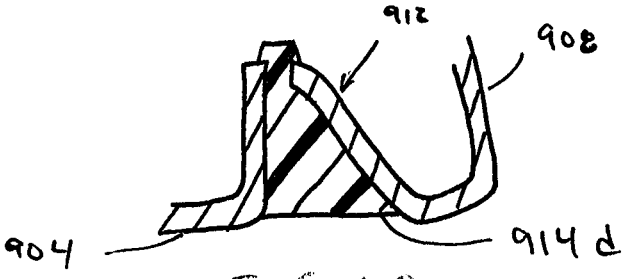
FIG. 68 is an alternative cross-sectional view of the golf club head of FIG. 61, corresponding to line 64-64 of FIG. 63.

In another embodiment, flexure 912 includes a non-continuous wall so that it forms an opening, such as a slot, into the interior cavity of the golf club head. An insert 914*d* is sized to extend through the opening so that a portion of the insert is inserted into the interior cavity of the golf club head, as shown in FIG. 68. Preferably, the portion of the insert extending into the interior cavity has a width dimension that is greater than the width dimension of the opening so that insert 914*d* is at least partially captured in the opening.

Additional embodiments of filled and partially filled flexure structures will be described with reference to FIGS. 80-84. In all of the embodiments shown in FIGS. 80-84, a golf club head 1000 is generally constructed as a hollow body formed by a crown 1002, a sole 1004, a skirt 1006, a face 1008 and a hosel. Golf club head 1000 includes a flexure that extends across a portion of sole 1004 in a generally heel-to-toe direction. The filled flexure creates additional deflection of the striking face toward the leading edge of the golf club head. The wall structure of the flexure and the fill material are selected so that the deflection of the flexure is in phase with the compression of the golf ball during impact between the golf club head and the golf ball. As a result, the golf ball leaves the face with increased ball speed, higher launch angle and lower back spin than a ball impacting a head that does not include the filled flexure. An advantage of the filled flexure construction is that it requires less control and more forgiving tolerances over the geometry, thicknesses and curvature of the metallic flexure components because of the contribution of the polymeric material to the deflection of the filled flexure, so it is easier to manufacture. Additionally, in cast titanium embodiments, the cast material often includes a brittle oxide layer on the surface of the casting. That brittle oxide layer can reduce the durability of the structure because micro cracks often initiate in that layer. Using a polymer to govern the flexibility of the filled flexure therefore reduces the impact that overdesigning thicknesses for durability has on the overall performance of the golf club head.

Figure 80:
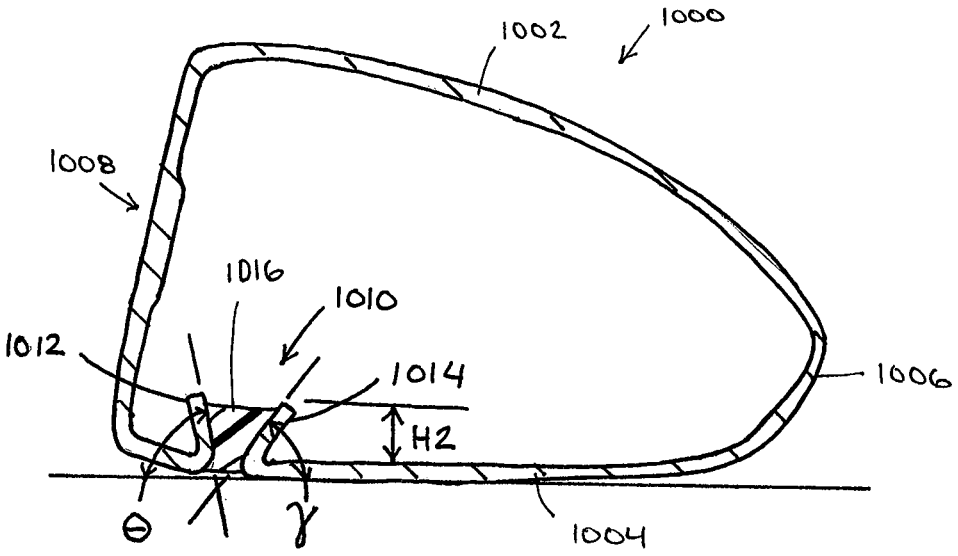
FIG. 80 is a cross-sectional view of an embodiment of a golf club head of the present invention.

Referring to FIG. 80, a flexure 1010 includes a first member 1012 that forms a forward wall and a second member 1014 that forms a rearward wall. Each of first member 1012 and second member 1014 extends from sole 1004 toward an interior of golf club head 1000. In the present embodiment, first member 1012 and second member 1014 form divergent flanges that are angled away from each other as they extend further toward the interior from sole 1004, and as a result the fore/aft distance between the members increases from the lowest portion, when the golf club head is in the address position, to the most inward, upper ends. In particular, each of first member and second member defines an angle relative to the ground plane when the golf club head is in an address position relative to the ground (i.e., when the golf club head is oriented at the designed loft angle and lie angle). In the illustrated embodiment, first member 1012 may be angled relative to the ground plane by a first member angle $\theta$, where $45° < \theta < 90°$, and second member 1014 may be angled relative to the ground plane by a second member angle $\gamma$, where $45° < \gamma < 90°$.

Flexure 1010 is filled with a filler 1016 constructed from at least one viscoelastic polymer, such as urethane, polyethylene, etc. Preferably, the polymeric material has a hardness value in a range of Shore A20-Shore D80. Additionally, the filler may be multi-material such as using two or more polymers having different hardness values and/or elastic properties in a layered configuration to optimize the compliance of the channel. As an example, a multi-compound filler includes a more elastic and softer (e.g., Shore D10) material as an inner most material and a less elastic and harder (e.g., Shore D40) material as an exposed external material to improve wear durability.

The filler 1016 preferably has a cross-sectional width within flexure that is in a range of about 1.0 mm to about 10.0 mm. Additionally, the height of the filler 1016 is preferably in a range of about 2.0 mm to about 10.0 mm.

Figure 81:
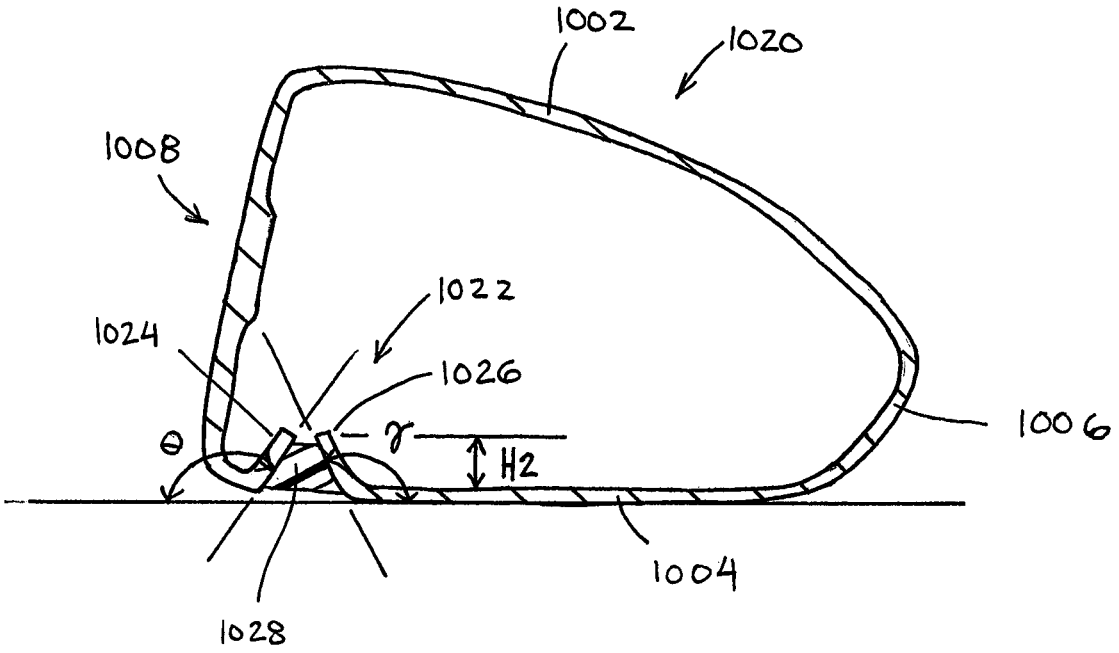
FIG. 81 is a cross-sectional view of an embodiment of a golf club head of the present invention.

In another embodiment, shown in FIG. 81, a golf club head 1020 is constructed similar to golf club head 1000, but the configuration of the flexure is different. Golf club head 1020 includes by a crown 1002, a sole 1004, a skirt 1006, a face 1008, a hose, and a flexure 1022. Flexure 1022 includes a first member 1024 that forms a forward wall and a second member 1026 that forms a rearward wall. Each of the first member 1024 and the second member 1026 extend toward an interior of golf club head 1020, and the first and second members form convergent flanges that are angled toward each other as they extend further toward the interior from sole 1004. In the illustrated embodiment, first member 1024 may be angled relative to the ground plane by a first member angle $\theta$, where $90° < \theta < 135°$, and second member 1026 may be angled relative to the ground plane by a second member angle $\gamma$, where $90° < \gamma < 135°$.

It should be appreciated that the walls of the flexure may be constructed to be divergent, parallel or convergent to tune the flexural response of the flexure when an impact load is placed on the golf club head. Additionally, the first member angle $\theta$ and the second member angle $\gamma$ may each range between about 45° and about 135°.

Figure 84:
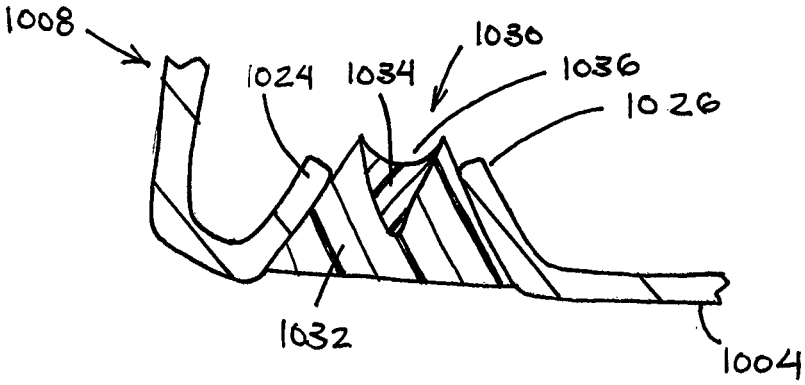
FIG. 84 is a cross-sectional view of a portion of another embodiment of a golf club head of the present invention.

Golf club head 1020 also includes a filler 1028 that is constructed from at least one viscoelastic polymer. The choices of materials are the same as those described above with respect to filler 1016. Additionally, a filler 1030 having a multi-material construction is illustrated in FIG. 84. In particular, filler 1030 includes a first material member 1032 and a second material member 1034. The members are chosen so that one is compliant and flexible and the other is stiff and strong so that the filler 1030 can allow the flexure to be compliant while preventing bending that would result in cracks forming along the flexure geometry. Additionally, the filler may be formed with geometry that alters the compliance of the filler. For example, filler 1030 may include geometric features that alter the stiffness of the filler 1030, such as radii or notches. As shown, filler 1030 includes a notch 1036 that extends along at least a portion of the length of filler 1030.

Figure 82:
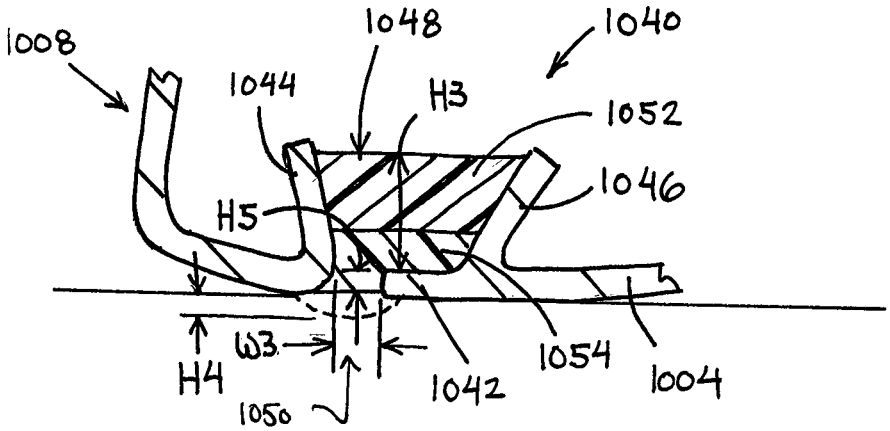
FIG. 82 is a cross-sectional view of a portion of another embodiment of a golf club head of the present invention.

In additional embodiments, the flexure includes a sole extension that extends across at least a portion of the flexure so that a width of the opening of the flexure on the outermost surface of the golf club head is reduced. The sole extension preferably covers a portion of a filler member so that it provides a skid plate to protect the filler from contact with a ground surface and foreign materials. Referring to FIG. 82 a flexure 1040 including a sole extension 1042 will be described. In particular, flexure 1040 generally includes a first member 1044 and a second member 1046, and is constructed so that the first and second members form divergent flanges. Sole extension 1042 extends from a portion of sole 1004 rearward of flexure 1040 where second member 1046 joins with sole 1004 toward first member 1044. Sole extension 1042 extends only partly across the opening formed by flexure 1040.

The flexure 1040 includes a filler 1048 that extends above sole extension 1042 and fills at least a portion of the space between first member 1044 and second member 1046. Preferably, filler 1048 extends above sole extension 1042 a height H3 between about 4.0 and about 10.0 mm. A width W3 of the opening 1050 extending between sole extension 1042 and first member 1044 is between about 1.0 mm and about 4.0 mm. Filler 1048 may also extend out of the golf club head through opening 1050 and may extend below the adjacent sole extension 1042, or adjacent sole surface by a height H4 that is between about 0.1 mm and about 1.0 mm. Additionally, filler 1048 may be flush with the external or internal sole surface and the distance H5 that the filler is recessed into the head from the external surface of the sole is preferably less than or equal to 1.0 mm. Preferably, a ratio of the maximum internal width, i.e., the maximum distance between first member 1044 and second member 1046 in the direction parallel to the Z-axis of the head, so the opening width W3 is between about 1.0 mm and about 10.0 mm.

Additionally, and as shown in FIG. 82, filler 1048 may be constructed from multiple materials. Filler 1048 may be constructed from a first material member 1052 and a second material member 1054. In an example, first material member 1052 is constructed from a material having a hardness of about Shore D40 and second material member 1054 is constructed from a material having a hardness of about Shore D10.

Figure 83:
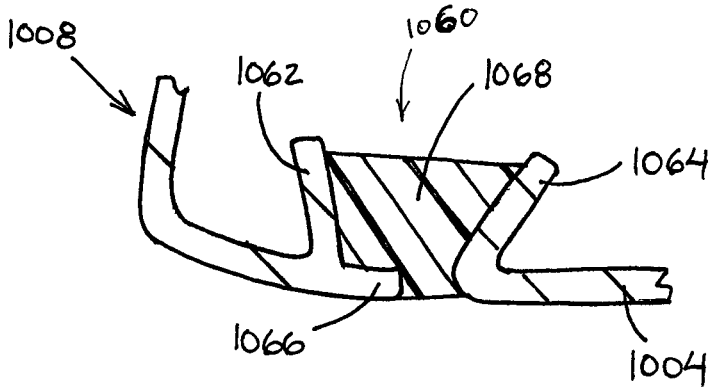
FIG. 83 is a cross-sectional view of a portion of another embodiment of a golf club head of the present invention.

In an alternative embodiment, illustrated in FIG. 83, a flexure 1060 is constructed from a first member 1062, a second member 1064 and a sole extension 1066. In the illustrated embodiment, the first member 1062 and second member 1064 form divergent flanges and sole extension 1066 extends from a portion of sole 1004 forward of flexure 1060 where first member 1062 joins with sole 1004 towards second member 1064. A filler 1068 is included in flexure 1060 to tune the deflection response of flexure 1060.

The mechanical behavior of the flexure may be tuned by selecting the material and the configuration of the inserts. In an example, a golf club head construction including a flexure having an opening was tested with and without an insert. Additionally, a plurality of insert configurations, including inserts constructed from different materials, were tested in that head construction to demonstrate the effectiveness of the insert in tuning the behavior of the flexure. In particular, a plurality of test heads were tested using a swing robot and measurements were taken of a golf ball behavior immediately after impact using a launch monitor. Each test head included a flexure configuration similar to that shown in FIG. 52, an elongate opening at the apex, a loft angle of 15.5°, and a volume of about 175 cc. Test heads were measured having no insert, and including three different configurations of inserts. Measurements of ball speed, launch angle, and backspin were taken from launch monitor data, which allowed calculation of carry distance and total yardage, as shown in the following table. In particular, Sample 1 corresponds to the test head with no insert. Sample 2 corresponds to the test head having an insert partially filling the recess and extending into the opening, with the insert constructed of a 3M 5200 FC Urethane material ("3M" is a registered trademark of 3M Company of St. Paul, Minn.). Sample 3 corresponds to the test head having an insert partially filling the recess and extending into the opening, with the insert constructed of a 3M TE 040 Urethane material. Sample 4 corresponds to the test head having an insert partially filling the recess and extending into the opening, with the insert constructed of a 3M TE 031 Urethane material. In all of these embodiments, the material was cast in place in the flexure.

| | Insert Material Durometer | Ball Speed [mph] | Launch Angle [deg.] | Backspin [rpm] | Carry [yd.] | Total Yards [yd.] |
|---|---|---|---|---|---|---|
| Sample 1 | N/A | 157.3 | 10.0 | 3011 | 258.5 | 273.0 |
| Sample 2 | 80 Shore A | 157.4 | 10.4 | 3125 | 259.2 | 272.6 |
| Sample 3 | 20 Shore D | 157.7 | 10.7 | 3304 | 259.1 | 270.5 |
| Sample 4 | 40 Shore D | 157.1 | 10.8 | 3365 | 257.0 | 268.6 |

In another test, an additional plurality of test heads having a flexure with a similar construction as the first plurality of test heads were constructed and tested. In the second plurality, the inserts were formed as separate components having different hardness and sizes, and inserted into the flexure. The second plurality of test heads was tested using a swing robot and launch monitor identical to the first plurality of test heads and measurements were taken, as shown in the following table. As is evident from the test data, a wide range of launch characteristics may be altered and tuned by altering the insert properties and dimensions.

| | Configuration | Insert Material Durometer | Ball Speed [mph] | Launch Angle [deg.] | Backspin [rpm] | Carry [yd.] | Total Yards [yd.] |
|---|---|---|---|---|---|---|---|
| Sample 5 | Empty | N/A | 156.2 | 11.2 | 3282 | 255.7 | 266.3 |
| Sample 6 | Short Soft Plug | 70 Shore A | 155.6 | 11.0 | 3372 | 253.0 | 263.1 |
| Sample 7 | Short Firm Plug | 80 Shore A | 155.9 | 11.1 | 3378 | 253.9 | 264.0 |
| Sample 8 | Tall Soft Plug | 70 Shore A | 154.8 | 10.9 | 3451 | 250.8 | 260.9 |
| Sample 9 | Tall Firm Plug | 80 Shore A | 154.6 | 11.1 | 3747 | 248.0 | 256.4 |
| Sample 10 | Soft Fill | 60 Shore A | 155.0 | 11.1 | 3430 | 251.7 | 261.6 |
| Sample 11 | Firm Fill | 80 Shore A | 154.5 | 11.3 | 3729 | 248.4 | 256.9 |

Figure 69:
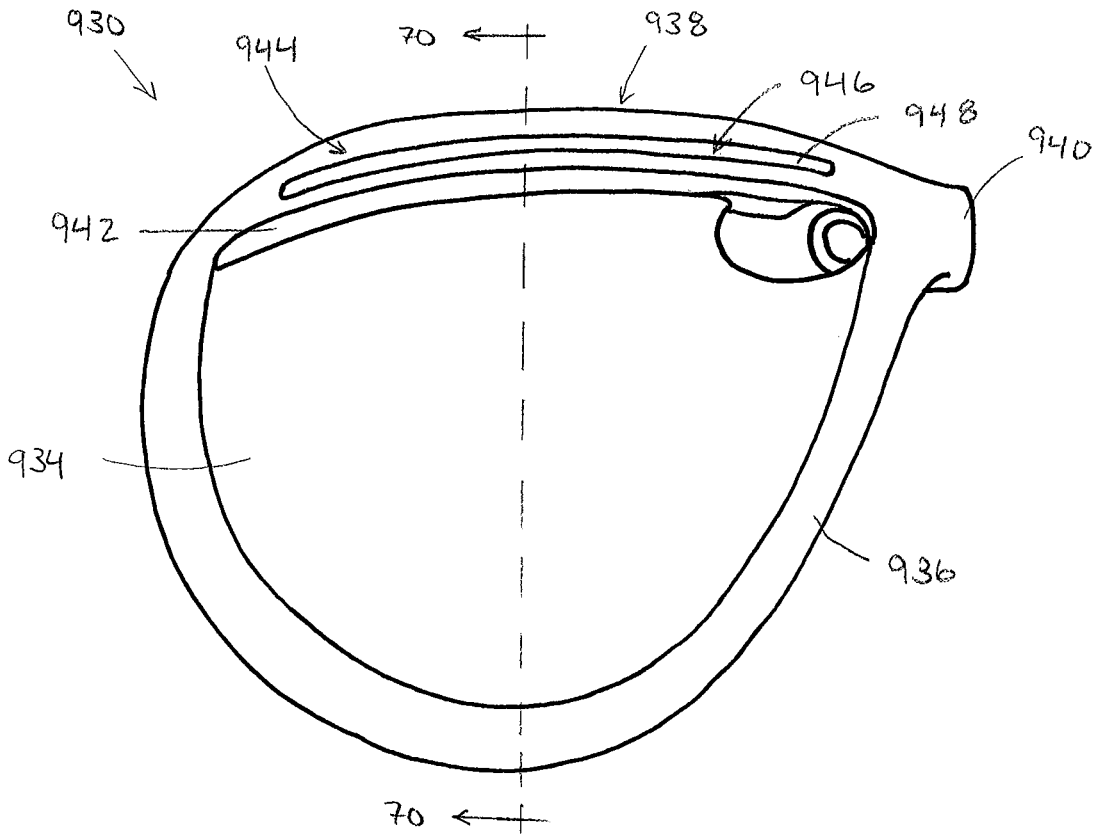
FIG. 69 is a bottom view of another embodiment of a golf club head of the present invention.
Figure 70:
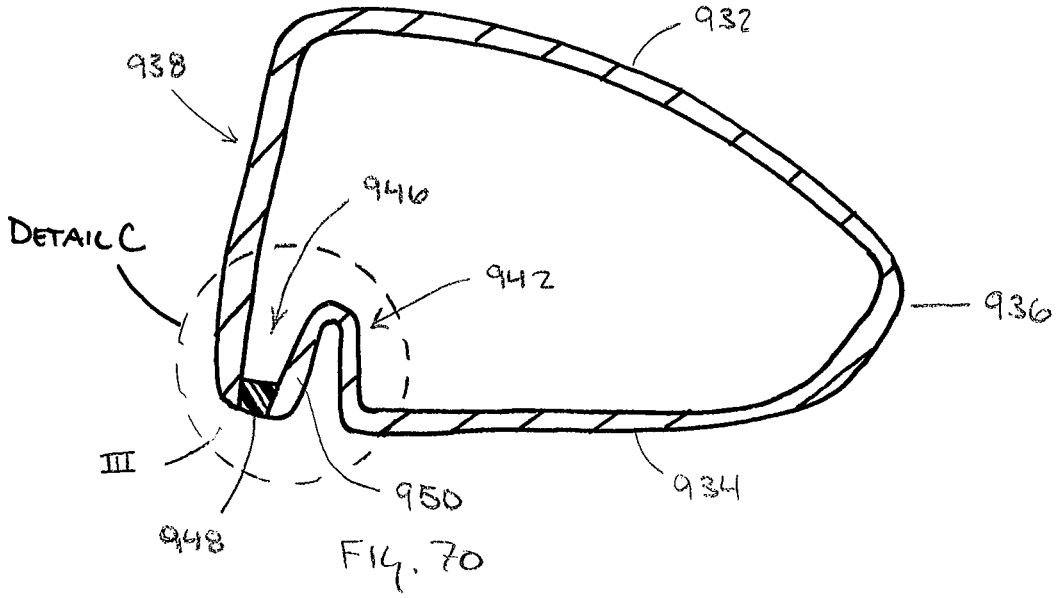
FIG. 70 is a cross-sectional view of the golf club head of FIG. 69, taken along line 70-70.
Figure 71:
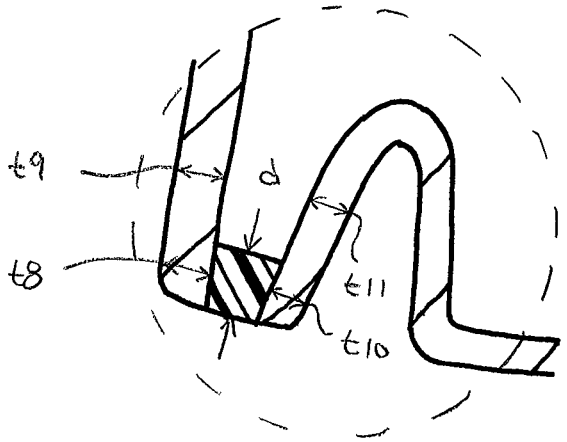
FIG. 71 is a side view of a portion, shown in FIG. 70 as detail C, of the golf club head of FIG. 70.

In another aspect of the present invention, additional features are added to alter the boundary conditions placed on a flexure, to alter the behavior of the golf club head. As an example, a slot, or through hole, may be disposed in a transmittal portion located between the face and the flexure, as shown in FIGS. 69-71. The slot may be used in conjunction with a flexure having any construction including flexures formed by either continuous or discontinuous walls, such as those described herein and those having constructions as described in U.S. Pat. No. 7,582,024 to Shear, such as the features illustrated in FIGS. 4B and 4C of that reference, which is hereby incorporated by reference.

In modern golf club heads that include compliant faces, when a ball hits the face the face deflects with the center of the face deflecting toward the interior cavity and the rear of the golf club head. The perimeter of the face is supported by the crown, the skirt and the sole and the deflection of the face generally creates a bending moment at the perimeter. That bending moment is transmitted into the crown, the skirt and the sole, generally causing them to bulge outward. The inclusion of a slot in a golf club head between a flexure and a compliant face at least partially decouples the face and sole so that the front wall of the flexure and the lower portion of the face are able to deflect more easily and in a less constrained manner, thereby increasing the efficiency of the flexure.

In particular, a golf club head 930 is constructed as a hollow body formed by a crown 932, a sole 934, a skirt 936, a face 938 and a hosel 940. Golf club head 930 includes a flexure 942 that extends across a portion of sole 934 in a generally heel-to-toe direction spaced from the face by a transmittal portion 944. Flexure 942 generally extends toward the interior cavity of the golf club head to form an elongate recess on the exterior of golf club head 930. Golf club head 930 also includes a slot 946 that is located in the transmittal portion 944 and decouples at least a portion of the front edge of the flexure 942 from the lower end of the face 938. Preferably, an insert 948 is disposed in slot 946, and insert 948 is constructed from an elastic material.

The addition of the relatively long and narrow through hole in the sole immediately behind the face, and immediately in front of the flexure allows a further decrease in backspin and increase in ball speed. The dimensions and location of slot 946, and the material properties of insert 948, are selected to provide the desired behavior of golf club head 930. Preferably, the maximum length of slot 946 parallel to the x-axis is at least about 50% of the maximum length of flexure 942, and more preferably the maximum length of slot 946 is at least about 75% of the maximum length of flexure 942. Additionally, slot 946 preferably extends across a vertical plane that extends through the geometric face center of the ball-striking surface of face 938, and that is generally perpendicular to a ground plane when the golf club head is in an address position. In a fairway wood embodiment the length of slot 946 is generally in a range between about 50 mm and about 90 mm, and is more preferably about 70 mm, and is preferably centered across the vertical plane that extends through the geometric face center of the ball-striking surface and that is parallel to the z-axis.

The maximum width of slot 946 is in a range of about 0.5 mm to about 5.0 mm, and is preferably between about 1.0 mm and about 4.0 mm, as measured along an axis that is parallel to the z-axis of the golf club head in a face to aft direction. The distance between a ball-striking surface plane and a leading edge, or forward most edge, of slot 946 is preferably between about 2.0 mm and about 5.0 mm, wherein the ball-striking surface plane is defined as a plane that is tangent to the geometric face center of the ball-striking surface of the golf club head. More preferably, the distance between the ball-striking surface plane and a leading edge of slot 946 is between about 3.0 mm and about 5.0 mm. In specific examples, a fairway wood is constructed with the distance between the ball-striking surface plane and a leading edge of the slot being about 3.0 mm, and a driver is constructed with that distance being about 5.0 mm, to optimize the combined behavior of the flexure and slot.

In the illustrated embodiment, the slot is sized so that insert 948 extends from a back surface of the face 938 to a front surface of a front wall of flexure 942. The thickness of the portion of the face forward of slot 946, immediately adjacent slot 946, is within about 35% of the minimum thickness of the face 938, and more preferably within about 25% of the minimum thickness of the face. As an alternative, the thickness of the portion of the face forward of slot 946, immediately adjacent slot 946, is about equal to the thickness of the face at the geometric face center. Even more preferably, a back surface of face 938 forms a front edge of slot 946 and the thickness of the portion of the face forward of slot 946, immediately adjacent and defining the front edge of the slot 946, is within about 25% of the minimum thickness of the face. In an embodiment, the thickness t8 of the portion of face 938 that defines a front edge of the slot is about the same as a thickness t9 of face 938 that is toward the geometric face center of the face and within about 10 mm of slot 946. Additionally, at least a portion of slot 946 is preferably forward in a fore-aft direction (i.e., a fore-aft direction being defined as extending between the face and a rearward most aft portion of the golf club head when the golf club head is placed in an address position as shown in FIG. 1, also corresponding to the direction of a Z-axis of the golf club head, may also be referred to as face-aft direction), of a heel to toe plane of the shaft axis including the golf club head.

As described above, the slot 946 is located in the transmittal portion 944, and is sized to extend from a back surface of the face to a front surface of a front wall of the flexure. The thickness t10 of the portion of the front wall 950 of flexure 942, immediately adjacent slot 946 and defining a rear wall of slot 946, is preferably within about 25% of the minimum thickness t11 of the front wall 950 of flexure 942. Even more preferably, the thickness t10 of the portion of the face forward of slot 946, immediately adjacent and defining the front edge of the slot 946, is about equal to the minimum thickness of the front wall 950 of flexure 942.

As shown, insert 948 fills slot 946 and is constructed from an elastic material. Preferably, the material of insert 948 has a hardness in a range of between about 30 to about 90 on a Shore A hardness scale, or between about 20 and about 40 on a Shore D hardness scale. Insert 948 extends into slot 946 from the outer surface of sole 934 and has a depth d of about 1.0 mm to about 8.0 mm, more preferably, insert 948 has a depth d of about 3.0 mm to about 6.0 mm, and more preferably insert 948 has a depth d of about 4.5 mm. Additionally, the slot may have constant width, in a direction between a face to aft of the club (i.e., along a Z-axis) or it may be tapered to have a width that varies over the depth. In the present embodiment, in cross-section the back surface of face 938 is angled relative to a forward surface of front wall 950 and the insert 948 occupies the space therebetween with a depth of about 4.5 mm. As a result, the insert 948 is tapered from a first width closest to the outer surface of the sole to a second width closest to the interior cavity of the golf club head, and the first width is less than the second width.

Figure 72:
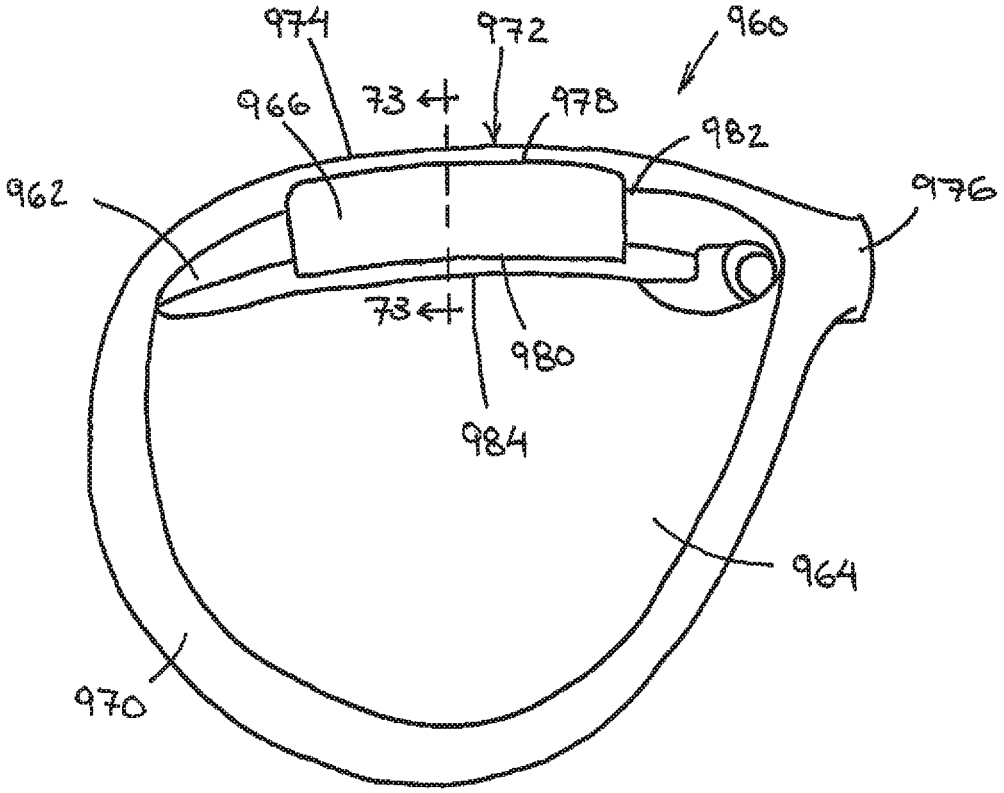
FIG. 72 is a bottom plan view of an embodiment of the golf club head.
Figure 73:
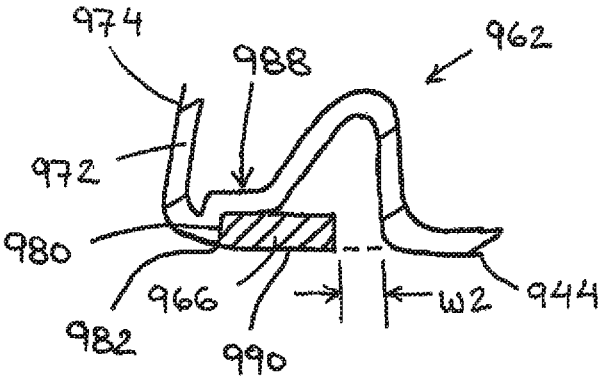
FIG. 73 is a side cross-sectional view of a portion, corresponding to line 73-73 of FIG. 72.

In additional examples, shown in FIGS. 72-79, a cover is included in the golf club to at least partially cover the opened flexure. As shown in FIGS. 72 and 73, a golf club head 960 includes a flexure 962 that is disposed on a sole 964 of the club head and a cover 966. Similar to previous embodiments, golf club head 960 is a hollow body that includes a crown, sole 964, a skirt 970, or side wall, that extends between a crown and sole 964, a face 972 that provides a ball striking surface 974, and a hosel 976. The flexure 962 extends toward the interior of the golf club head and creates an elongate recess that extends across a portion of sole 964.

Similar to the embodiment illustrated FIG. 13, the compliant flexure may be combined with a cover member. The cover may be configured to assist in the control of the address position of the golf club head, such as by altering the visual face angle of the golf club head, when the sole is placed on the playing surface, and/or to alter the interaction between the sole and the ground surface for clubs intended for ground impact, such as fairway wood and hybrid clubs. Preferably, the cover is included in golf club heads including a flexure that is within 20.0 mm of the leading edge to compensate for the smaller sole surface forward of the flexure to improve interaction with the ground during use, effectively increasing the sole surface area between the leading edge and the opened portion of the flexure. In an example, cover 966 is generally a strip of material that is disposed partially across flexure 962 in both a toe-to-heel direction (i.e., in the direction of the X-axis) and a fore-aft direction (i.e., in the direction of the Z-axis) to partially cover flexure 962.

In this and alternative embodiments, the size and position of the cover are selected to provide a desired behavior. For example, in embodiments in which the cover is used to alter the visual face angle of the golf club head at address, the cover extends heelward from a vertical plane extending in a fore-aft direction (i.e., a plane parallel to both the Y-axis and the Z-axis; a Y-Z plane) through the geometric face center of the golf club head, and preferably it extends between 10.0 and 40.0 mm from that plane toward a heel of the golf club head and in a direction parallel to the X-axis of the golf club head.

In embodiments in which the cover is used to alter the interaction between the golf club head and a ground plane, the cover preferably extends across a vertical plane extending in a fore-aft direction. In particular, the cover extends across the plane and for a distance of at least 5.0 mm on both sides of the plane. More preferably, the cover extends at least 10.0 mm to at least one side of the fore-aft plane and even more preferably at least about 20.0 mm to at least one side of the fore-aft plane.

The cover 966 defines a cover leading edge 978 and a cover trailing edge 980. Similarly, flexure 962 defines a leading edge 982 and a trailing edge 984. In the present embodiment, the cover trailing edge 980 is spaced from the flexure trailing edge 984 by a space W2 that is preferably between about 1.0 and about 10.0 mm.

The cover 966 may be constructed as a separate component and coupled to the golf club head, or it may formed as a monolithic part of the golf club head such as by casting. In embodiments utilizing a separate cover, the cover 966 is coupled to portions of golf club head 960 adjacent flexure 962 by welding, brazing, adhesive bonding, press fitting, co-molding or by mechanical fasteners. In an example, shown in FIG. 73, a secondary recess 988 is included in a leading edge 982 of flexure 962 that receives a portion of the cover 966 including the leading edge 980. The cover 966 is coupled to the head in the recess so that an outer surface 990 of cover 966 is able to follow the contour of the portions of sole 964 adjacent to cover 966 and so that the leading edge 978 of the cover is protected during a ground impact.

The cover 966 may be constructed from metallic or non-metallic materials, such as titanium, aluminum, steel, magnesium, carbon fiber composite, thermoplastic, etc. A plurality of covers may be constructed from different materials having different specific gravities so that covers having different masses may be provided.

Figure 74:
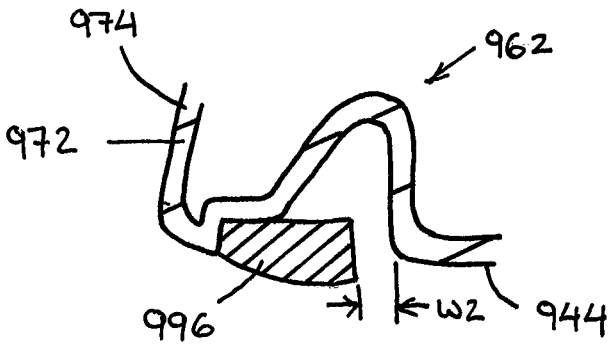
FIG. 74 is a side cross-sectional view of an alternative embodiment, generally corresponding to line 73-73 of FIG. 72.
Figure 75:
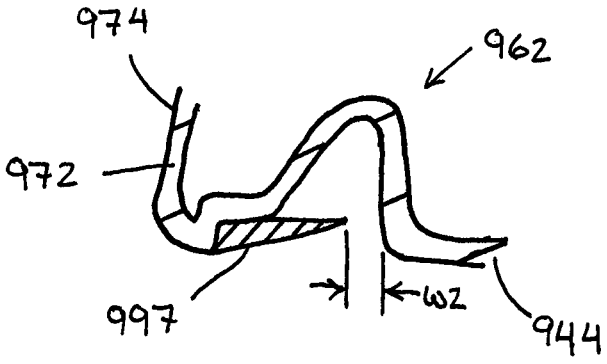
FIG. 75 is a side cross-sectional view of an alternative embodiment, generally corresponding to line 73-73 of FIG. 72.
Figure 76:
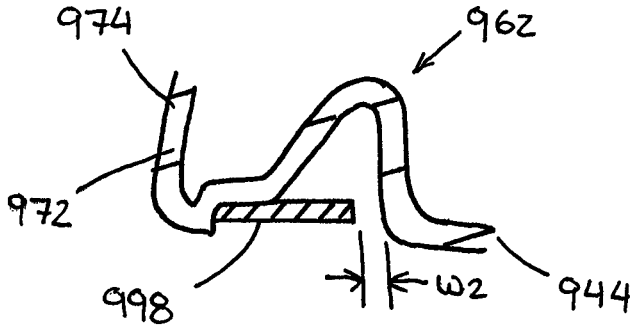
FIG. 76 is a side cross-sectional view of an alternative embodiment, generally corresponding to line 73-73 of FIG. 72.

The shape of the cover may be selected to provide a desired sole contour, as shown in embodiments of FIGS. 74-76. The different shapes and sizes of the covers are provided to allow for better playability for different player deliver conditions. In particular, different players have swings that result in the club head approaching the ground and a golf ball at different angles that provide an angle of attack. The different angles of attack of the swings create different requirements for ground interaction that are accommodated by the different covers. In each of those embodiments, the golf club head and flexure remain the same to illustrate the difference in cover configurations. In a first example, a cover 996 includes a rounded bulbous profile that extends outward from the contour of the adjacent sole portions. In another example, a cover 997 is drafted or angled relative to the contour of the adjacent sole portions. In a still further example, cover 998 has a flatter profile similar to cover 966, but the thickness of cover 998 is smaller so that a stepped sole configuration is provided, i.e., the outer surface of the cover is recessed relative to adjacent sole portions of the golf club head.

The cover may be included to both assist in the control of the address position of the golf club head when the sole is placed on the playing surface and to eliminate undesirable aesthetics of the flexure. In particular, the cover may be included to tune the visual face angle of the golf club head when the head is placed on the playing surface by altering the contact surface of the golf club head. The cover may be configured to wrap around a perimeter of the golf club head to the crown and may replace a portion of the material of the perimeter to create a lower density body structure to provide additional discretionary mass, a lower and/or deeper center of gravity location and a higher moment of inertia, thus improving performance and distance potential.

Figure 58:
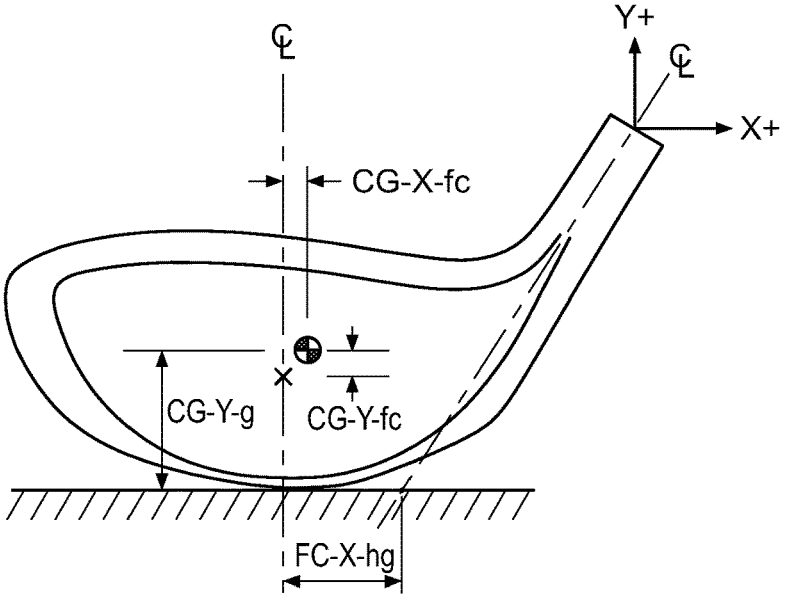
FIG. 58 is a front view of a golf club head illustrating dimensional characteristics and a coordinate system used herein.
Figure 59:
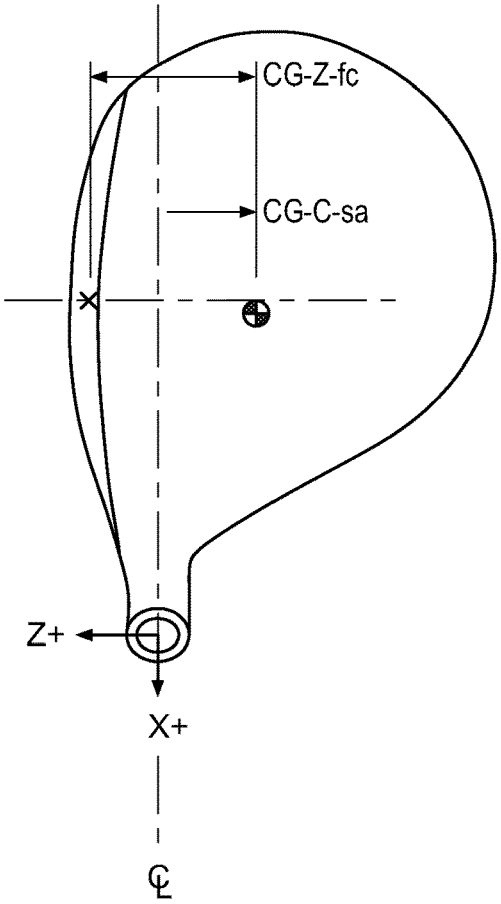
FIG. 59 is a top view of the golf club of FIG. 58.
Figure 60:
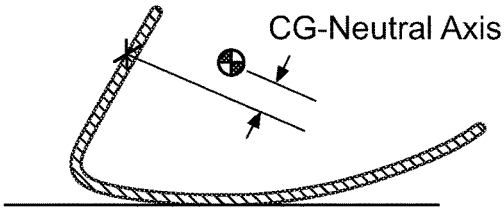
FIG. 60 is a cross-sectional view of a portion of the golf club head of FIG. 58.
Figure 61:
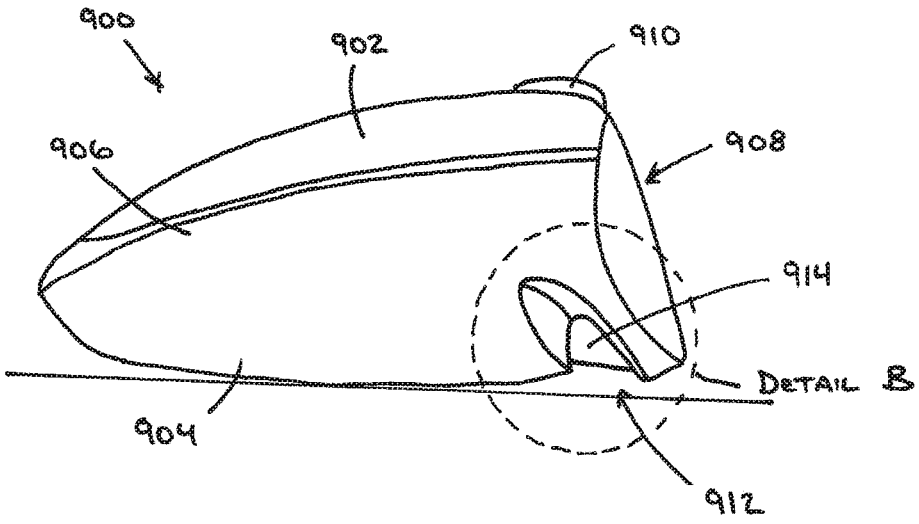
FIG. 61 is a side view of another embodiment of a golf club head of the present invention.

The physical attributes of golf club heads are generally controlled to provide desired behavior during an impact with a golf club head. In metalwood golf club heads, the mass distribution is controlled to provide a desired location of the center of gravity and a desired moment of inertia. As illustrated in FIGS. 58-60, the center of gravity of a golf club head may be dimensionally related to any number of features on the golf club head. Desired dimensional ranges for golf clubs of the present invention are presented in the table below, with negative values denoted by parenthesis to indicate the direction relative to the reference feature (e.g., fc-face center; g-ground).

| Golf Club Type | CG-C-sa [mm] | CG-X-fc [mm] | CG-Y-fc [mm] | CG-Z-fc [mm] | CG-Y-g [mm] | CG-Neutral Axis [mm] |
|---|---|---|---|---|---|---|
| Driver | 13.5-28.0 | (1.6)-7.8 | (7.8)-1.2 | (43.0)-(29.0) | 26.3-32.7 | (5.3)-7.0 |
| Preferred Driver | 18-22 | (1.3)-3.5 | (5.4)-0.0 | (38.0)-(30.0) | 26.9-29.0 | (1.0)-6.3 |
| Fairway | 5.8-21.9 | (0.9)-5.3 | (4.8)-0.9 | (33.3)-(18.2) | 13.8-18.9 | (2.8)-7.8 |
| Preferred Fairway | 8.0-15.9 | 0.3-2.5 | (4.8)-(0.6) | (29.5)-(22.0) | 14.1-18.8 | (2.5)-6.8 |

The flexures of the present invention are also sized relative to the location of the center of gravity of the golf club head to provide desired behavior. It should also be appreciated that the width W, height H and distance to ball striking-surface D may be measured on all of the embodiments described herein as illustrated in FIGS. 1 and 4. Preferably the distance D from the ball-striking surface to the flexure is less than or equal to 30.0 mm, more preferably less than or equal to 20.0 mm, and more preferably between 5.0 mm and 20.0 mm. Additionally, the distance D is preferably between 20% and 50% of the CG-Z-fc distance, and more preferably between 25% and 45% of the CG-Z-fc distance. Additionally, the sum of the height and width of the flexure is preferably within +/−30% of the CG-Y-g distance and more preferably within +/−20% of the CG-Y-g distance.

The reduction in backspin provided by the flexure of the present invention also provides more flexibility in mass distribution to increase the moment-of-inertia of a golf club head. In particular, the incorporation of a flexure of the present invention into the sole of a golf club head provides ball impacts that emulate launch conditions of a golf club head without a flexure that has a low center of gravity. Analysis has shown that the incorporation of a flexure of the present invention provides the same effect as lowering the center of gravity of a golf club without the flexure by as much as 3.0 mm. However, lowering the center of gravity of requires that mass is placed lower in the golf club head and because of the shape of the golf club head it limits the amount of mass that can be placed at the perimeter to increase moment-of-inertia. Therefore, the flexure of the present invention may be used to provide the behavior of a golf club head with a lower center-of-gravity while additional mass is placed at the perimeter of the golf club head to increase moment-of-inertia and moving the center-of-gravity rearward.

As described above, the flexure of the present invention provides lower stiffness locally in a portion of the golf club head. Generally the lower stiffness may be achieved by selecting the geometry of the flexure, such as by altering the shape and/or cross-sectional thickness, and/or by selecting the material of portions of the flexure. Materials that may be selected to provide the lower stiffness flexure include low Young's modulus beta ((3), or near beta (near-(3), titanium alloys.

Beta titanium alloys are preferable because they provide a material with relatively low Young's modulus. The deflection of a plate supported at its perimeter under an applied stress is a function of the stiffness of the plate. The stiffness of the plate is directly proportional to the Young's modulus and the cube of the thickness (i.e., $t^3$). Therefore, when comparing two material samples that have the same thickness and differing Young's moduli, the material having the lower Young's modulus will deflect more under the same applied force. The energy stored in the plate is directly proportional to the deflection of the plate as long as the material is behaving elastically and that stored energy is released as soon as the applied stress is removed. Thus, it is desirable to use materials that are able to deflect more and consequently store more elastic energy.

The construction of the flexure generally results in material extending into the cavity of the golf club, which generally raises the CG when the flexure is located in the sole or the crown of the golf club head. The increase in CG height is more substantial when a flexure is included in the crown. Preferably, in embodiments utilizing a crown flexure, the portion of the crown rearward of the flexure is lowered relative to the portion of the crown forward of the flexure to lower the overall CG of the golf club head. In particular, the height of the forward edge of the crown flexure is greater than the height of the rearward edge of the crown flexure. Preferably, the difference in height is greater than 1.0 mm, and more preferably greater than 2.0 mm, and the location of the crown having a maximum height from the ground surface is between the face of the golf club head and the flexure.

As shown in previous embodiments, a golf club head may be constructed with one or more mounting features for removable weights to alter the overall golf club head weight and/or the location of the CG, in addition to a flexure. In an embodiment, a golf club head including a flexure in the sole of the golf club head has a CG-C-sa value that is greater than 18.0 mm behind the shaft axis, and preferably a CG-Z-fc value greater than 33.0 mm rearward of face center, and/or a moment-of-inertia value about the Y-axis of the golf club head of at least 450 kg-mm$^2$. Additionally, the golf club head has a at least one weight mounting feature and at least one removable weight that allows the CG of the golf club head to be altered by at least 2.0 mm in a direction.

Additionally, it is preferable to match the frequency of vibration of a golf club face with the frequency of vibration of a golf ball to maximize the golf ball speed off the face after an impact. The frequency of vibration of the face depends on the face parameters, such as the material's Young's modulus and Poisson's ratio, and the face geometry. The alpha-beta ($\alpha$-$\beta$) Ti alloys typically have a modulus in the range of 105-120 GPa. In contrast, current $\beta$-Ti alloys have a Young's modulus in the range of 48-100 GPa.

The material selection for a golf club head must also account for the durability of the golf club head through many impacts with golf balls. As a result, the fatigue life of the face must be considered, and the fatigue life is dependent on the strength of the selected material. Therefore, materials for the golf club head must be selected that provide the maximum ball speed from a face impact and adequate strength to provide an acceptable fatigue life.

The $\beta$-Ti alloys generally provide low Young's modulus, but are also usually accompanied by low material strength. The $\beta$-Ti alloys can generally be heat treated to achieve increases in strength, but the heat treatment also generally causes an increase in Young's modulus. However, $\beta$-ti alloys can be cold worked to increase the strength without significantly increasing the Young's modulus, and because the alloys generally have a body centered cubic crystal structure they can generally be cold worked extensively.

Preferably, a material having strength in a range of about 900-1200 MPa and a Young's modulus in a range of about 48-100 GPa is utilized for portions of the golf club head. For example, it would be preferably to use such a material for the face and/or flexure and/or flexure cover of the golf club head. Materials exhibiting characteristics in those ranges include titanium alloys that have generally been referred to as Gum Metals.

Although less preferable, heat treatment may be used on $\beta$-Ti to achieve an acceptable balance of strength and Young's modulus in the material. Previous applications of $\beta$-titanium alloys generally required heat treating to maximize the strength of the material without controlling Young's modulus. Titanium alloys go through a phase transition from hexagonal close packed crystal structure $\alpha$ phase to a body centered cubic $\beta$ phase when heated. The temperature at which this transformation occurs is called the $\beta$-transus temperature. Alloying elements added to titanium generally show either a preference to stabilize the $\alpha$ phase or the $\beta$ phase, and are therefore referred to as $\alpha$ stabilizers or $\beta$ stabilizers. It is possible to stabilize the $\beta$ phase even at room temperature by alloying titanium with a certain amount of $\beta$ stabilizers. However, if such an alloy is re-heated to elevated temperature, below the $\beta$-transus temperature, the $\beta$ phase decomposes and transforms into a phase as dictated by the thermodynamic rules. Those alloys are referred to as metastable $\beta$ titanium alloys.

While the thermodynamic laws only predict the formation of $\alpha$ phase, in reality a number of non-equilibrium phases appear on the decomposition of the $\beta$ phase. These non-equilibrium phases are denoted by $\alpha'$, $\alpha''$, and $\omega$. It has been reported that each of these phases has different Young's moduli and that the magnitude of the Young's modulus generally conforms with $\beta<\alpha''<\alpha<\omega$. Thus, it is speculated that if one desires to increase the strength of $\beta$-titanium through heat treatment, it would be advantageous to do it in such a manner that the material includes $\alpha''$ phase as a preferred decomposition product and we eliminate, or minimize the formation of $\alpha$ and $\omega$ phases. The formation of $\alpha''$ phase is facilitated by quenching from the $\alpha+\beta$ region on the material phase diagram, which means the alloy should be quenched from below the $\beta$-transus temperature. Therefore, preferably a $\beta$-Ti alloy that has been heat treated to maximize the formation of $\alpha''$ phase from the $\beta$ phase is used for a portion of the golf club head.

The heat treatment process is selected to provide the desired phase transformation. Heat treatment variables such as maximum temperature, time of hold, heating rate, quench rate are selected to create the desired material composition. Further, the heat treatment process may be specific to the alloy selected, because the effect of different $\beta$ stabilizing elements is not the same. For example, a Ti—Mo alloy would behave differently than Ti—Nb alloy, or a Ti—V alloy, or a Ti—Cr alloy; Mo, Nb, V and Cr are all $\beta$ stabilizers but have an effect of varying degree. The $\beta$-transus temperature range for metastable $\beta$-Ti alloys is about 700° C. to about 800° C. Therefore, for such alloys the solution treating temperature range would be about 25-50 Celsius degrees below the $\beta$-transus temperature, in practical terms the alloys would be solution treated in the range of about 650° C. to about 750° C. Following water quenching, it is possible to age the β-Ti alloys at low temperature to further increase strength. Strength of the solution treated material was measured to be about 650 MPa, while the heat treated alloy had a strength of 1050 MPa.

Examples of suitable beta titanium alloys include: Ti-15Mo-3Al, Ti-15Mo-3Nb-0.30, Ti-15Mo-5Zr-3Al, Ti-13Mo-7Zr-3Fe, Ti-13Mo, Ti-12Mo-6Zr-2Fe, Ti—Mo, Ti-35Nb-5Ta-7Zr, Ti-34Nb-9Zr-8Ta, Ti-29Nb-13Zr-2Cr, Ti-29Nb-15Zr-1.5Fe, Ti-29Nb-10Zr-0.5Si, Ti-29Nb-10Zr-0.5Fe-0.5Cr, Ti-29Nb-18Zr-Cr-0.5Si, Ti-29Nb-13Ta-4.6Zr, Ti—Nb, Ti-22V-4Al, Ti-15V-6Cr-4Al, Ti-15V-3Cr-3Al-3Sn, Ti-13V-11Cr, Ti-10V-2Fe-3Al, Ti-5Al-5V-5Mo-3Cr, Ti-3Al-8V-6Cr-4Mo-4-Zr, Ti-1.5Al-5.5Fe-6.8Mo, Ti-13Cr-1Fe-3Al, Ti-6.3Cr-5.5Mo-4.0Al-0.2Si, Ti—Cr, Ti—Ta alloys, the Gum Metal family of alloys represented by Ti+25 mol % (Ta, Nb, V)+(Zr, Hf, O), for example, Ti-36Nb-2Ta-3Zr-0.350, etc (by weight percent). Near beta titanium alloys may include: SP-700, TIMET 18, etc.

In general, it is preferred that a face cup or face insert of the inventive golf club head be constructed from α-β or near-β titanium alloys due to their high strength, such as Ti-64, Ti-17, ATI425, TIMET 54, Ti-9, TIMET 639, VL-Ti, KS ELF, SP-700, etc. Further, the rear portion of the golf club body (i.e., the portion other than the face cup, face insert, flexure and flexure cover) is preferably made from α, α-β, or β titanium alloys, such as Ti-8Al-1V-1Mo, Ti-8Al-1Fe, Ti-5Al-1Sn-1Zr-1V-0.8Mo, Ti-3Al-2.5Sn, Ti-3Al-2V, Ti-64, etc.

As described previously, the flexure may be constructed as a separate component and attached to the remainder of a golf club head body. For example, the flexure component may be stamped and formed from wrought sheet material and the remainder of the body constructed as one or more cast components. Stamping a flexure component may be preferable over casting the flexure because casting can introduce mechanical shortcomings. For example, cast materials often suffer from lower mechanical properties as compared to the same material in a wrought form. As an example, Ti-64 in cast form has mechanical properties about 10%-20% lower as compared to wrought Ti-64. This is because the grain size in castings is significantly larger as compared to the wrought forms, and generally finer grain size results in higher mechanical properties in metallic materials.

Further, titanium castings also develop a surface layer called "alpha case", a region at the surface that has predominantly alpha phase of titanium that results from titanium that is enriched with interstitial oxygen. The alpha phase in and of itself is not detrimental, but it tends to be very hard and brittle so in fatigue applications, such as repeated golf ball impacts that cause repeated flexing, the alpha case can compromise the durability of the component.

Most titanium alloys are almost impossible to form at room temperature. Thus, the titanium alloys have to be heated to an elevated temperature to form them. The temperature necessary to form the alloy will depend on the alloy's composition, and alloys that have higher beta transus temperature typically require higher forming temperatures. Exposure to elevated temperature results in lowered mechanical properties when the material is cooled down to ambient temperature. Additionally, the exposure to elevated temperature results in the formation of an oxide layer at the surface. This oxide layer is almost like the "alpha case" discussed above except that it typically does not extend as deep into the material. Thus, it is beneficial if the forming temperature can be lowered.

Generally, if using Ti-64 as a baseline since it is commonly used in the construction of metal wood type golf club heads, alloys that have beta transus temperatures that are lower than that of Ti-64 can provide a significant benefit. For example, one such alloy is ATI 425, which has a beta transus temperature in the range of about 957°-971° C., while Ti-64 has a beta transus temperature of about 995° C. Thus, it can be expected that ATI 425 can be formed at a lower temperature as compared to Ti-64. Since ATI 425 has mechanical properties comparable to Ti-64 at room temperature, it is expected that a sole fabricated from ATI 425 alloy will be stronger as compared to a sole made from Ti-64. In addition, ATI 425 generally has better formability as compared to Ti-64, so in an example, a flexure is formed of ATI 425 sheet material and will experience less cross-sectional thinning than a flexure formed of a Ti-64 sheet material. Further, ATI 425 may be cold formable which would further result in a stronger component.

In an example, a multi-material golf club head is constructed from components constructed of Ti-64 and ATI 425. A body including a crown, a sole or partial sole, a skirt, a hosel and a face flange may be cast of Ti-64. Then a portion of the sole may be formed by a flexure component that is constructed from ATI 425 sheet material and welded to the cast Ti-64 body, such as in a slot or recess, such as in the configuration shown in FIGS. 5 and 6. A forged face insert is then welded to the face flange of the cast Ti-64 to complete the head.

Various manufacturing methods may be used to construct the various components of the golf club head of the present invention. Preferably all of the components are joined by welding. The welding processes may be manual, such as TIG or MIG welding, or they may be automated, such as laser, plasma, e-beam, ion beam, or combinations thereof. Other joining processes may also be utilized if desired or required due to the material selections, such as brazing and adhesive bonding.

The components may be created using stamping and forming processes, casting processes, molding processes and/or forging processes. As used herein, forging is a process that causes a substantial change to the shape of a specimen, such as starting with a bar and transforming it into a sheet, that characteristically includes both dimensional and shape changes. Additionally, forging generally is performed at higher temperature and may include a change in the microstructure of the material, such as a change in the grain shape. Forming is generally used to describe a process in which a material is shaped while generally retaining the dimension of the material, such as by starting with a sheet material and shaping the sheet without significantly changing the thickness. The following are examples of material selections for the portions of the golf club head utilizing stamping and forming processes:

a) α-β face member+β flexure+α-β rear body b) β face member+α-β face insert+β flexure+α-β rear body c) β face member+α-β face insert+β flexure+β rear body d) β face member+α-β face insert+β flexure+α-β rear body (Heat Treated)

The following are examples of material selections for the portions of the golf club head utilizing cast components:

a) Cast α-β face member+Cast β flexure+Cast α-β rear body b) Formed α-β face member+Cast β flexure+Cast α-β rear body c) Formed α-β face member+Cast β flexure+Formed α-β rear body d) Cast α-β face member+Cast β flexure+Formed α-β rear body The following are examples of material selections for the portions of the golf club head utilizing forged components:

a) Forged α-β face member+Cast β flexure+Cast α-β rear body b) Forged α-β face member+Cast β flexure+Formed α-β rear body The density of β alloys is generally greater than the density of α-β or α alloys. As a result, the use of β alloys in various portions of the golf club head will result in those portions having a greater mass. Light weight alloys may be used in the rear portion of the body so that the overall golf club head mass may be maintained in a desired range, such as between about 170 g and 210 g for driver-type golf club heads. Materials such as aluminum alloys, magnesium alloys, carbon fiber composites, carbon nano-tube composites, glass fiber composites, reinforced plastics and combinations of those materials may be utilized.

While various descriptions of the present invention are described above, it should be understood that the various features of each embodiment could be used alone or in any combination thereof. Therefore, this invention is not to be limited to only the specifically preferred embodiments depicted herein. Further, it should be understood that variations and modifications within the spirit and scope of the invention might occur to those skilled in the art to which the invention pertains. For example, the face insert may have thickness variations in a step-wise continuous fashion. In addition, the shapes and locations of the slots are not limited to those disclosed herein. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

We claim:

1. A golf club head, comprising:

a crown defining an upper surface of the golf club head;

a sole defining a lower surface of the golf club head, comprising a transmittal portion, a flexure and a rear portion, wherein the flexure is defined by a front wall that is spaced from a rear wall to define a cavity, wherein each of the front wall and the rear wall extend from the sole toward an interior of the golf club head to upper free ends;

a side wall extending between the crown and the sole;

a hosel including a shaft bore;

a face defining a front ball-striking surface and a back surface, the face intersecting the transmittal portion at a leading edge; and a filler at least partially filling the cavity defined between the front wall and the rear wall of the flexure, wherein the filler is exposed to the interior of the golf club head, wherein the golf club head defines an origin at a location on a shaft axis defined by the shaft bore in a plane defined by a proximal end of the hosel, an x-axis extending from the origin in a heel to toe direction and parallel to a plane that is tangent to the face at a geometric face center of the ball-striking surface, a y-axis extending vertically through the origin and perpendicular to a ground plane when the golf club head is in an address position on the ground plane, and a z-axis extending in a face to aft direction parallel to the ground plane when the golf club head is in an address position, wherein the flexure is spaced aftward of the ball-striking surface by the transmittal portion;

wherein the front wall is angled away from the face as the front wall extends toward the interior of the golf club head;

wherein the front wall is angled relative to the ground plane by an angle θ, where $90° < \theta < 135°$;

wherein the filler is constructed from at least one viscoelastic polymer having a hardness value in a range of Shore A20 Shore D80;

wherein a height of the filler is in a range of about 2.0 mm to about 10.0 mm;

wherein the filler includes a notch that extends along at least a portion of a length of the filler;

wherein the flexure is spaced from the ball-striking surface by a distance that is between 20% and 50% of a CG-Z-fc distance between the geometric face center of the golf club head and the center of gravity of the golf club head along a horizontal Z-axis that extends from the face to the aft of the golf club head;

wherein the transmittal portion of the sole defines a first positive angled bounce surface between the face and the flexure of the golf club head, and wherein the rear portion of the sole defines a second positive angled bounce surface between the flexure and a rear end of the golf club head.

2. A golf club head, comprising:

a crown defining an upper surface of the golf club head;

a sole defining a lower surface of the golf club head, comprising a transmittal portion, a flexure and a rear portion, wherein the flexure is defined by a front wall that is spaced from a rear wall to define a cavity, wherein each of the front wall and the rear wall extend from the sole toward an interior of the golf club head to upper free ends;

a side wall extending between the crown and the sole;

a hosel including a shaft bore;

a face defining a front ball-striking surface and a back surface, the face intersecting the transmittal portion at a leading edge; and a filler at least partially filling the cavity defined between the front wall and the rear wall of the flexure, wherein the filler is exposed to the interior of the golf club head, wherein the golf club head defines an origin at a location on a shaft axis defined by the shaft bore in a plane defined by a proximal end of the hosel, an x-axis extending from the origin in a heel to toe direction and parallel to a plane that is tangent to the face at a geometric face center of the ball-striking surface, a y-axis extending vertically through the origin and perpendicular to a ground plane when the golf club head is in an address position on the ground plane, and a z-axis extending in a face to aft direction parallel to the ground plane when the golf club head is in an address position, wherein the flexure is spaced aftward of the ball-striking surface by the transmittal portion;

wherein the front wall is angled away from the face as the front wall extends toward the interior of the golf club head; wherein the transmittal portion of the sole defines a first positive angled bounce surface between the face and the flexure of the golf club head, and wherein the rear portion of the sole defines a second positive angled bounce surface between the flexure and a rear end of the golf club head;

wherein the first positive angled bounce surface includes a linear portion and defines a bounce angle that is between about 2° and about 20° and wherein the second positive angled bounce surface includes a linear portion and defines a bounce angle that is between about 2° and about 20°.

3. The golf club head of claim 2, wherein the front wall is angled relative to the ground plane by an angle θ, where 90°<θ<135°.

4. The golf club head of claim 2, wherein the filler is constructed from at least one viscoelastic polymer having a hardness value in a range of Shore A20 Shore D80.

5. The golf club head of claim 2, wherein a height of the filler is in a range of about 2.0 mm to about 10.0 mm.

6. The golf club head of claim 2, wherein the filler includes a notch that extends along at least a portion of a length of the filler.

7. The golf club head of claim 2, wherein the flexure is spaced from the ball-striking surface by a distance that is between 20% and 50% of a CG-Z-fc distance between the geometric face center of the golf club head and the center of gravity of the golf club head along a horizontal Z-axis that extends from the face to the aft of the golf club head.

8. The golf club head of claim 2, wherein at least a portion of the front wall is curved towards the rear wall.

9. The golf club head of claim 2, wherein the front wall has a wall thickness of about 0.9 mm to about 2.0 mm.

10. A golf club head, comprising:

a crown defining an upper surface of the golf club head;

a sole defining a lower surface of the golf club head, comprising a transmittal portion, a flexure and a rear portion, wherein the flexure is defined by a front wall that is spaced from a rear wall to define a cavity, wherein each of the front wall and the rear wall extend from the sole toward an interior of the golf club head to upper free ends;

a side wall extending between the crown and the sole;

a hosel including a shaft bore;

a face defining a front ball-striking surface and a back surface, the face intersecting the transmittal portion at a leading edge; and a filler at least partially filling the cavity defined between the front wall and the rear wall of the flexure, wherein the filler is exposed to the interior of the golf club head, wherein the golf club head defines an origin at a location on a shaft axis defined by the shaft bore in a plane defined by a proximal end of the hosel, an x-axis extending from the origin in a heel to toe direction and parallel to a plane that is tangent to the face at a geometric face center of the ball-striking surface, a y-axis extending vertically through the origin and perpendicular to a ground plane when the golf club head is in an address position on the ground plane, and a z-axis extending in a face to aft direction parallel to the ground plane when the golf club head is in an address position, wherein the flexure is spaced aftward of the ball-striking surface by the transmittal portion;

wherein the transmittal portion of the sole defines a first positive angled bounce surface between the face and the flexure of the golf club head, and wherein the rear portion of the sole defines a second positive angled bounce surface between the flexure and a rear end of the golf club head;

wherein the first positive angled bounce surface includes a linear portion and defines a bounce angle that is between about 2° and about 20° and wherein the second positive angled bounce surface includes a linear portion and defines a bounce angle that is between about 2° and about 20°.

11. The golf club head of claim 10, wherein the front wall is angled relative to the ground plane by an angle θ, where 90°<θ<135°.

12. The golf club head of claim 10, wherein the filler is constructed from at least one viscoelastic polymer having a hardness value in a range of Shore A20-Shore D80.

13. The golf club head of claim 10, wherein a height of the filler is in a range of about 2.0 mm to about 10.0 mm.

14. The golf club head of claim 10, wherein the filler includes a notch that extends along at least a portion of a length of the filler.

15. The golf club head of claim 10, wherein the front wall has a wall thickness of about 0.9 mm to about 2.0 mm.

16. The golf club head of claim 10, wherein at least a portion of the front wall is curved towards the rear wall.

* * * * *